US012778222B2

(12) United States Patent
Karakoc

(10) Patent No.: US 12,778,222 B2
(45) Date of Patent: Nov. 3, 2026

(54) RELOCATABLE PROTECTION SYSTEM

(71) Applicant: Ahmet Karakoc, Sewell, NJ (US)

(72) Inventor: Ahmet Karakoc, Sewell, NJ (US)

( * ) Notice: Subject to any disclaimer, the term of this patent is extended or adjusted under 35 U.S.C. 154(b) by 0 days.

(21) Appl. No.: 19/258,937

(22) Filed: Jul. 3, 2025

(65) Prior Publication Data

US 2026/0033567 A1 Feb. 5, 2026

Related U.S. Application Data

(63) Continuation-in-part of application No. 19/226,062, filed on Jun. 2, 2025, now abandoned, which is a continuation-in-part of application No. 18/111,530, filed on Feb. 17, 2023, now abandoned.

(51) Int. Cl.

| | |
|---|---|
| ***A41D 13/06*** | (2006.01) |
| ***A41D 1/06*** | (2006.01) |
| ***A41D 13/05*** | (2006.01) |
| ***A41D 27/20*** | (2006.01) |

(52) U.S. Cl.

CPC ..... *A41D 13/065* (2013.01); *A41D 1/06* (2013.01); *A41D 13/0543* (2013.01); *A41D 13/0568* (2013.01); *A41D 13/0575* (2013.01); *A41D 27/20* (2013.01)

(58) Field of Classification Search

CPC ..... A41D 13/065; A41D 13/0153; A41D 13/0543; A41D 13/0568; A41D 2500/50; A41D 2600/10; A41D 1/06; A41D 27/20; A63B 71/1225; A63B 71/125; A63B 2071/125; A63B 2209/10;

(Continued)

(56) References Cited

U.S. PATENT DOCUMENTS 2,561,872 A * 7/1951 Krinick ..... A41D 13/065 2/24
4,453,271 A * 6/1984 Donzis ..... A41D 13/0153 2/2.5

(Continued)

FOREIGN PATENT DOCUMENTS

DE 4137766 A1 * 5/1993 ..... A41D 13/065
JP 2007215822 A * 8/2007

OTHER PUBLICATIONS

"Snap Fit Joints Design Guideline." Erye. Sep. 10, 2025. https://www.eycpu.com/blog/snap-fit-joints-design-guideline/ (Year: 2025).*

*Primary Examiner* — Grace Huang
(74) *Attorney, Agent, or Firm* — Ashok Tankha

(57) ABSTRACT has A relocatable protection system (RPS) a base padding (BP), a shell, a slip-resistant layer, and a fastening mechanism comprising retention members, straps and slotted anchor plates. The BP is configured to provide cushioning to a body part of a wearer. The shell of the RPS is positioned over the BP. The slip-resistant layer is positioned over the shell. The RPS is paired with a pair of trousers (PT) to form a kit for use by a wearer. The PT comprises a pair of elongated pockets (PEPs), each attached to a front section of a trouser leg of the PT and comprising a top opening. Furthermore, each of the PEPs comprise adjacently located loops on a first longitudinal side and a second longitudinal side of the PEPs. The PEPs comprise openings disposed below the first and second longitudinal sides of the PEPs.

22 Claims, 47 Drawing Sheets

(58) Field of Classification Search
CPC .... A63B 2071/1241; A63B 2071/1266; A63B 2071/1258; A63B 2071/1275
USPC ..... 2/24, 22
See application file for complete search history.

(56) References Cited

U.S. PATENT DOCUMENTS 4,561,123 A * 12/1985 Hull ..... A41D 13/065 2/24
4,613,991 A * 9/1986 Grover ..... A41D 27/20 2/23
4,985,931 A * 1/1991 Wingo, Jr. ..... A41D 31/285 2/268
5,065,457 A * 11/1991 Henson ..... A63B 71/12 2/24
5,105,473 A * 4/1992 Valtakari ..... A41D 13/0575 2/24
5,309,570 A * 5/1994 Grimm ..... A41D 13/065 2/24
5,455,969 A * 10/1995 Pratson ..... A41D 13/065 2/24
5,592,689 A * 1/1997 Matthews ..... A41D 13/0562 2/24
5,652,961 A * 8/1997 Knight-Yurt ..... A41D 13/12 2/114
6,347,403 B1 * 2/2002 Wilcox ..... A41D 13/065 2/24
6,745,398 B1 * 6/2004 Hennessey ..... A41D 1/067 2/23
6,988,281 B1 * 1/2006 Jerome ..... A41D 13/0568 2/24
7,143,484 B2 * 12/2006 Lee ..... A63B 33/004 2/452
7,219,372 B2 * 5/2007 Frieler ..... A41D 13/065 2/23
7,380,283 B1 * 6/2008 Dumont ..... A41D 13/065 2/23
7,490,360 B2 * 2/2009 Meadows ..... A41D 13/065 2/23
7,937,768 B2 * 5/2011 Behrend ..... A63B 71/1225 2/24
7,945,968 B2 * 5/2011 Johnson ..... A41D 13/065 2/23
11,771,297 B1 * 10/2023 James ..... A47L 13/42 15/209.1
12,041,976 B2 * 7/2024 Reid ..... A41D 7/00
12,302,960 B2 * 5/2025 Schaaper ..... A41D 13/0512
2002/0007509 A1 * 1/2002 Kamada ..... A41D 13/08 2/455
2008/0222767 A1 * 9/2008 Williams ..... A41D 13/0556 2/24
2008/0289072 A1 * 11/2008 Shin ..... A41D 13/0556 2/24
2013/0061365 A1 * 3/2013 Arceo ..... A41D 13/0568 2/24
2014/0230116 A1 * 8/2014 Weber ..... A41D 13/0543 2/22
2014/0237696 A1 * 8/2014 Carver ..... A41D 13/08 2/24
2014/0325729 A1 * 11/2014 Hsieh ..... A41D 13/08 2/24
2024/0057698 A1 * 2/2024 Finley ..... A41D 13/065
2024/0382820 A1 * 11/2024 Ceolin ..... A63B 71/1225
2025/0000215 A1 * 1/2025 Xia ..... A41F 1/002
2025/0040634 A1 * 2/2025 Arslan ..... A63B 71/1225
2025/0185736 A1 * 6/2025 Niffenegger ..... A41D 13/0562
2025/0221476 A1 * 7/2025 Worple ..... A41D 13/0156

* cited by examiner

RELOCATABLE PROTECTION SYSTEM

CROSS-REFERENCE TO RELATED APPLICATIONS

This application is a continuation-in-part of non-provisional patent application titled "Relocatable Protective Padding System for Clothing", application Ser. No. 19/226,062, filed in the United States Patent and Trademark Office on Jun. 2, 2025 which is a continuation-in-part of non-provisional patent application titled "Relocatable Protective Padding System", application Ser. No. 18/111,530, filed in the United States Patent and Trademark Office on Feb. 17, 2023. The specifications of the above referenced patent applications are incorporated herein by reference in their entirety.

FIELD OF THE INVENTION

The present invention relates generally to protective clothing and more specifically to clothing with removable and relocatable impact protection pads such as knee pads, shin pads and holders. The present invention is related to products that provide protection and comfort for the user's lower leg region, namely the knee and shins. More specifically, the present invention relates to products that provide the user an adjustable, removable, and relocatable knee pad holder and/or shin guard holder for apparel including work pants. The present invention is also related to products used for shins, elbows, spine, hips, thighs and shoulder protection among other places, for work, sports and motor racing applications.

BACKGROUND

There are numerous occupations that require protection for the knees and or shins in order to prevent injuries and to ensure the safety of the worker Typical occupations that require occasional to continuous kneeling are baggage handlers, carpenters, roofers, tile installers, and carpet layers where it is desirable to protect the knees and shins are carpenters, electricians, floor tilers, roofers, installers, etc. These occupations demand a lot of physical labor and may cause the worker to kneel for an extended period of time. It is important that suitable padding is provided for the worker's knee or shin not only to provide comfort while working but also to avoid potential injury or damage to the knee or shin due to the exposure to high pressures while kneeling and accidents of the workplace.

Kneepads are designed to reduce the chance of injury and to provide comfort to the user while kneeling. Typical kneepads are big and awkward and have a tendency to migrate down the legs. Specifically, traditional knee pads with straps that go behind the leg are very uncomfortable to wear. The straps pinch and bind and the pad moves around on the leg. Since the pad rubs against the knee, the knee pad causes perspiration and chafing of that area. The knee pads also move into the wrong place often and need to be adjusted causing additional chafing and discomfort.

Hence there is a long-felt need for an adjustable knee pad that provides cushioning to the knees. There is also a long-felt need for an adjustable knee pad that can absorb impact on the knees. There is also a long-felt need for an adjustable knee pad that is slip resistant when the wearer kneels down on surface.

BRIEF DESCRIPTION OF THE DRAWINGS

The foregoing summary, as well as the following detailed description of the invention, is better understood when read in conjunction with the appended drawings. For illustrating the invention, exemplary constructions of the invention are shown in the drawings. However, the invention is not limited to the specific structures/components disclosed herein. The description of a structure/component referenced by a numeral in a drawing is applicable to the description of that structure/component shown by that same numeral in any subsequent drawing herein.

DETAILED DESCRIPTION OF THE INVENTION

Figure 1:
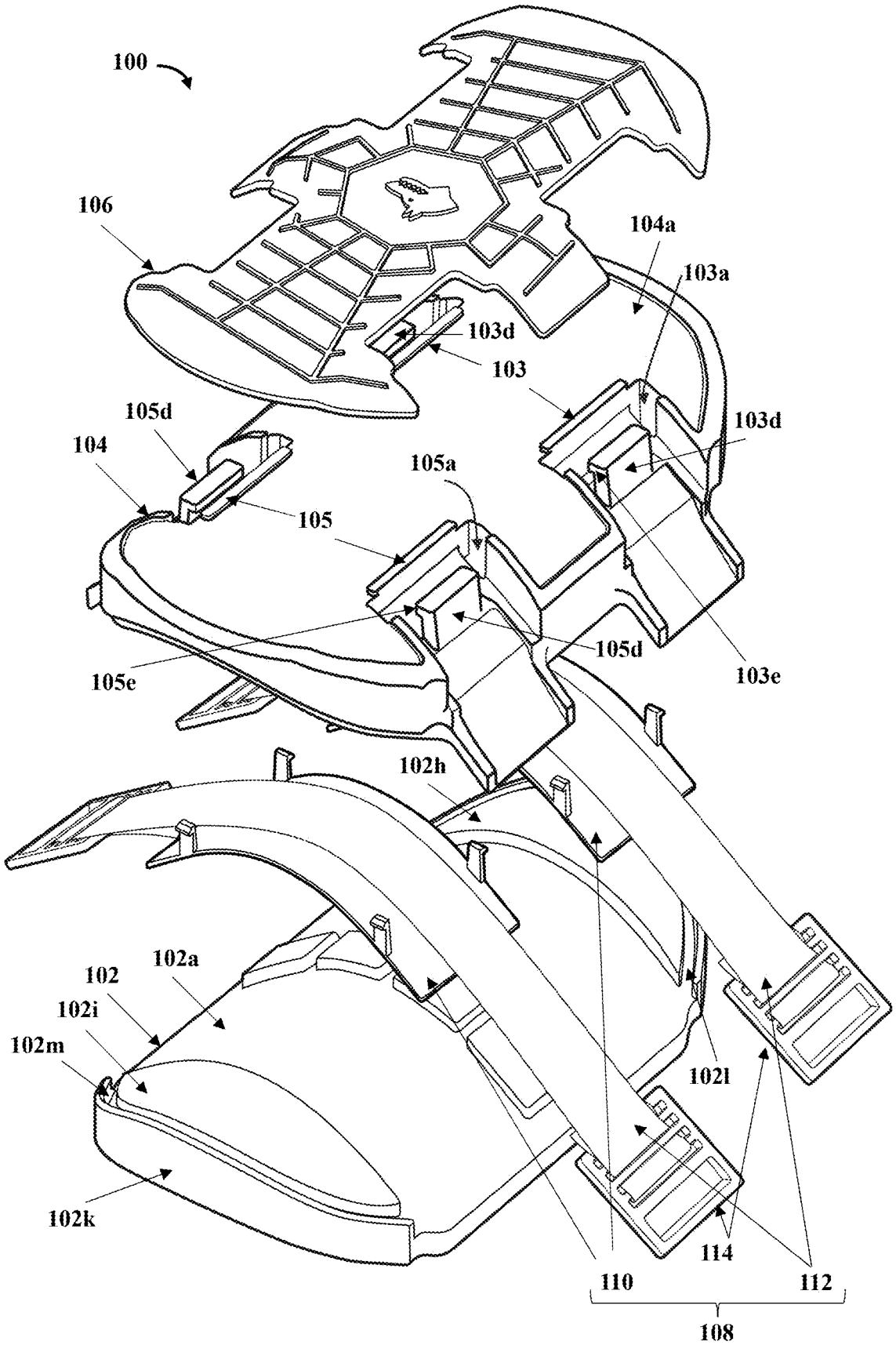
FIG. 1 illustrates an exploded front, top perspective view of a relocatable protection system comprising a base padding, a shell, a slip-resistant layer, and a fastening mechanism comprising retention members and straps.
Figure 2:
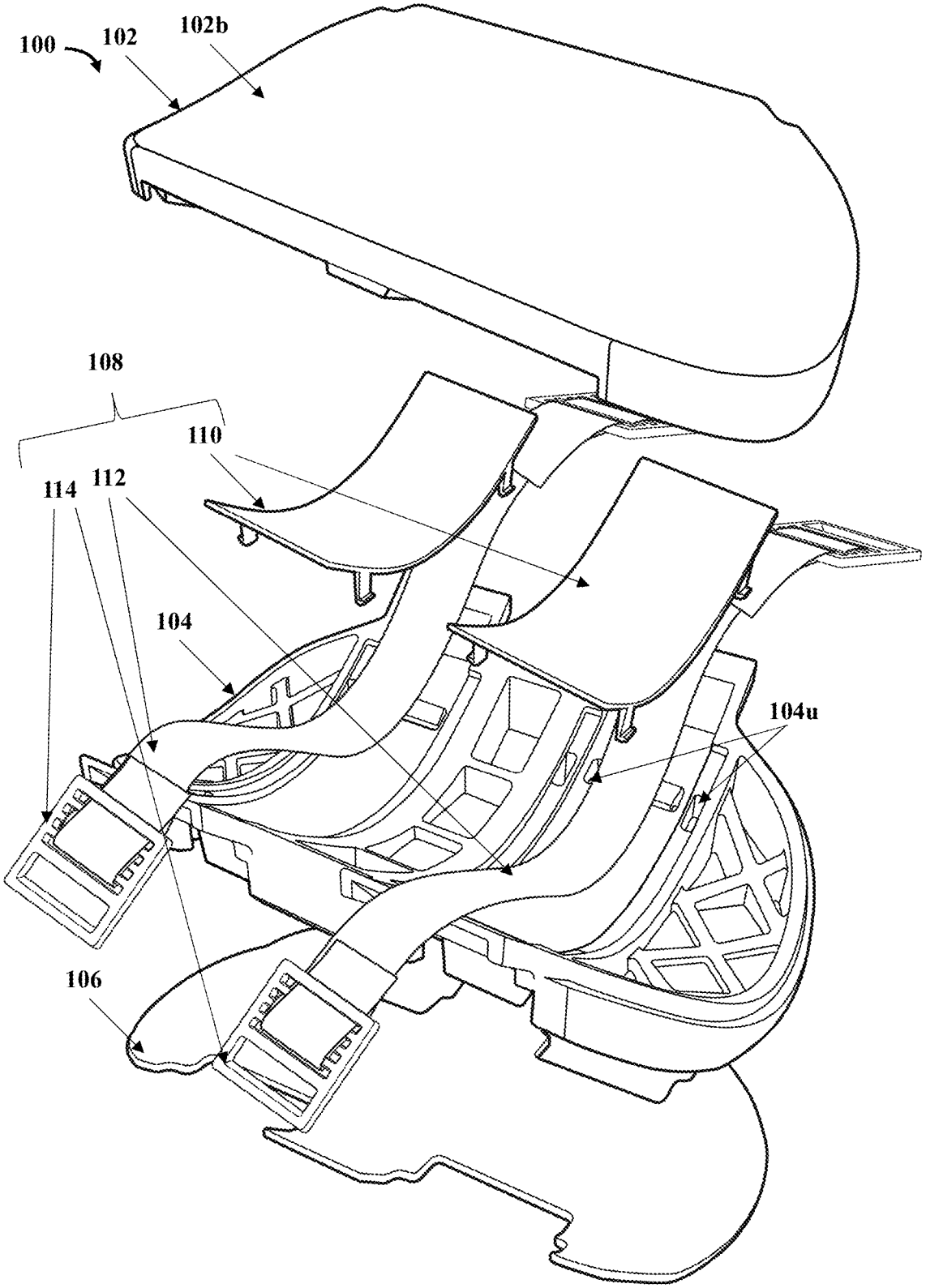
FIG. 2 illustrates an exploded front bottom perspective view of the relocatable protection system.

The relocatable protection system 100 disclosed herein addresses the above-mentioned long-felt need for an adjustable knee pad that provides cushioning to the knees. The relocatable protection system 100 disclosed herein also addresses the above-mentioned need for an adjustable knee pad that can absorb impact on the knees. The relocatable protection system 100 disclosed herein also addresses the above-mentioned need for an adjustable knee pad that is slip resistant when the wearer kneels down on surf-ace. FIG. 1 illustrates an exploded front, top perspective view of a relocatable protection system 100 comprising a base padding 102, a shell 104, a slip-resistant layer 106, and a fastening mechanism 108 comprising retention members 110, straps 112 and slotted anchor plates 114. The base padding 102 comprises a base padding upper surface 102*a*, shown in FIG. 1, and a base padding lower surface 102*b*, shown in FIG. 2. The base padding lower surface 102*b* is shaped to substantially conform to a wearer's body part, for example, a knee, an elbow, a thigh, a shin, a forearm, an upper arm, etc. The base padding 102 is configured to provide cushioning to the body part of the wearer. FIG. 2 illustrates an exploded front bottom perspective view of the relocatable protection system 100. As shown in FIGS. 1 and 2, the base padding 102 has a capsule shape. In an embodiment, the base padding 102, the shell 104 and the slip resistant layer 106 has either a rounded rectangular shape, an oval shape or a capsule shape.

Figure 3:
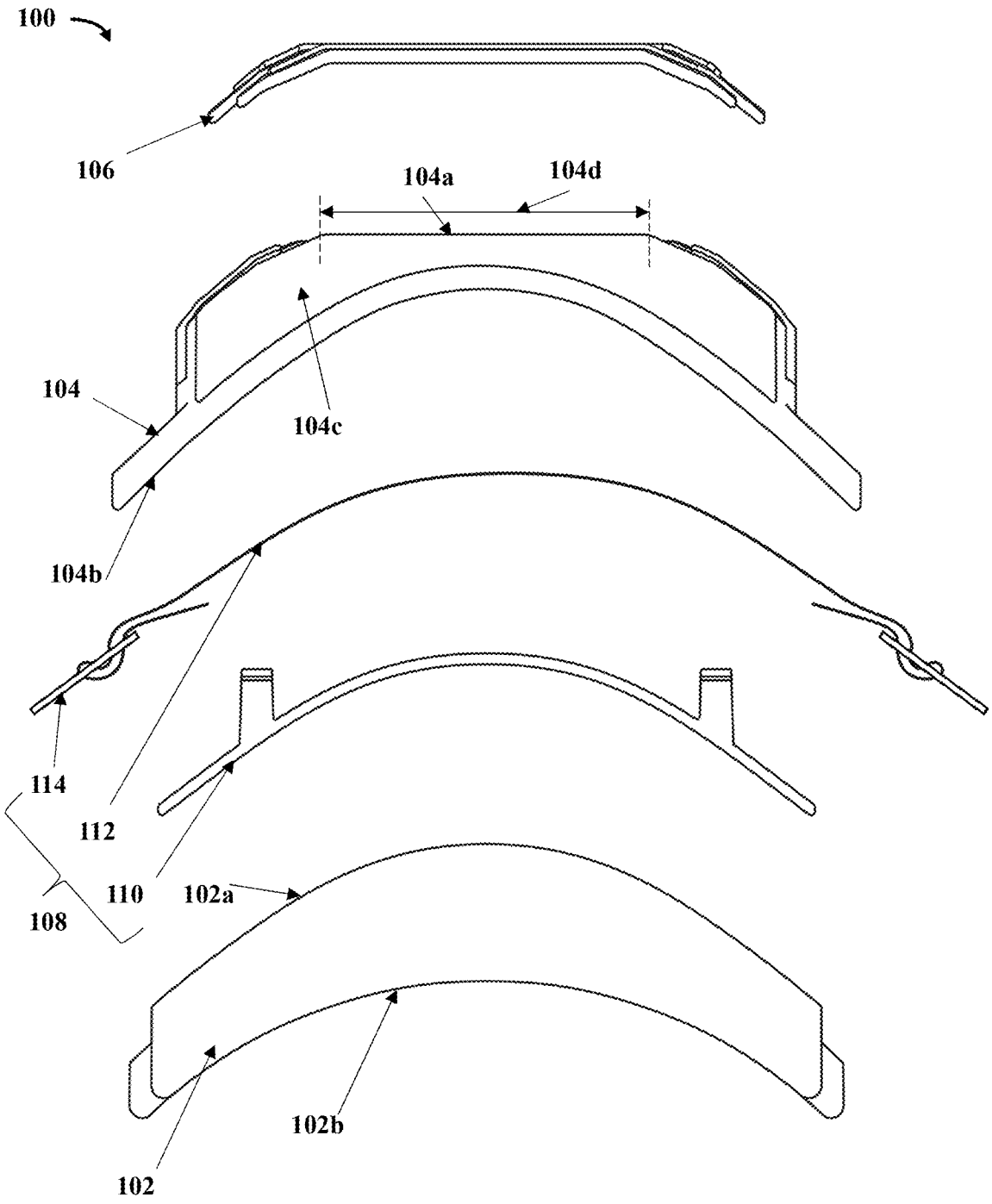
FIG. 3 illustrates an exploded front view of the relocatable protection system.
Figure 4A:
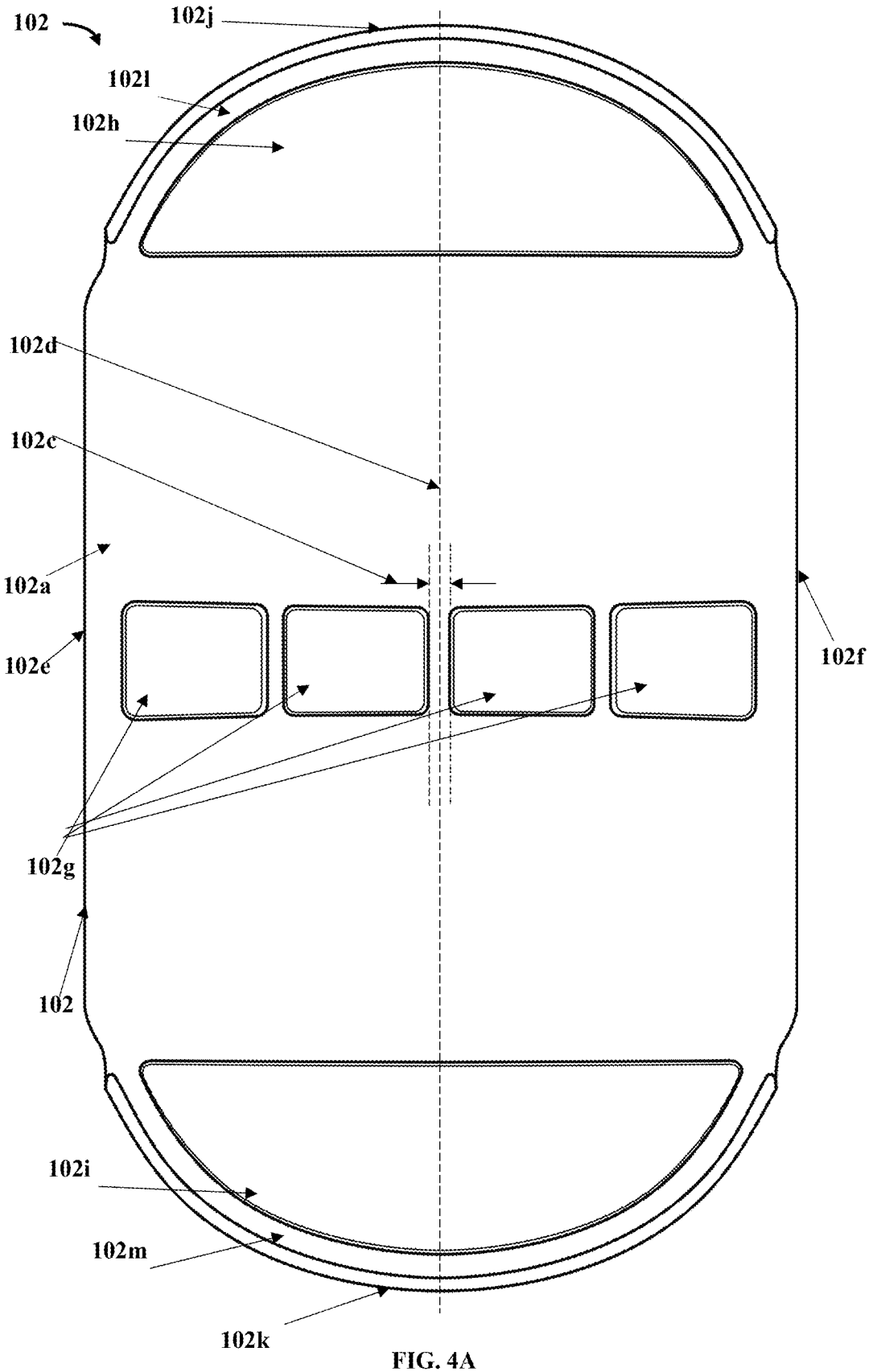
FIG. 4A illustrates a front view of the base padding.
Figure 4B:
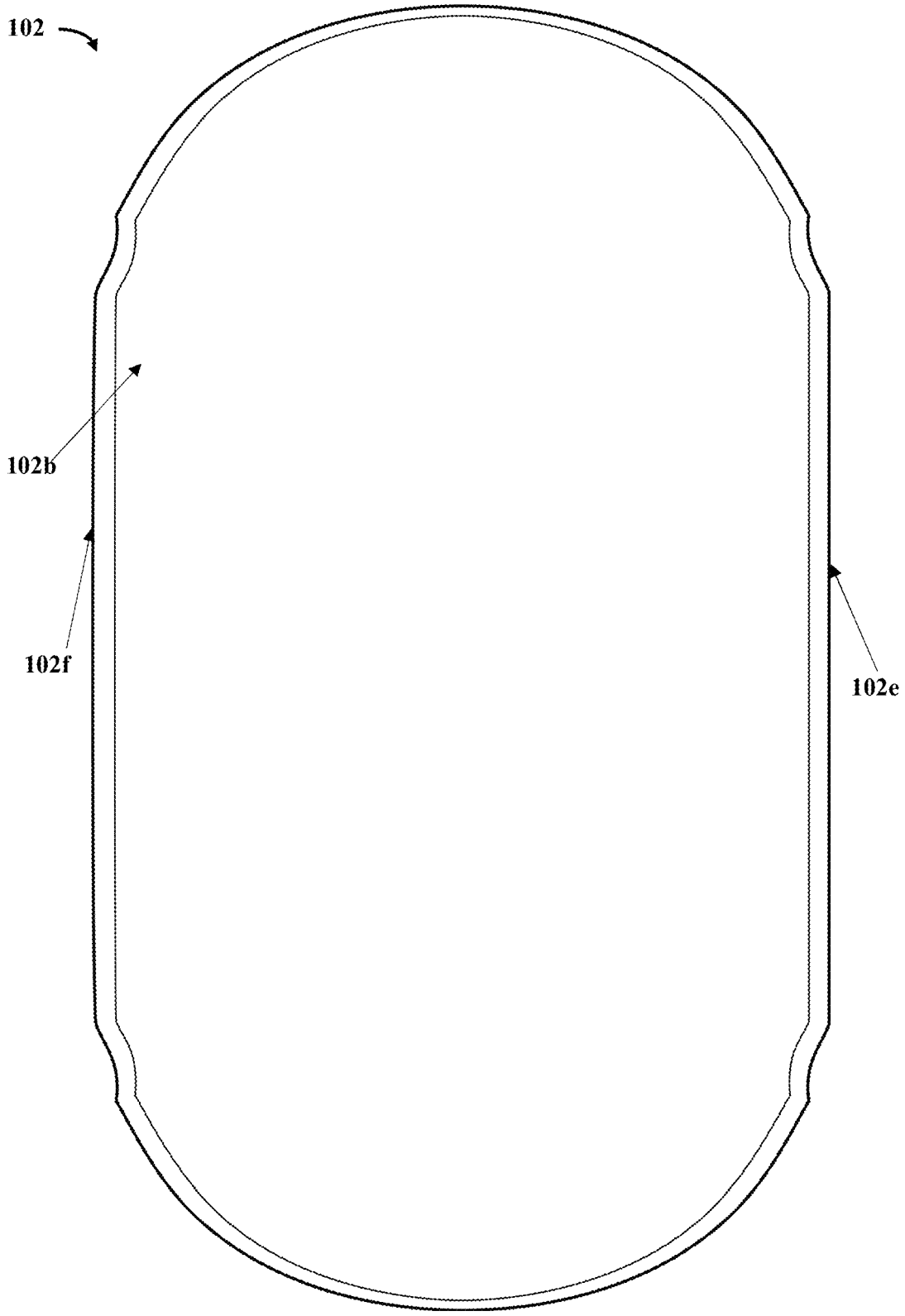
FIG. 4B illustrates a rear view of the base padding.
Figure 4C:
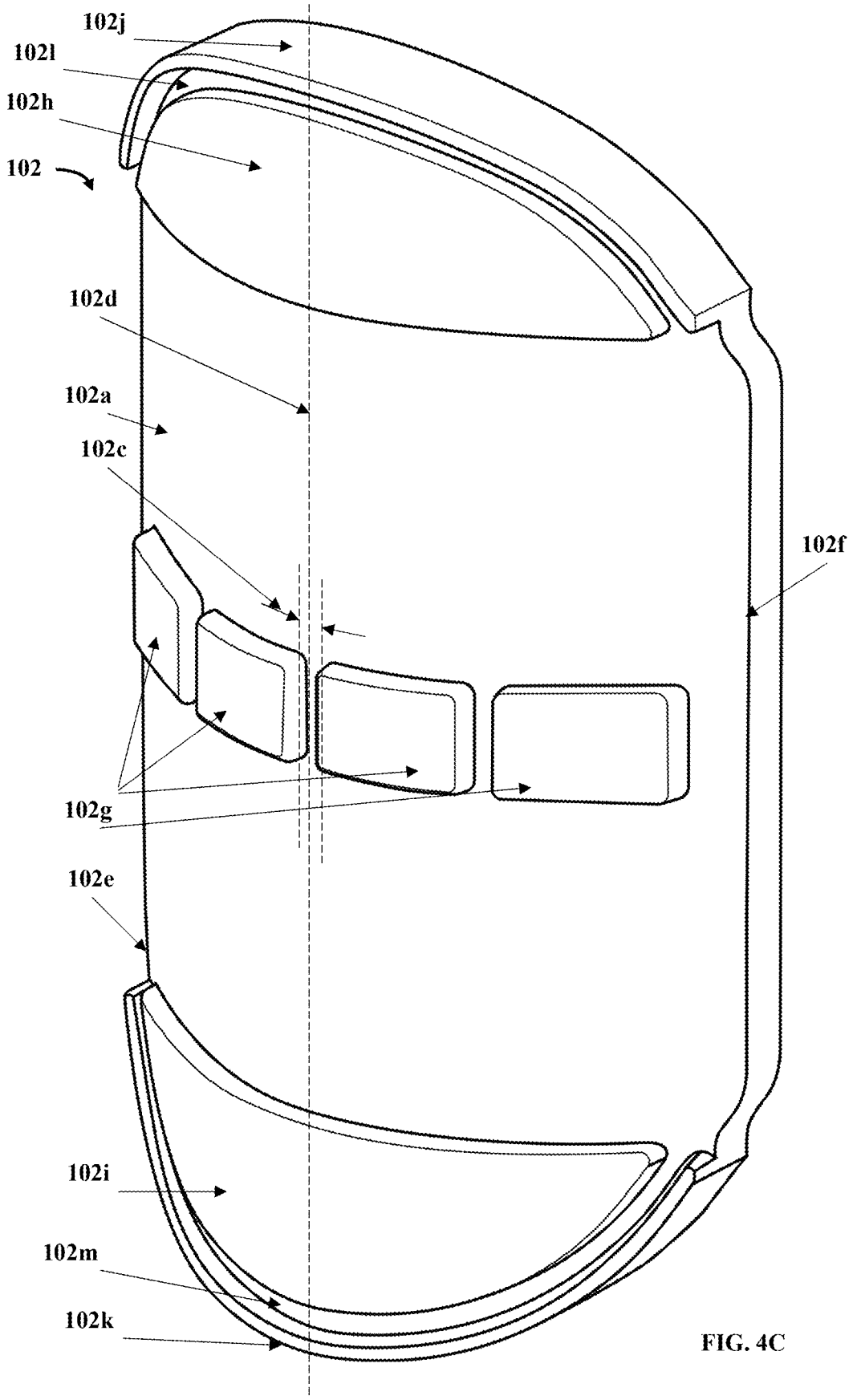
FIG. 4C illustrates a front, right-side perspective view of the base padding.

FIG. 3 illustrates an exploded front view of the relocatable protection system 100. In an embodiment, the base padding 102 has a lateral cross-sectional shape of either a curved arch, as shown in FIG. 3 or a segmental arch. FIG. 4A illustrates a front view of the base padding 102. FIG. 4B illustrates a rear view of the base padding 102. FIG. 4C illustrates a front, right-side perspective view of the base padding 102. The padding upper surface 102*a* comprises a mid-section 102*c* located along a longitudinal axis 102*d* of the padding upper surface 102*a*. The padding upper surface 102*a* curves downwards from the mid-section 102*c* located along the longitudinal axis 102*d* to both sides 102*e* and 102*f* of the padding upper surface 102*a* that are parallel to the longitudinal axis 102*d*. The padding upper surface 102*a* further comprises a plurality of protrusions 102*g* disposed along a width of the base padding 102 at the mid-section 102*c* of the padding upper surface 102*a*. The protrusions 102*g* have a generally square shape and are spaced apart from an adjacent one of the protrusions 102*g*, as shown in FIGS. 4A and 4C. As shown in FIGS. 1, 4A, 4C, 4E and 4F, the padding upper surface 102*a* further comprises a first supplemental padding section 102*h* integrally formed at a first end 102*j* of the padding upper surface 102*a* and a second supplemental padding section 102*i* integrally formed at a second end 102*k* of the padding upper surface 102*a*.

Figure 4D:
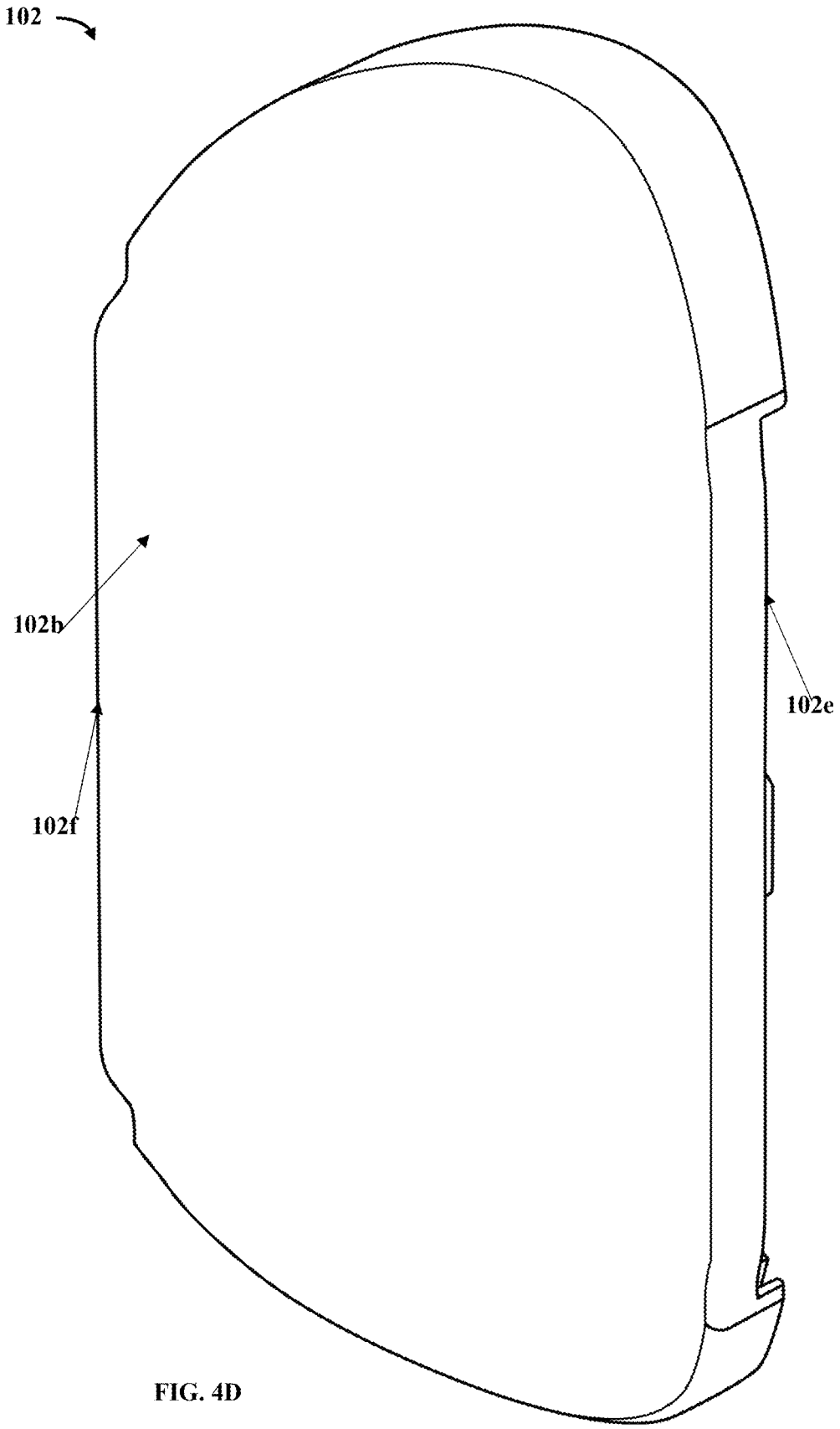
FIG. 4D illustrates a rear, left-side perspective view of the base padding.
Figure 4E:
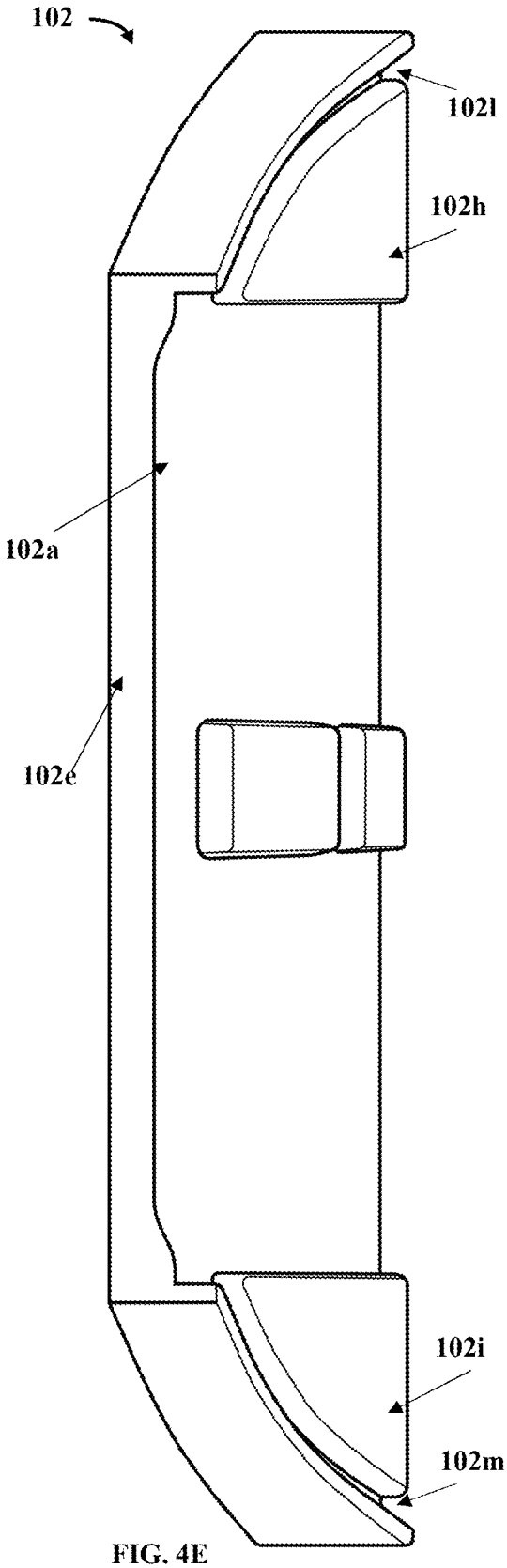
FIG. 4E illustrates a left-side view of the base padding.
Figure 4F:
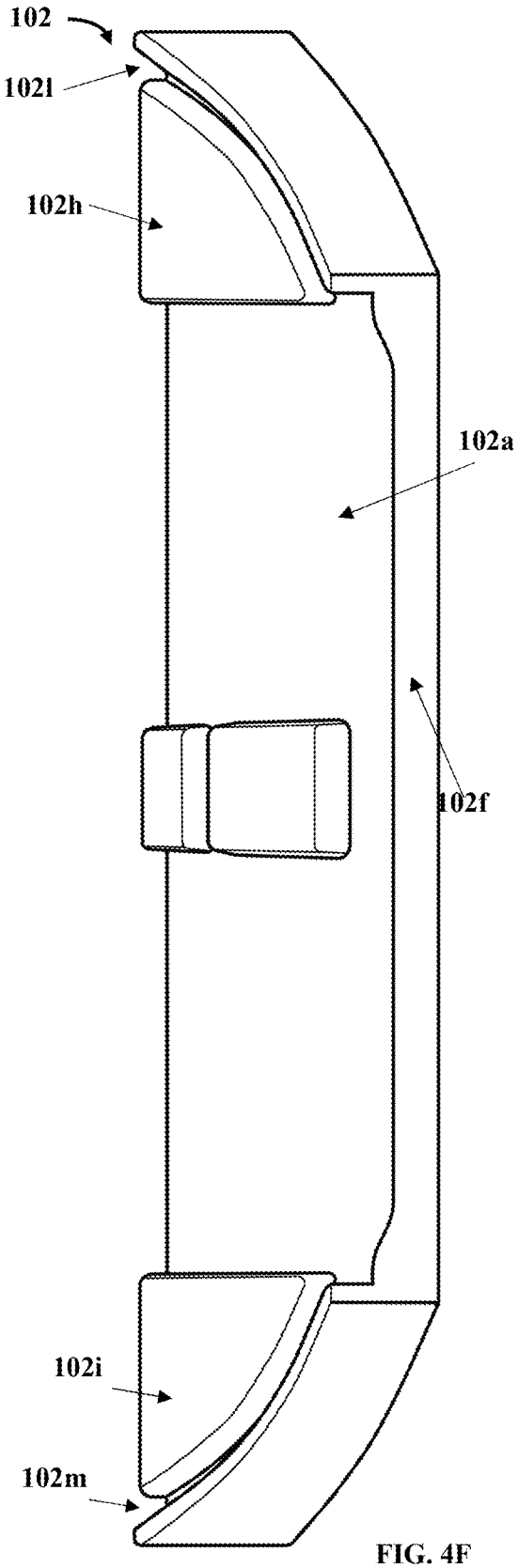
FIG. 4F illustrates a right-side view of the base padding.

As shown in FIGS. 1, 4A, 4C, 4E and 4F, the padding upper surface 102*a* further comprises a first channel 1021 integrally formed along the boundary of the padding upper surface 102*a* adjacent to the first supplemental padding section 102*h*. The padding upper surface 102*a* further comprises a second channel 102*m* integrally formed along the boundary of the padding upper surface 102*a* adjacent to the second supplemental padding section 102*i*. FIG. 4D illustrates a rear, left-side perspective view of the base padding 102. As shown in FIG. 4D, the base padding lower surface 102*b* is curved along its length with the resembling a concave curve. FIG. 4E illustrates a left-side view of the base padding 102. FIG. 4F illustrates a right-side view of the base padding 102.

In an embodiment, the base padding 102 is designed to absorb impact and transfer less to no impact to the body part of the wearer wearing the relocatable protection system 100.

The base padding is made of either an impact absorbing or cushioning material such as rubber, foam, etc.

Figure 5A:
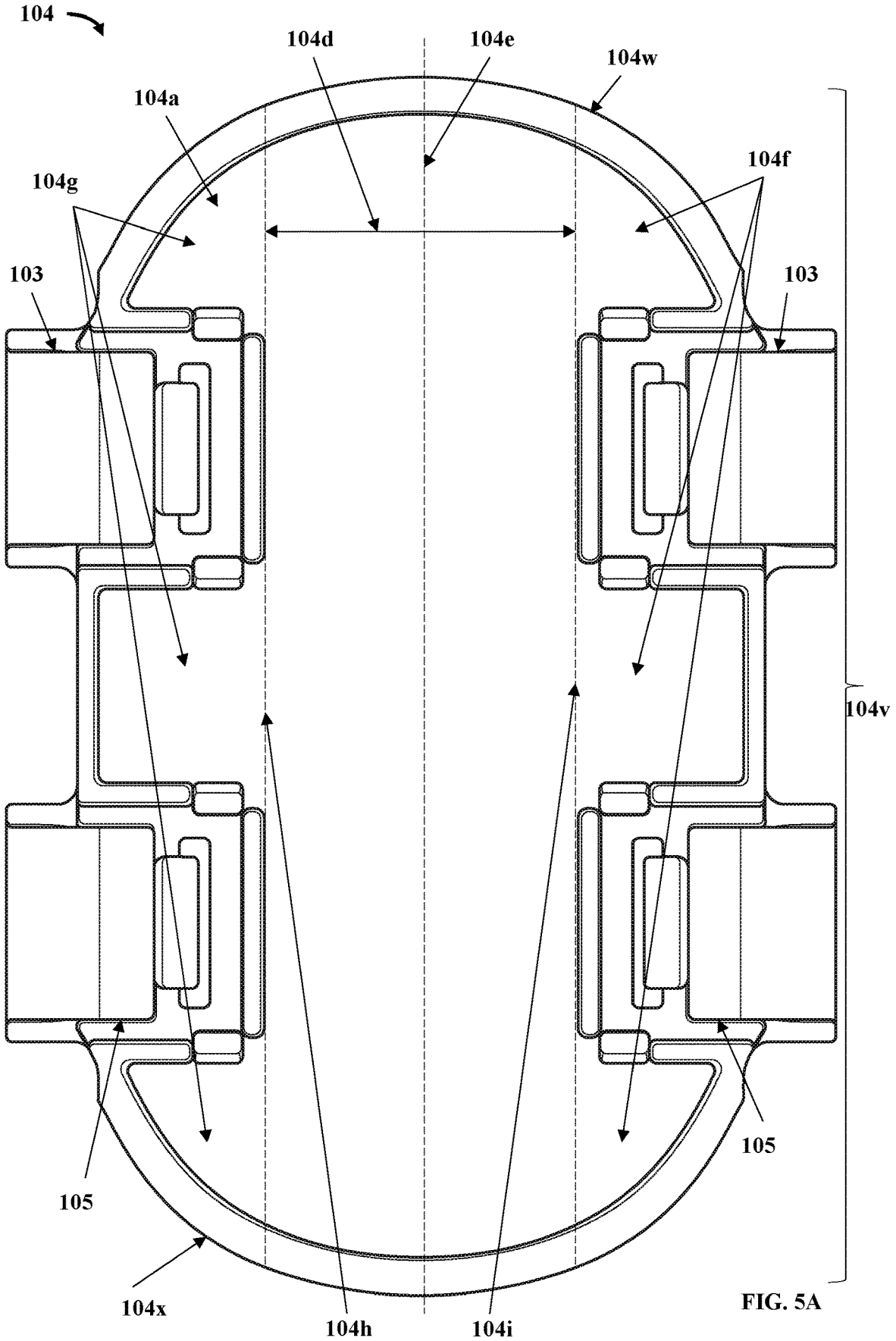
FIG. 5A illustrates a front view of the shell.
Figure 5B:
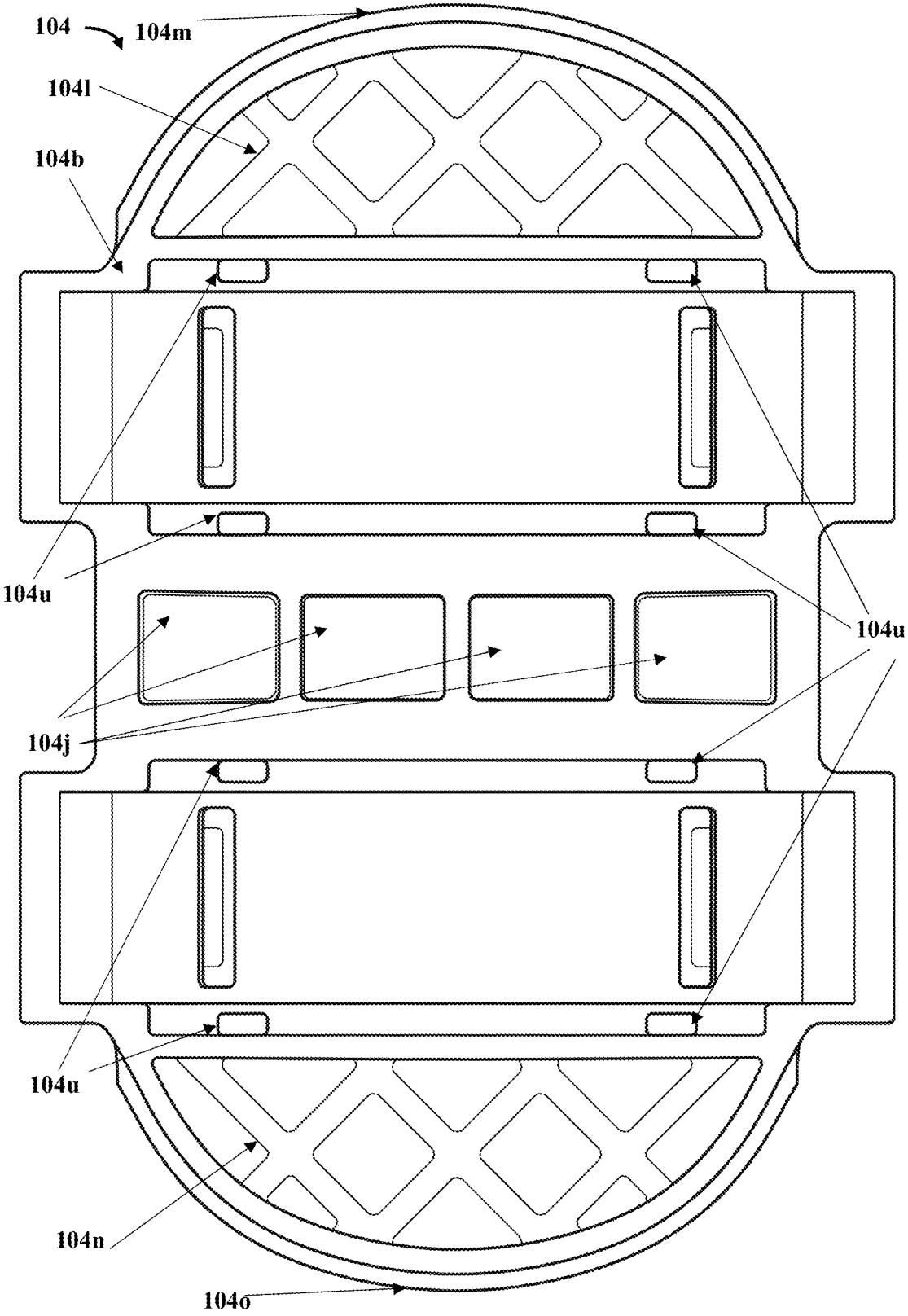
FIG. 5B illustrates a rear view of the shell.
Figure 5C:
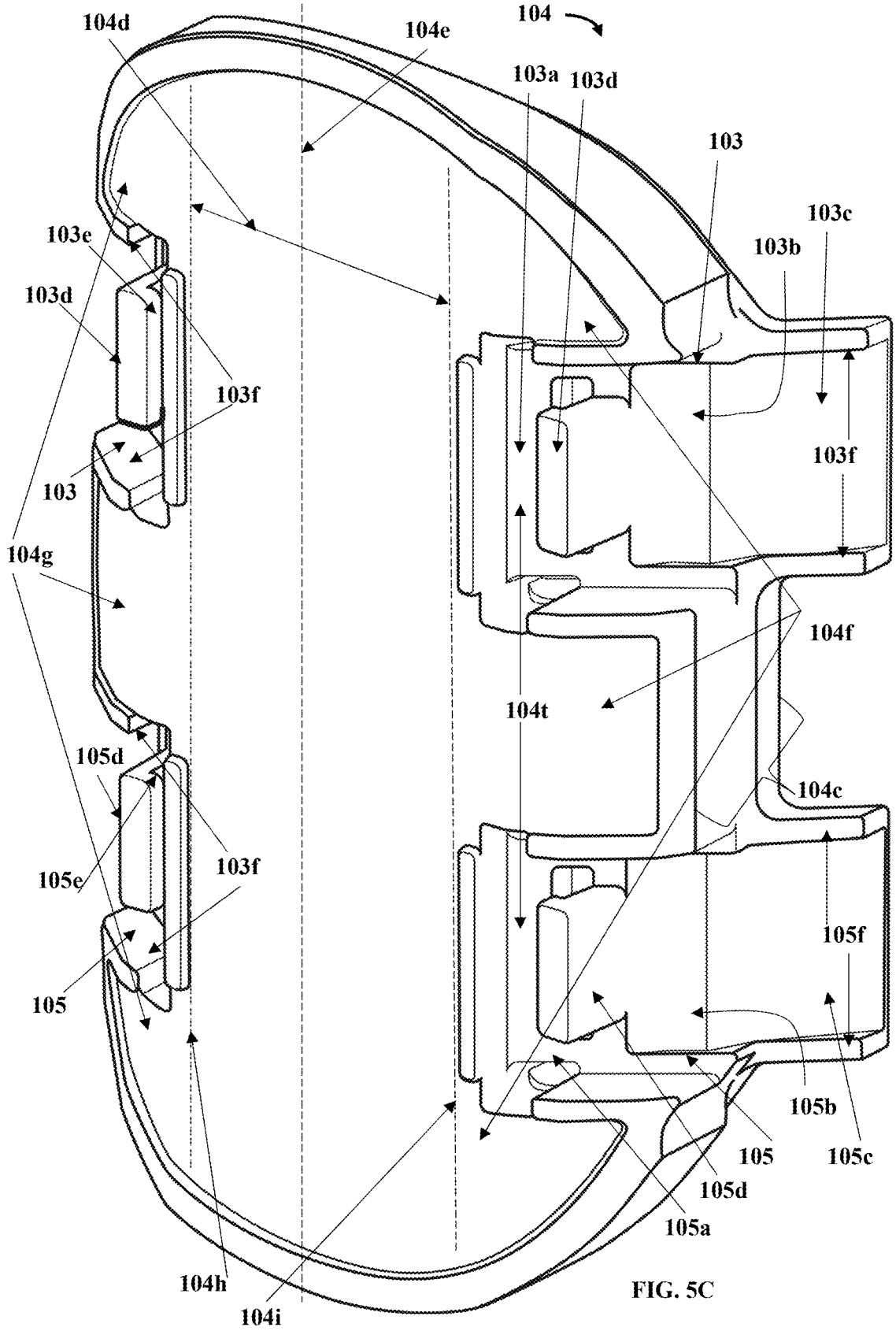
FIG. 5C illustrates a front, right-side perspective view of the shell.

FIG. 5A illustrates a front view of the shell 104. As shown in FIGS. 1 and 2, the shell 104 of the relocatable protection system 100 is positioned over the base padding 102. The shell 104 is made of a hard material and/or an impact resistant material, for example, plastic, wood, etc. In an embodiment, the shell 104 is designed to withstand a substantial amount of impact. FIG. 5B illustrates a rear view of the shell 104. FIG. 5C illustrates a front, right-side perspective view of the shell 104. As shown in FIGS. 5A and 5B, the shell 104 has a capsule shape. As shown in FIGS. 5A, 5B and 5C, the shell 104 comprises a shell upper section 104*a*, a shell lower section 104*b* and an intermediate section 104*c* therebetween the shell upper section 104*a* and the shell lower section 104*b*. The shell lower section 104*b* and the intermediate section 104*c* have a cross-sectional shape of a curved arch, as shown in FIG. 3. The shell upper section 104*a* has a substantially flat mid-section 104*d* extending symmetrically from a longitudinal axis 104*e* of the shell upper section 104*a*. The shell upper section 104*a* further comprises a first lateral curved section 104*f* extending downwardly from a first side 104*i* of the substantially flat mid-section 104*d*. The shell upper section 104*a* further comprises a second lateral curved section 104*g* extending downwardly from a second side 104*h* of the substantially flat mid-section 104*d*.

More particularly, the shell 104 has an elongated body portion 104*v* and opposing rounded end portions 104*w* and 104*x*, as shown in FIG. 5A.

Figure 5D:
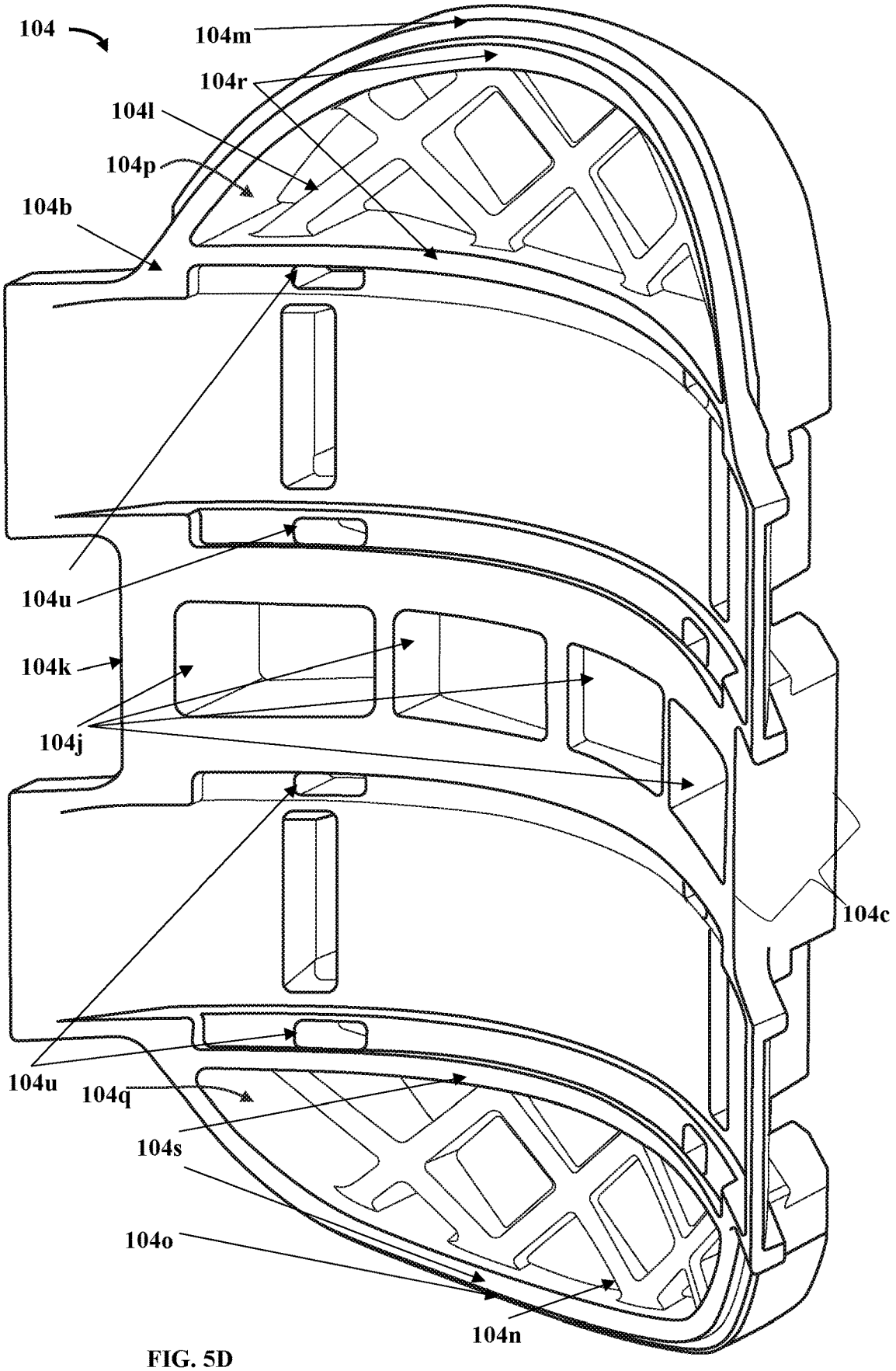
FIG. 5D illustrates a rear, left-side perspective view of the shell.
Figure 5E:
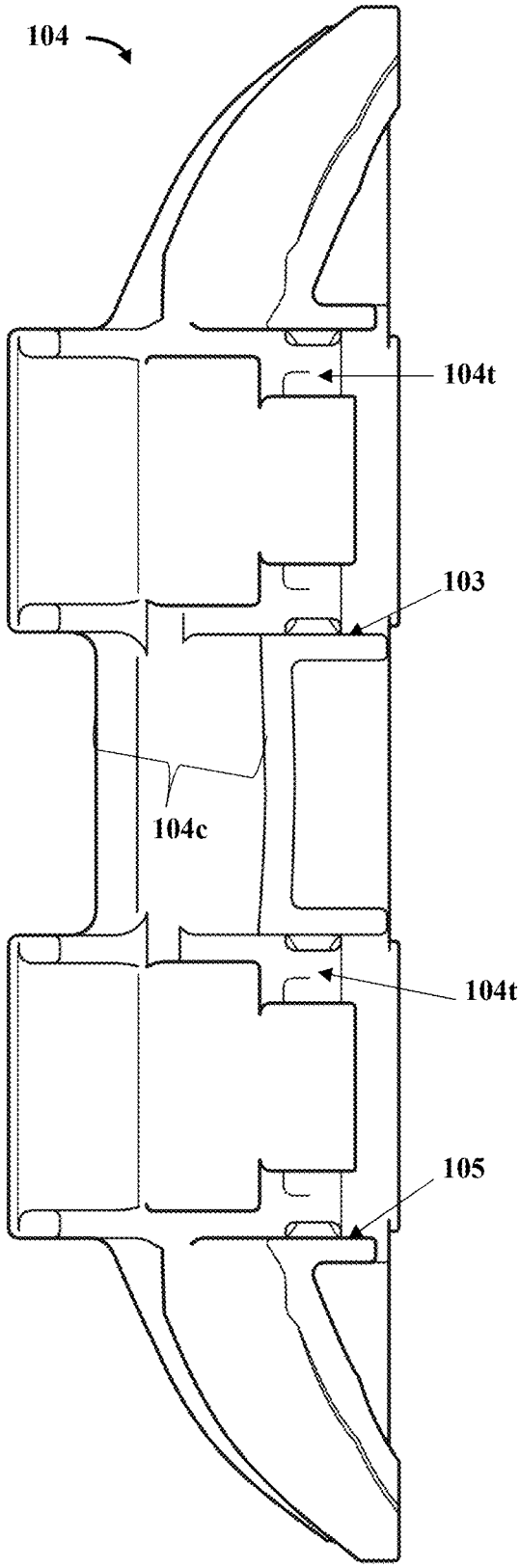
FIG. 5E illustrates a left-side view of the shell.
Figure 5F:
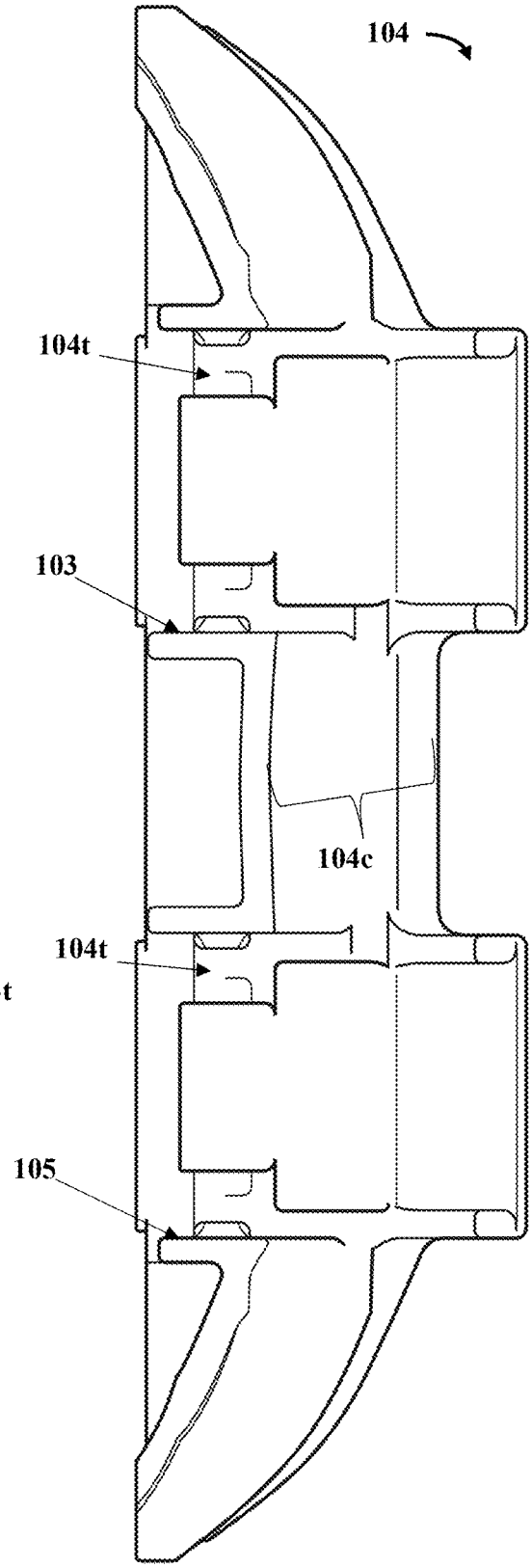
FIG. 5F illustrates a right-side view of the shell.

FIG. 5D illustrates a rear, left-side perspective view of the shell 104. As shown in FIGS. 5B and 5D, the intermediate section 104*c* comprises multiple cut-outs 104*j* integrally formed along a width of the shell 104. The cut-outs 104*j* are located at a mid-section 104*k* of the shell 104 and extend along a thickness of the intermediate section 104*c*, as shown in FIG. 5D. The intermediate section 104*c* further comprises a first latticework 1041 integrally formed at a first end 104*m* and a second latticework 104*n* integrally formed at a second end 104*o* of the shell 104. The first and second latticework 1041 and 104*n* are substantially parallel to the cut-outs 104*j*. Furthermore, the first and second latticework 1041 and 104*n* extend partially along the thickness of the intermediate section 104*c*. The first latticework 1041 is partially recessed within a cavity 104*p* at the first end 104*m* of the shell 104 and the second latticework 1041 is partially recessed within a cavity 104*q* at the second end 104*o* of the shell 104, as shown in FIG. 5D. The cavity 104*p* at the first end 104*m* of the shell 104 is adapted to receive and accommodate the first supplemental padding section 102*h* of the padding upper surface 102*a* and the cavity 104*q* is adapted to receive and accommodate the second supplemental padding section 102*i* of the padding upper surface 102*a*. The cavity 104*p* comprises a wall 104*r* surrounding the cavity 104*p* and the cavity 104*q* comprises a wall 104*s* surrounding the cavity 104*q*. FIG. 5E illustrates a left-side view of the shell 104. FIG. 5F illustrates a right-side view of the shell 104. A substantial portion of the wall 104*r* is configured to mate with the first channel 1021 of the padding upper surface 102*a*, shown in FIG. 5D and establish a secure connection between the base padding 102 and the shell 104. Similarly, a substantial portion of the wall 104*s* is configured to mate with the second channel 102*m* of the padding upper surface 102*a* and establish a secure connection between the base padding 102 and the shell 104.

The shell 104 further comprising at least two pairs of indentations 103 and 105, as shown in FIGS. 1 and 5C. Each indentation 103 and 105 comprises an opening 103*a* and 105*a* in the shell upper section 104*a*, another opening 103*b* and 105*b* on the side of the 104 shell, and a downwardly sloping cantilever slab 103*c* and 105*c*. A first 103 of the pair of indentations 103 and 105 are disposed between the cut-outs 104*j* and the first latticework 1041 and a second 105 of the pair of indentations 103 and 105 are disposed between the cut-outs 104*j* and the second latticework 104*n*. Each of the indentations 103 and 105 comprise a cantilever hook 103*d* and 105*d* projecting substantially perpendicularly upwards from the indentations 103 and 105 and disposed proximal to an external wall 104*t* of the intermediate section 104*c*. Atop end of each of the cantilever hooks 103*d* and 105*d* comprise a catch 103*e* and 105*e*, as shown in FIGS. 1 and 5C. Furthermore, as shown in FIG. 5C, each of the downwardly sloping cantilever slabs 103*c* and 105*c* in the indentations 103 and 105 comprise guardrails 103*f* and 105*f* on both sides of each of the downwardly sloping cantilever slabs 103*c* and 105*c*.

Figure 6A:
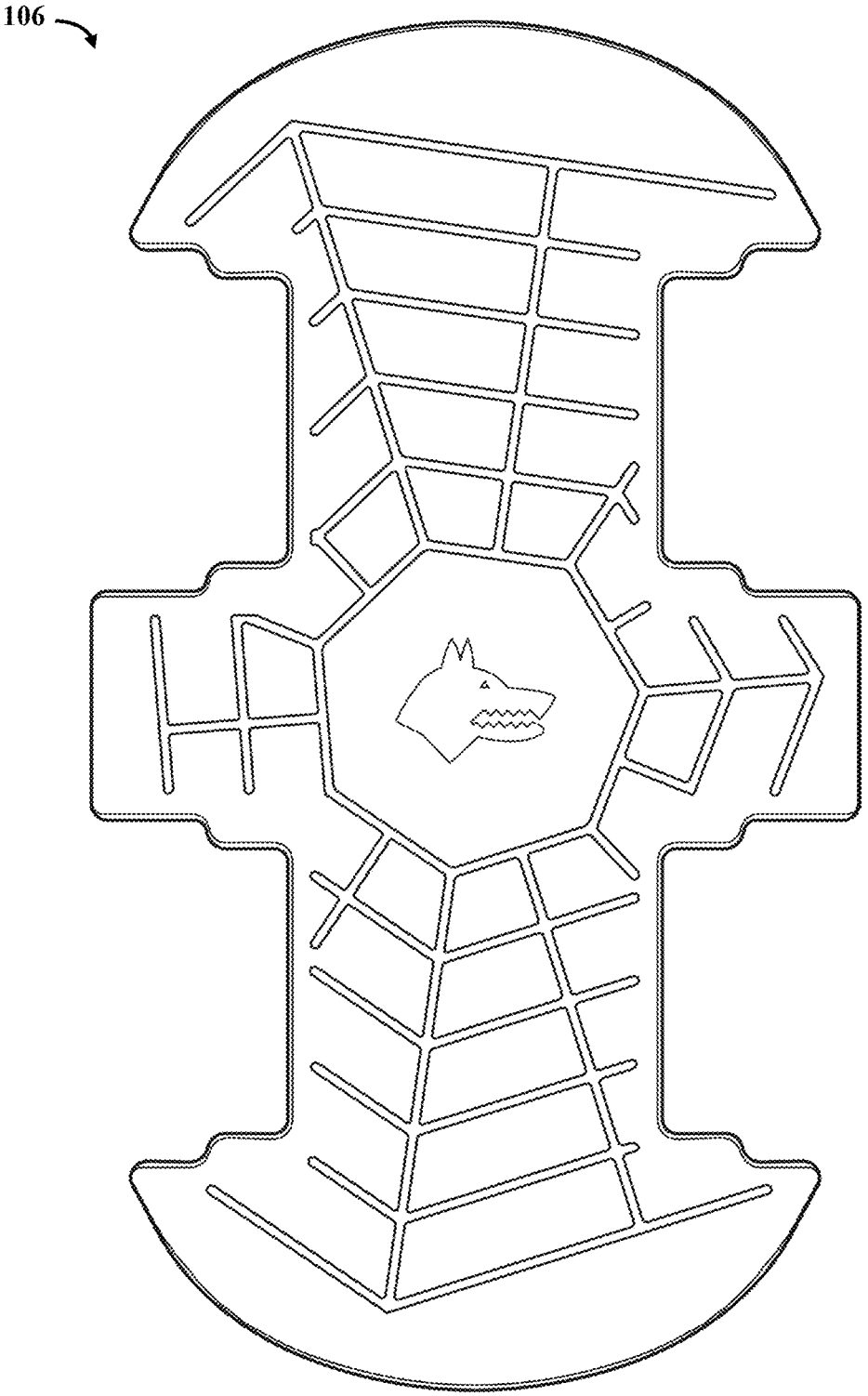
FIG. 6A illustrates a front view of the slip-resistant layer.
Figure 6B:
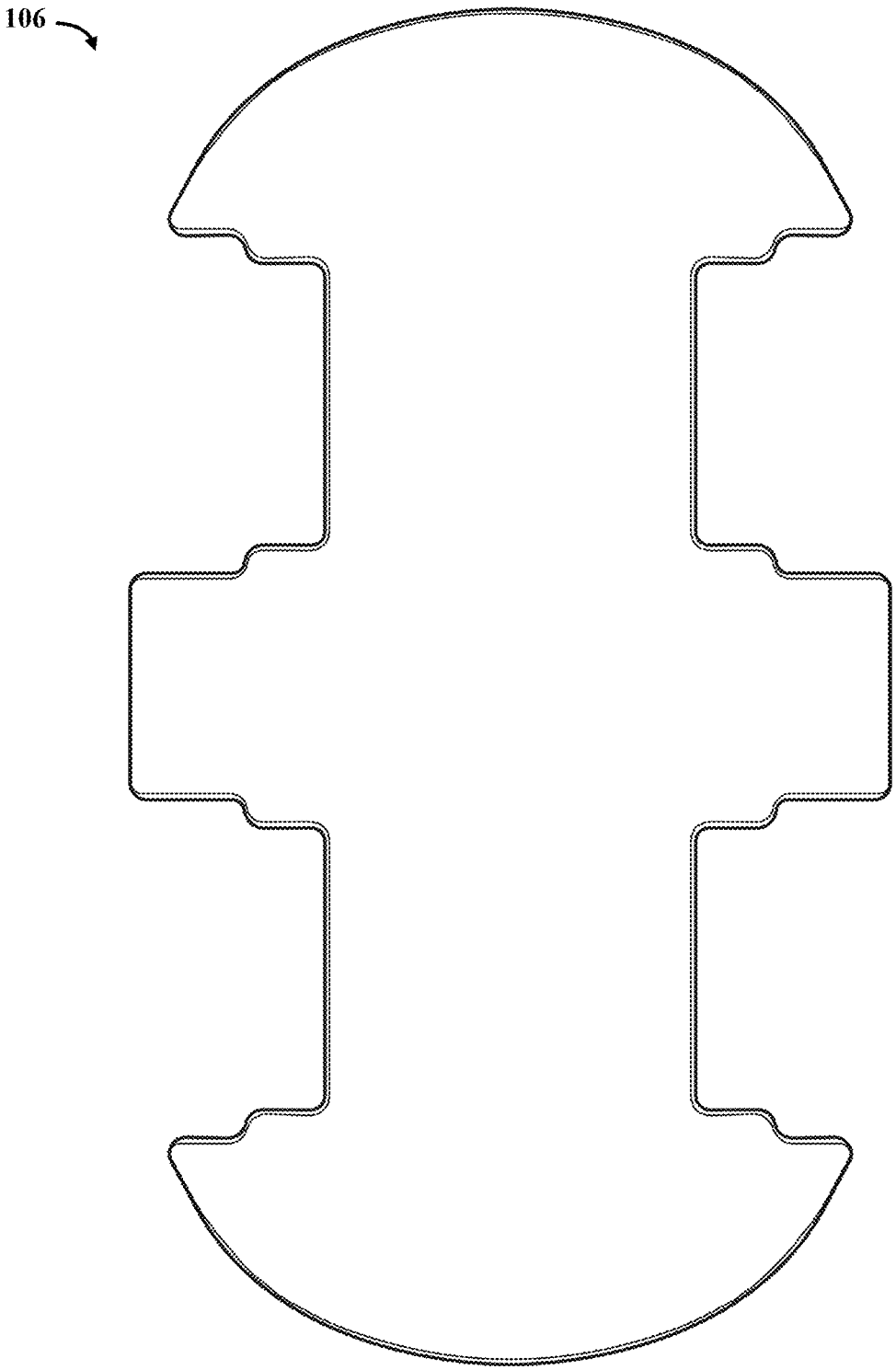
FIG. 6B illustrates a rear view of the slip-resistant layer.
Figure 6C:
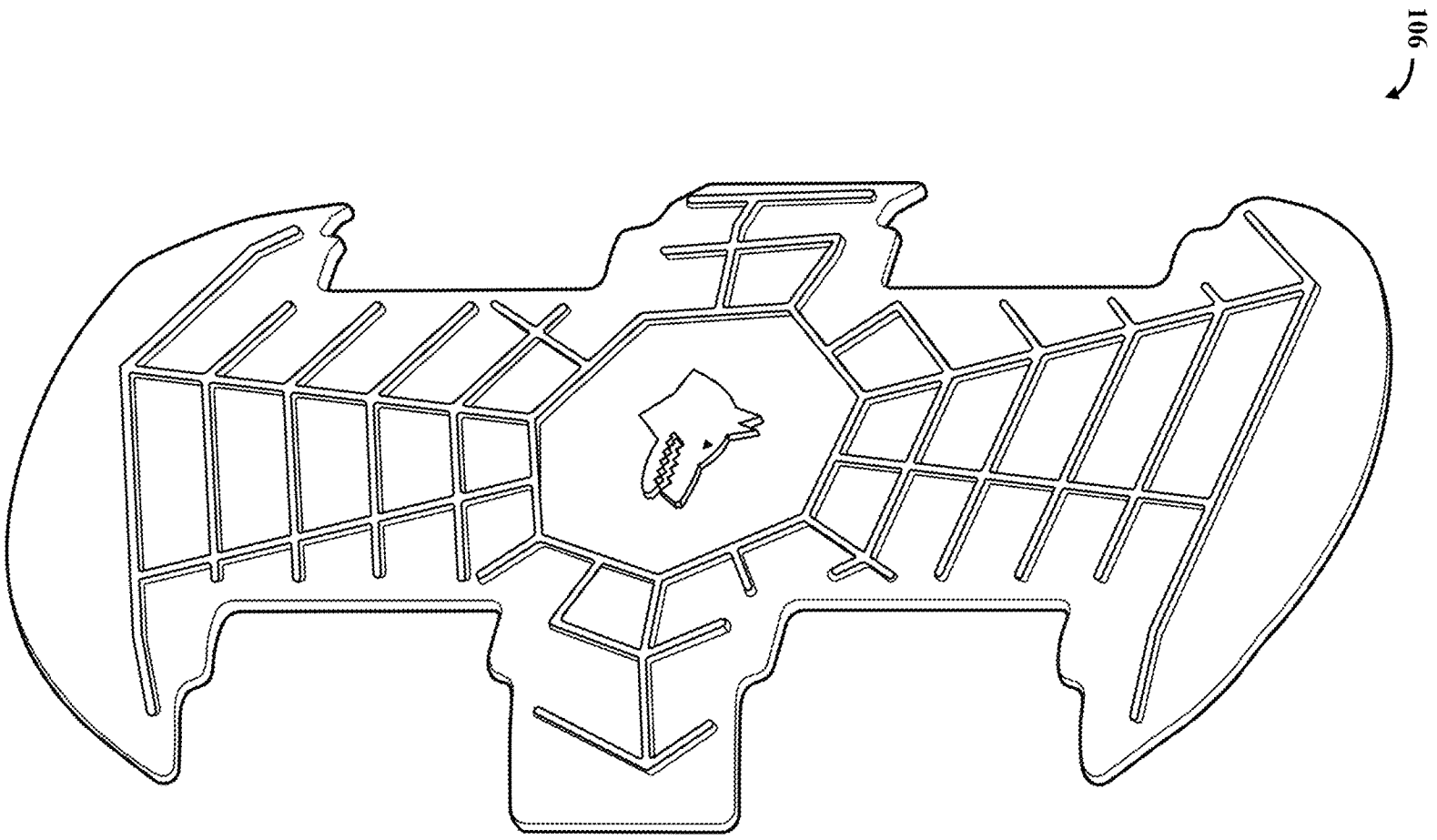
FIG. 6C illustrates a front, right-side perspective view of the slip-resistant layer.
Figure 6D:
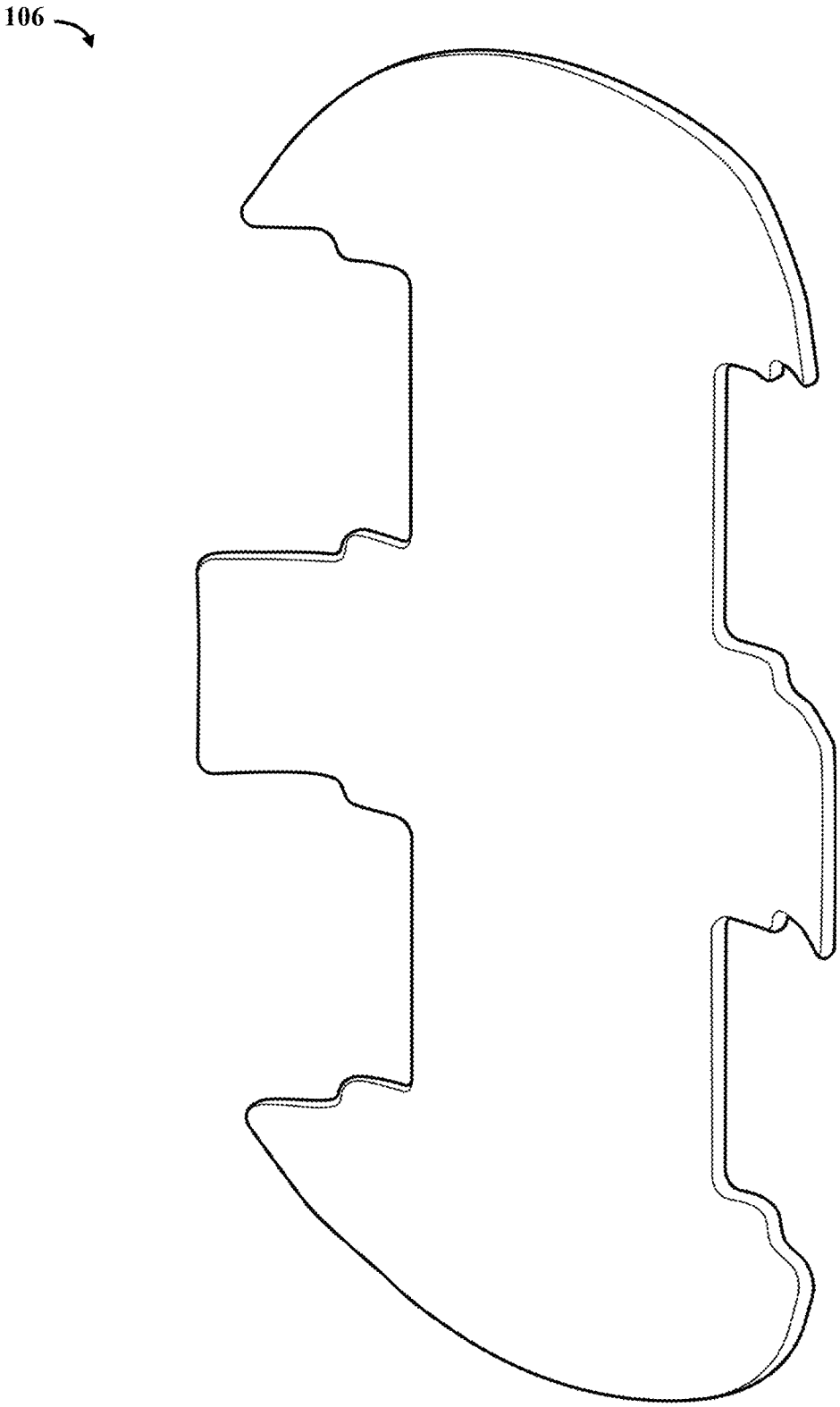
FIG. 6D illustrates a rear, left-side perspective view of the slip-resistant layer.
Figure 6E:
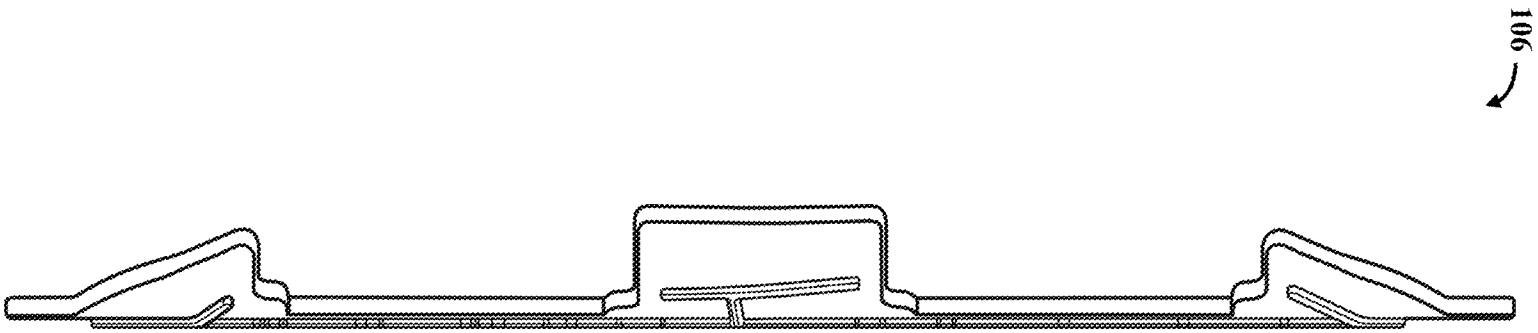
FIG. 6E illustrates a left-side view of the slip-resistant layer.
Figure 6F:
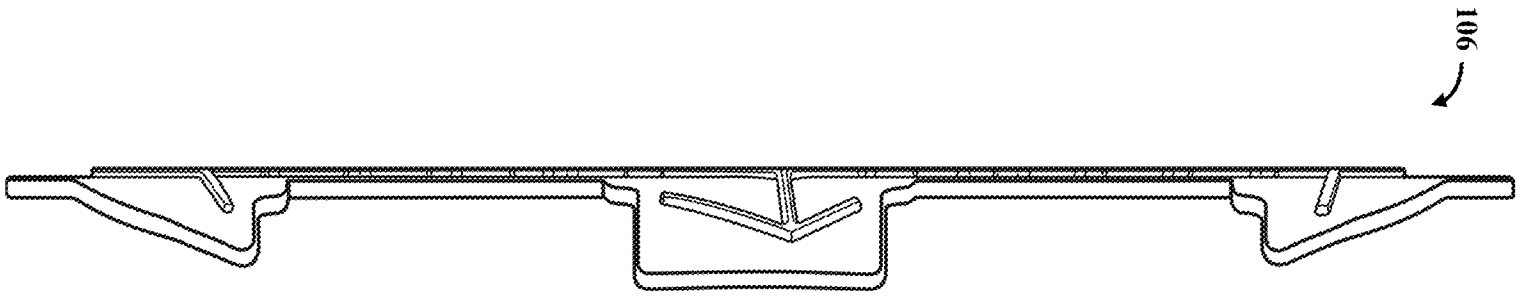
FIG. 6F illustrates a right-side view of the slip-resistant layer.

FIG. 6A illustrates a front view of the slip-resistant layer 106. FIG. 6B illustrates a rear view of the slip-resistant layer 106. FIG. 6C illustrates a front, right-side perspective view of the slip-resistant layer 106. FIG. 6D illustrates a rear, left-side perspective view of the slip-resistant layer 106. FIG. 6E illustrates a left-side view of the slip-resistant layer 106. FIG. 6F illustrates a right-side view of the slip-resistant layer 106. The slip-resistant layer 106 is positioned over the shell 104. In an embodiment, the slip-resistant layer 106 is attached to the shell upper section 104*a* using adhesive or chemical bonding. In another embodiment, the slip-resistant layer 106 is moulded directly on the the shell upper section 104*a*. The slip-resistant layer 106 prevents the relocatable protection system 100 from slipping during use.

Figure 7A:
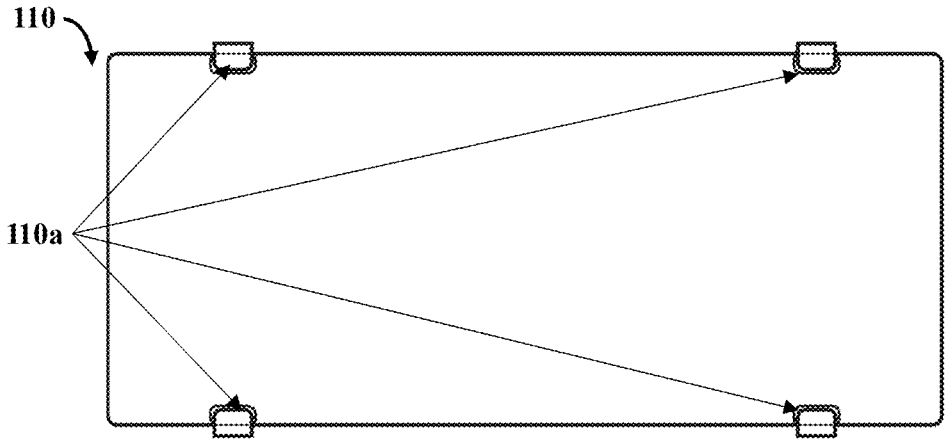
FIG. 7A illustrates a front view of a retention member.
Figure 7B:
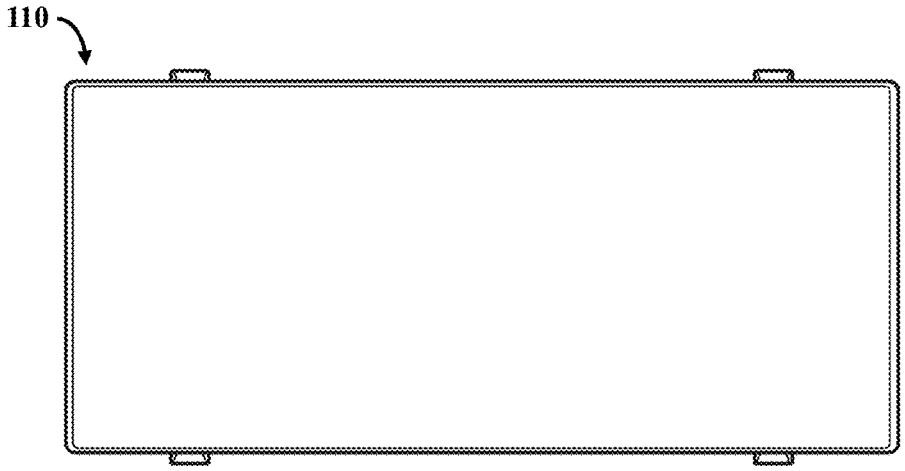
FIG. 7B illustrates a rear view of the retention member.
Figure 7C:
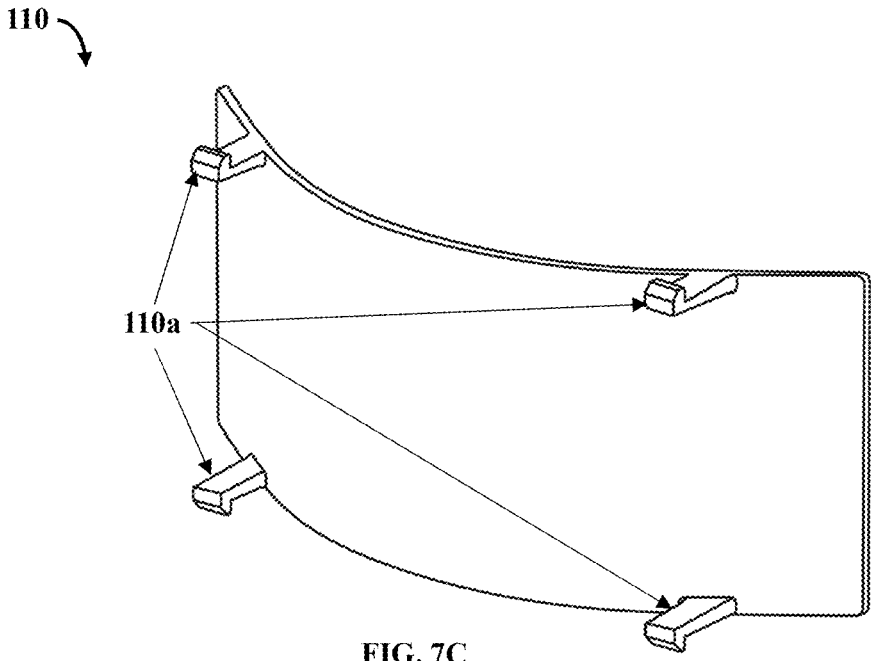
FIG. 7C illustrates a front, right-side perspective view of the retention member.
Figure 7D:
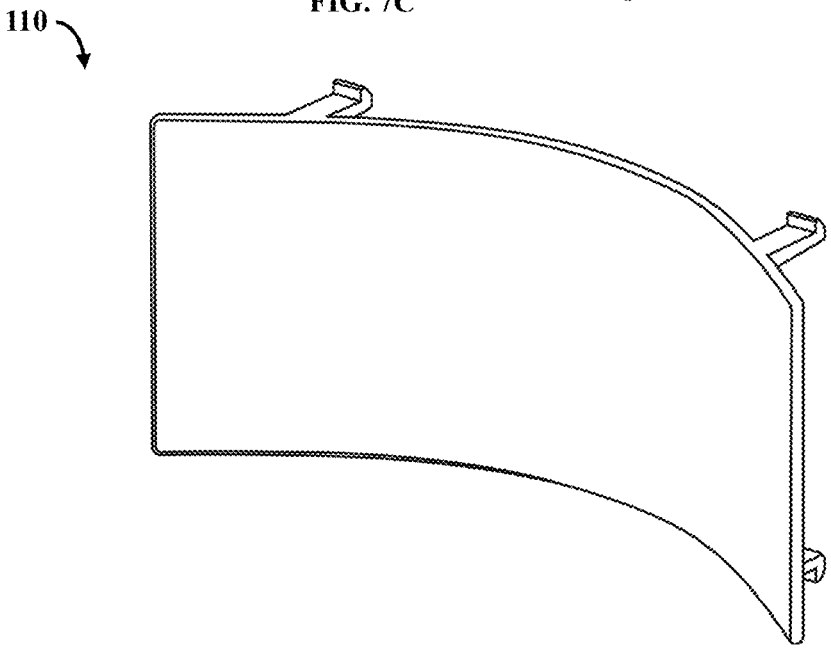
FIG. 7D illustrates a rear, left-side perspective view of the retention member.
Figure 7E:
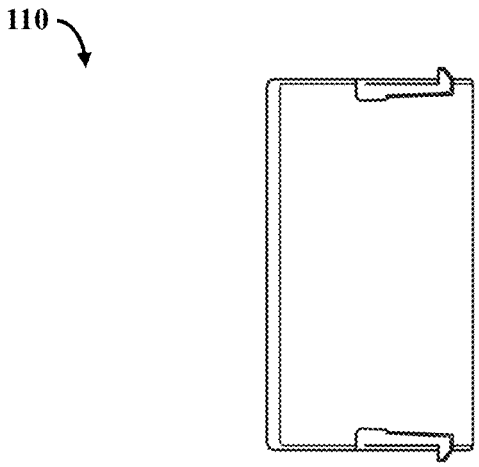
FIG. 7E illustrates a left-side view of the retention member, the right-side view of the retention member being a mirror image of the left-side view.

As shown in FIG. 1, the fastening mechanism 108 is disposed between the base padding 102 and the shell 104. The fastening mechanism 108 comprises multiple retention members 110. FIG. 7A illustrates a front view of a retention member 110. FIG. 7B illustrates a rear view of the retention member 110. FIG. 7C illustrates a front, right-side perspective view of the retention member 110. FIG. 7D illustrates a rear, left-side perspective view of the retention member 110. Each of the retention members 110 comprise multiple cantilever snap-fit connectors 110*a* located proximal to each corner of said retention member 110, as shown in FIGS. 7A and 7C. Each of the cantilever snap-fit connectors 110*a* are configured to be inserted into corresponding one of the slots 104*u* in the shell lower section 104*b*. Upon insertion, each of the cantilever snap-fit connector 110*a* deflects and snaps back into place inside the slots 104*u*, to secure the retention member 110 to the shell lower section 104*b* and thereby creating a locked connection between the retention member 110 and the shell lower section 104*b*. The retention member 110 has a curved rectangular profile, as shown in FIGS. 1, 2, 3, 7C and 7D. FIG. 7E illustrates a left-side view of the retention member 110, the right-side view of the retention member 110 being a mirror image of the left-side view. The retention member 110 is configured to be attached to the shell lower section 104*b*.

Figure 8:
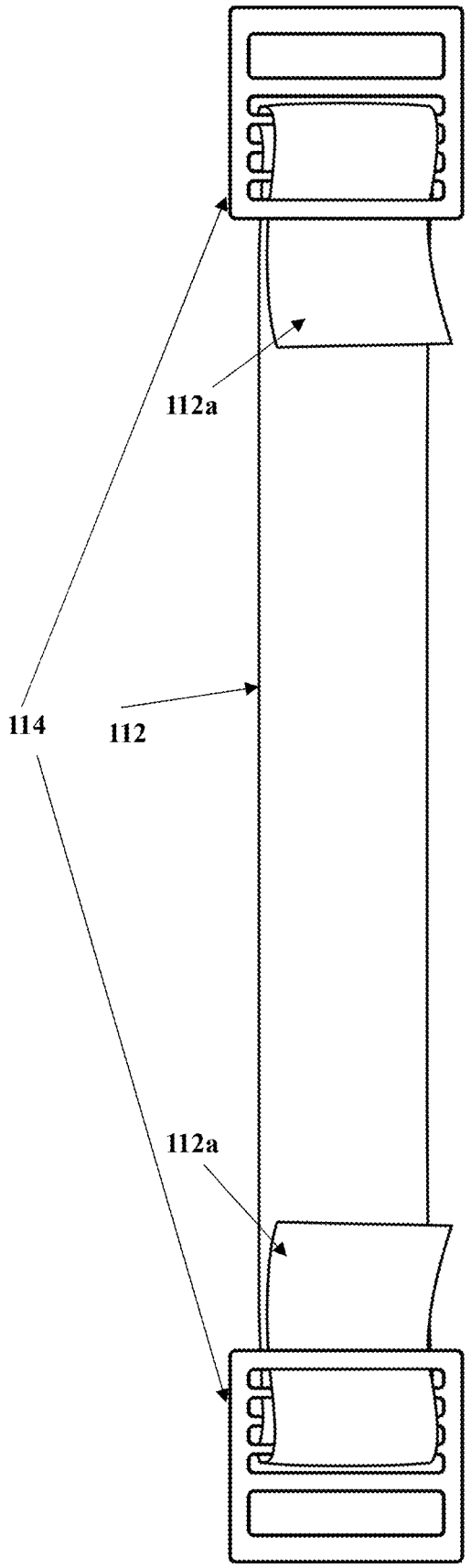
FIG. 8 illustrates a strap comprising a slotted anchor plate attached on either ends of the strap.

FIG. 8 illustrates a strap 112 comprising a slotted anchor plate 114 attached on either ends 112*a* of the strap 112. In an embodiment, the number of straps 112 correspond to the number of retention members 110, as shown in FIGS. 1 and 2. The straps 112 are configured to fasten the relocatable protection system 100 to a body part of the wearer. As shown in FIGS. 1 and 2, each of the straps 112 is disposed along a length of one of the retention members 110. Furthermore, as shown in FIGS. 1-3, each of the straps 112 is sandwiched between one of the retention members 110 and the shell lower section 104*b*.

Figure 9A:
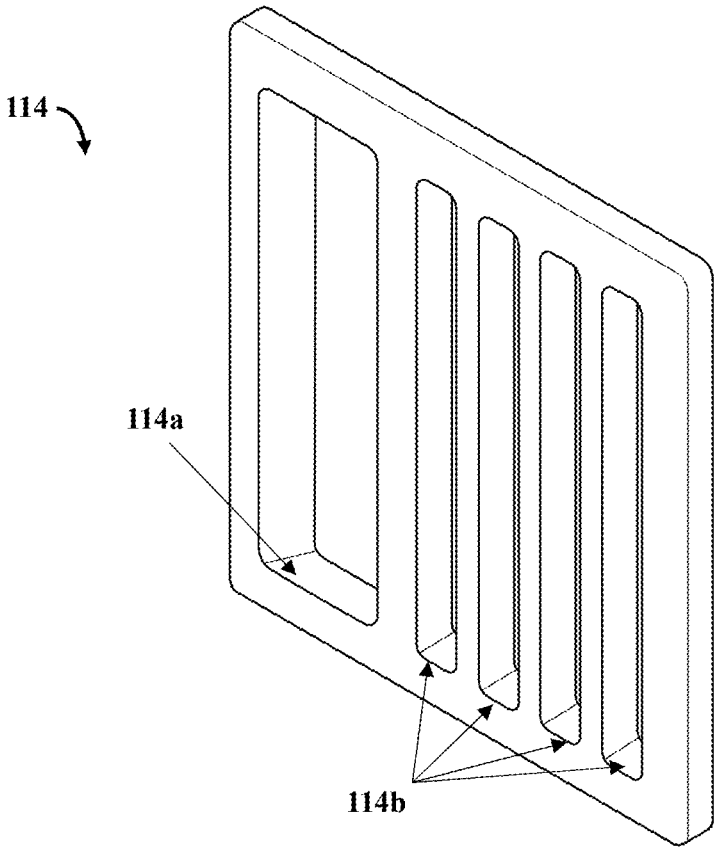
FIG. 9A illustrates a front perspective view of the slotted anchor plate.
Figure 9B:
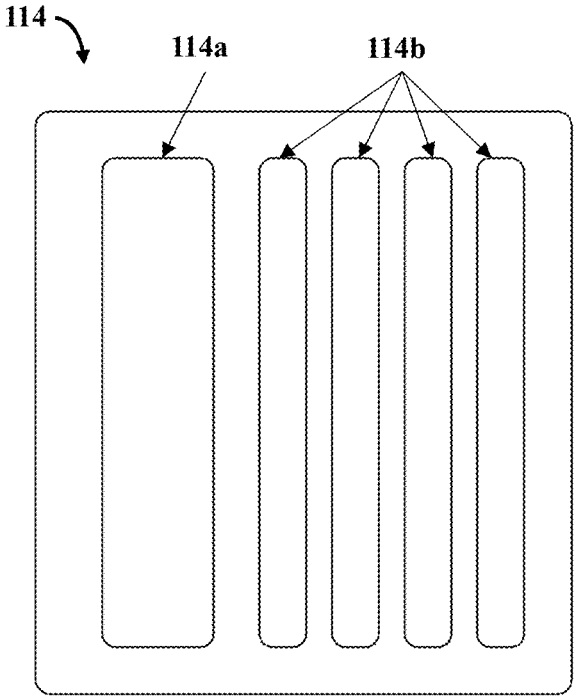
FIG. 9B illustrates a front view of the slotted anchor plate, the rear view of the slotted anchor plate being a mirror image of the front view.

FIG. 9A illustrates a front perspective view of the slotted anchor plate 114. FIG. 9B illustrates a front view of the slotted anchor plate 114, the rear view of the slotted anchor plate 114 being a mirror image of the front view. As shown in FIGS. 1, 2, 3 and 8, the slotted anchor plate 114 is attached to an end 112*a* of one of the straps 112. In fact, each end 112*a* of the strap 112 is attached to a slotted anchor plate 114. As shown in FIGS. 9A and 9B, each slotted anchor plate comprises an anchor slot 114*a* and multiple adjuster slots 114*b*. The end 112*a* of one of the straps 112 is looped through the adjuster slots 114*b* to adjust the length of the strap 112. The anchor slot 114*a* and the adjuster slots 114*b* are substantially parallel to each other, as shown in FIGS. 9A and 9B.

Figure 10A:
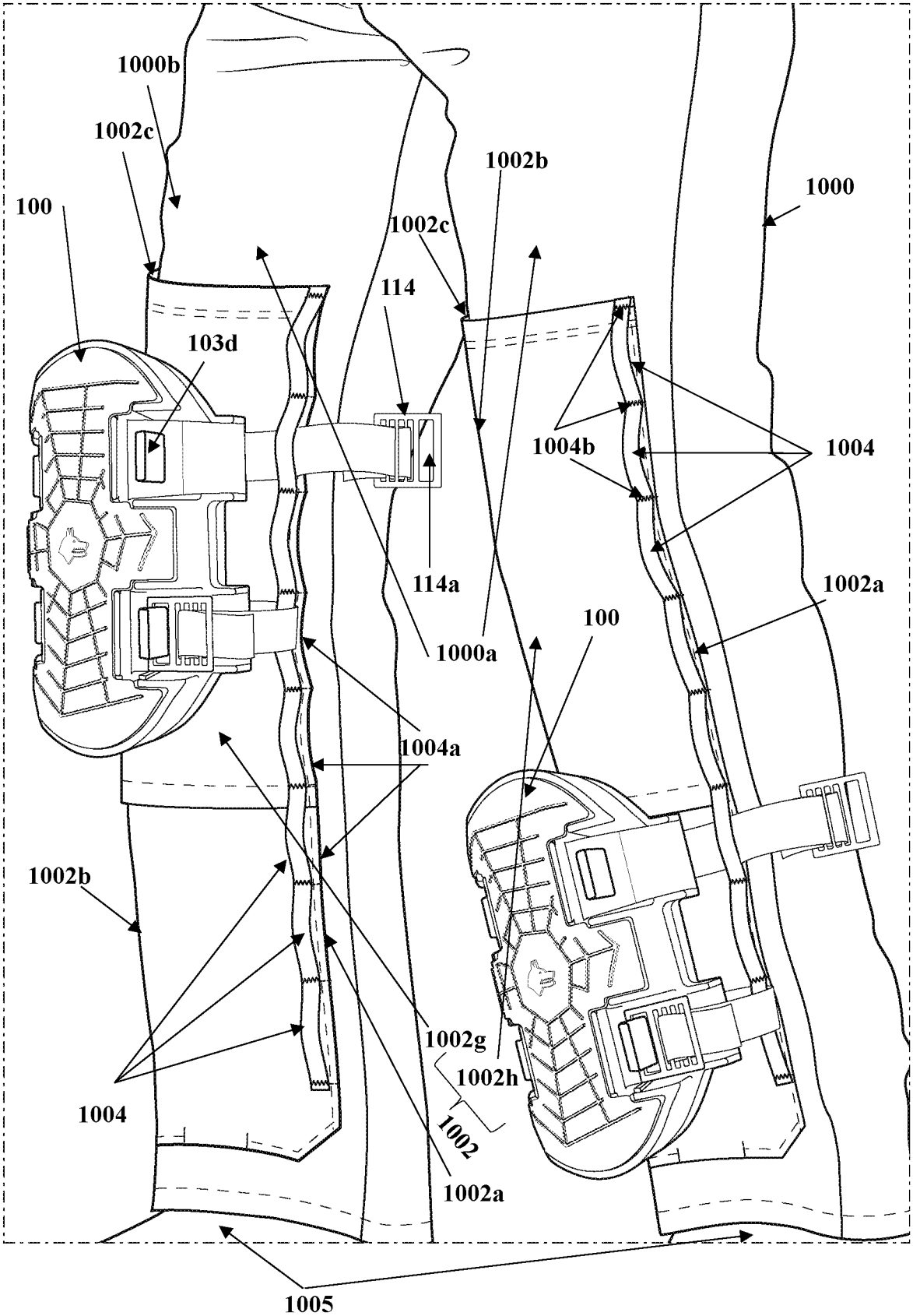
FIG. 10A illustrates an assembled view of the relocatable protection system, comprising all the components shown in FIGS. 1-3, being secured to the legs of a wearer.

FIG. 10A illustrates an assembled view of the relocatable protection system 100, comprising all the components shown in FIGS. 1-3, being secured to the legs 1005 of a wearer. As shown in FIG. 10A, the slotted anchor plate 114 is secured to the cantilever hook 103*d* or 105*d* of the shell 104 to fasten the relocatable protection system 100 to a leg 1005 of the wearer. As shown in FIG. 10A, each relocatable protection system 100 uses a pair of straps 112, each attached to a pair of slotted anchor plates 114. To secure a first of a pair of slotted anchor plate 114 to a cantilever hook 103*d* or 105*d* of the pair of indentations 103 and 105 in the shell 104, the anchor slot 114*a* in each one of the slotted anchor plates 114 is positioned over a respective one of the cantilever hooks 103*d* or 105*d*. The cantilever hook 103*d* or 105*d* is then slid into the anchor slot 114*a*. The remaining 3 cantilever hooks 103*d* and 105*d* of the pair of indentations 103 and 105 in the shell 104 are also secured to the slotted anchor plates 114 in a similar way. The ends 112*a* of the pair of straps 112 are pulled to fasten the relocatable protection system 100 to the leg 1005 of the wearer.

Figure 10B:
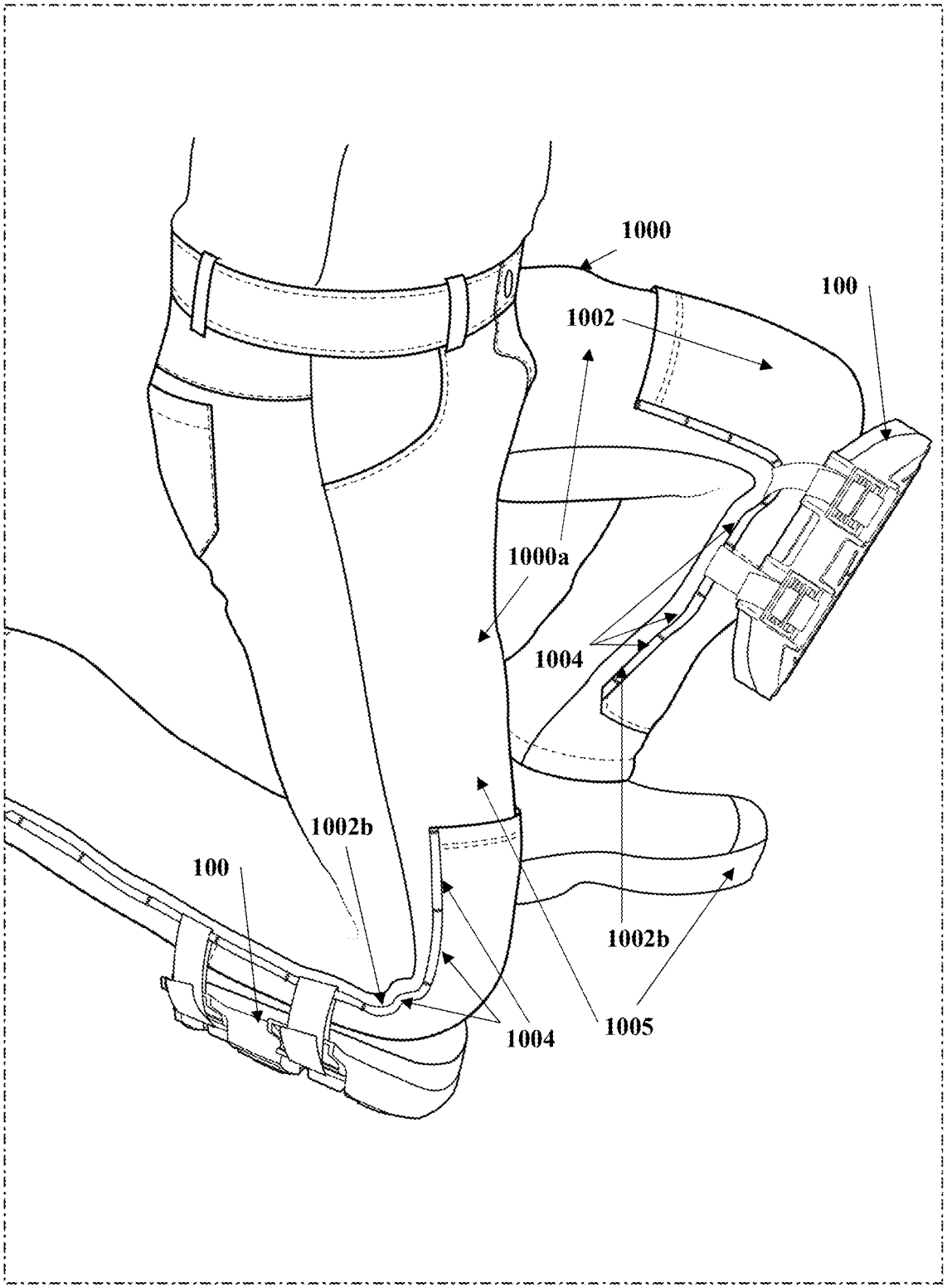
FIG. 10B illustrates a usage of the embodiment of the relocatable protection system shown in FIG. 10A.

FIG. 10B illustrates a usage of the embodiment of the relocatable protection system 100 shown in FIG. 10A. In an embodiment, as shown in FIGS. 10A and 10B, the wearer may utilize a pair of trousers 1000 having a pair of elongated pockets 1002 attached to a front section 1000*a* of the pair of trousers 1000. The pair of elongated pockets 1002 comprise a top opening 1002*c*, as shown in FIG. 10A. Each elongated pocket 1002*g* and 1002*h* of the pair of elongated pockets 1002, as shown in FIG. 10A are configured to receive a respective one of the padding material 1300, as shown in FIGS. 13C and 13D. The pair of elongated pockets 1002 comprise multiple adjacently located loops 1004. The loops 1004 are located on the first longitudinal side 1002*a* and the second longitudinal side 1002*b* of the elongated pockets 1002. In an embodiment, the loops 1004 extend along an entire length of the pair of elongated pockets 1002. In an embodiment, individual loops 1004 are created by folding and stitching a strip of fabric to form the loop 1004. The loop 1004 is then attached to the first longitudinal side 1002*a* and the second longitudinal side 1002*b* of the elongated pockets 1002 via stitching or other means. In another embodiment, a long single piece of may be used to create multiple loops 1004 on the first longitudinal side 1002*a* or the second longitudinal side 1002*b* side. The long single piece of fabric is folded and stitched to create a long strip of fabric. The long strip of fabric is then attached to, for example, the first longitudinal side 1002*a* of the elongated pockets 1002 via stitching or other means. The long strip of fabric is sewn onto the first longitudinal side 1002*a* of the elongated pockets 1002 by multiple, equidistant stitches 1004*b* across a width of the long strip of fabric but along a length of the long strip of fabric, as shown in FIG. 10A.

Figure 14A:
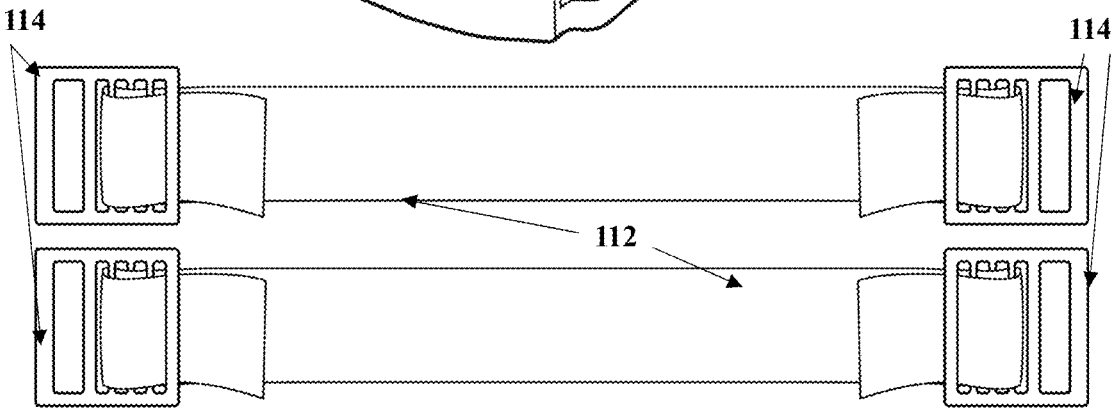
FIG. 14A illustrates a pair of straps used to fasten the relocatable protection system to a body part of the wearer.
Figure 14B:
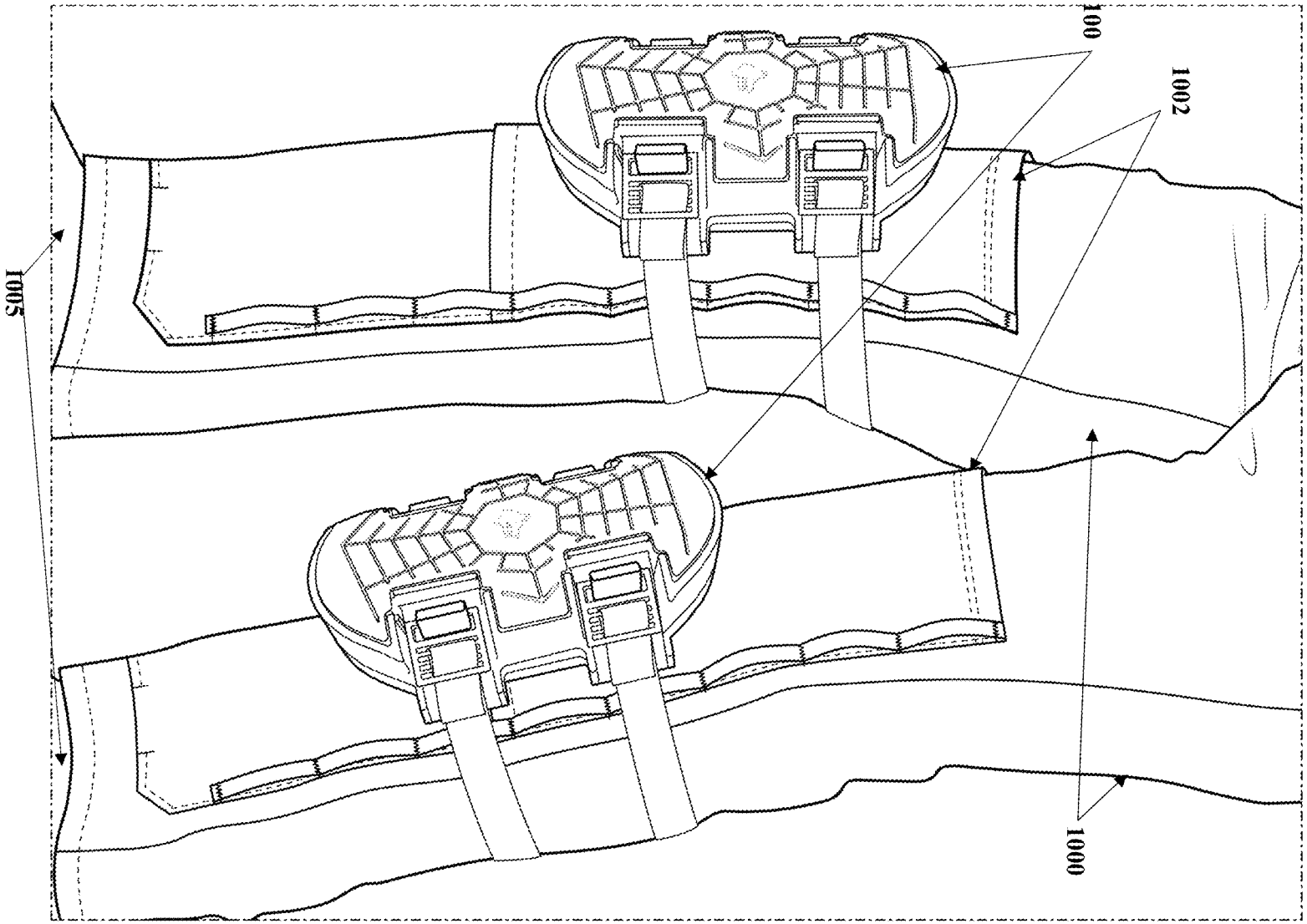
FIG. 14B illustrates the relocatable protection system being secured to a leg of a wearer by wrapping the strap around the leg of the wearer.

As shown in FIGS. 10A and 10B, each of the pair of straps 112 are inserted through a pair of loops 1004 to secure the relocatable protection system 100 to the leg 1005 of the wearer via the loops 1004. For example, each of the loops 1004 of the pair of loops 1004 is configured to receive one of the straps 112 for fastening the relocatable protection system 100 to either the pair of trousers 1000 or to a leg 1005 of a wearer. An end 112*a* of one of the straps 112 is configured to be inserted into one of the loops 1004 of the pair of loops 1004 on the first longitudinal side 1002*a* and configured to be drawn out from another one of the loops 1004 of the pair of loops 1004 on the second longitudinal side. In an embodiment, each one of the loops 1004 on the second longitudinal side 1002*b* is located opposite to another one of the loops 1004 on the first longitudinal side 1002*a*. As shown in FIG. 10A, one of the relocatable protection systems 100 is secured above a knee of the wearer and another relocatable protection system 100 is secured to a shin of the wearer. Furthermore, as shown in FIG. 14B, one of the straps 112, for example the upper strap 112 may be inserted through the loops 1004 and wraps a around the leg 1005 of the wearer. In another embodiment such as FIG. 10A, the lower strap 112 may be inserted through the loops 1004 with the ends 112*a* of the strap 112 being looped around the loops 1004 on the first longitudinal side 1002*a* and the second longitudinal side 1002*b* and then the slotted anchor plates 114 at the ends 112*a* of the strap 112 secured to the corresponding cantilever hook 103*d* or 105*d* of the relocatable protection system 100.

In another embodiment, the pair of elongated pockets 1002 comprise multiple openings 1004*a* disposed underneath the first longitudinal side 1002*a* and the second longitudinal side 1002*b* of the pair of elongated pockets 1002. More specifically, the portions of the first longitudinal side 1002*a* and the second longitudinal side 1002*b* below each of the loops 1004 are not attached to the pair of trousers 1000 to create the openings 1004*a*. Therefore, each opening 1004*a* has substantially the same size as one of the loops 1004. An end 112*a* of the strap 112 is configured to be inserted into one of the openings 1004*a* on one of the longitudinal sides, for example, the first longitudinal side 1002*a*, and configured to be drawn out from another one of the openings 1004*a* on the second longitudinal side 1002*b*, where each of the openings 1004*a* on the second longitudinal side 1002*b* is located opposite to another one of the openings 1004*a* on the first longitudinal side 1002*a*. The slotted anchor plates 114 at the ends 112*a* of the strap 112 may be then secured to the corresponding cantilever hook 103*d* or 105*d* of the relocatable protection system 100.

Figure 10C:
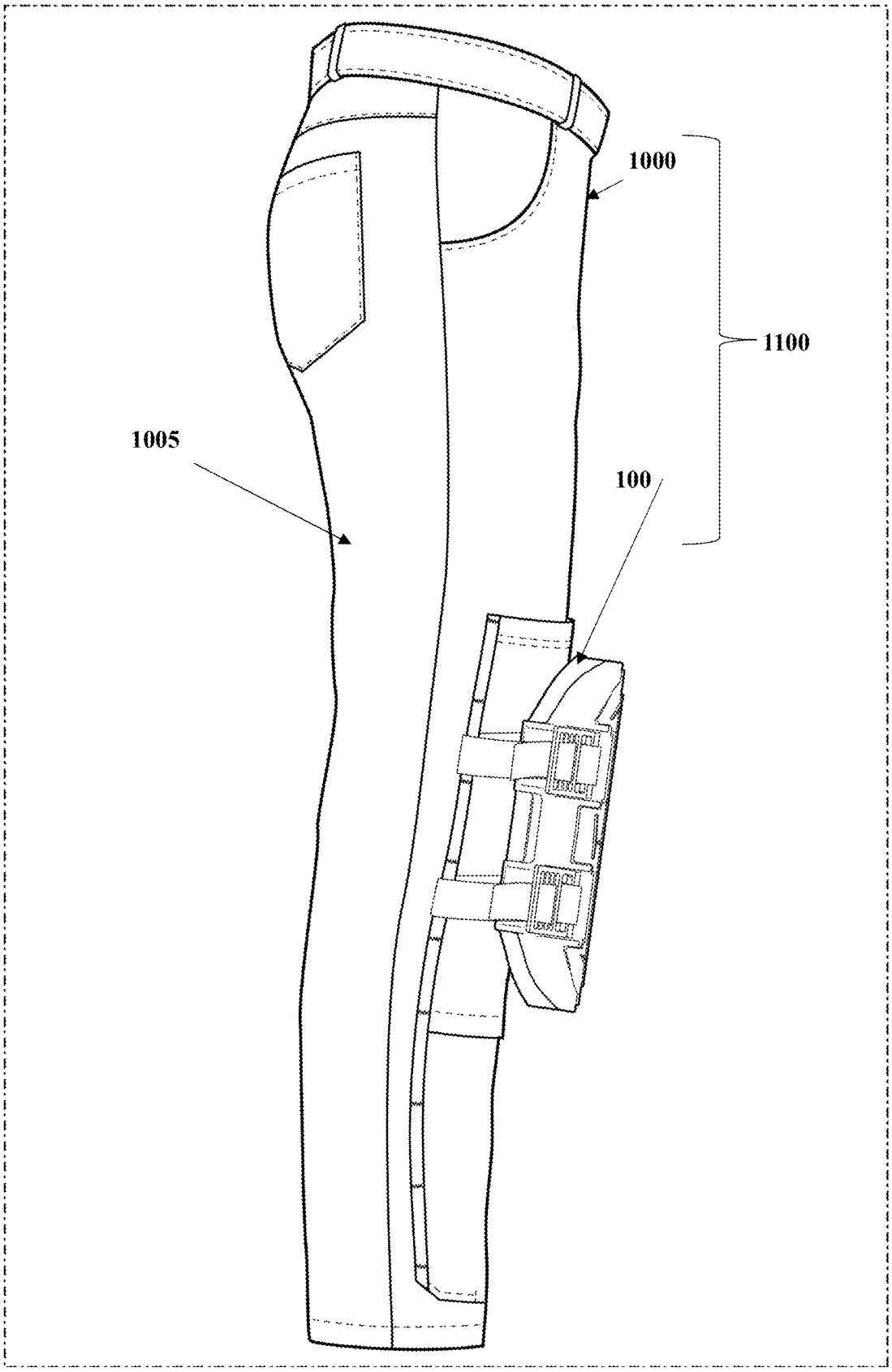
FIG. 10C illustrates a left side view of the usage of the embodiment of the relocatable protection system shown in FIG. 10A.

As shown in FIG. 10B, both the relocatable protection systems 100 are secured to the shins of the wearer's legs 1005. FIG. 10C illustrates a left side view of the usage of the embodiment of the relocatable protection system 100 shown in FIG. 10A. As shown in FIG. 10C, the relocatable protection system 100 is secured above the knee of the wearer.

Figure 10D:
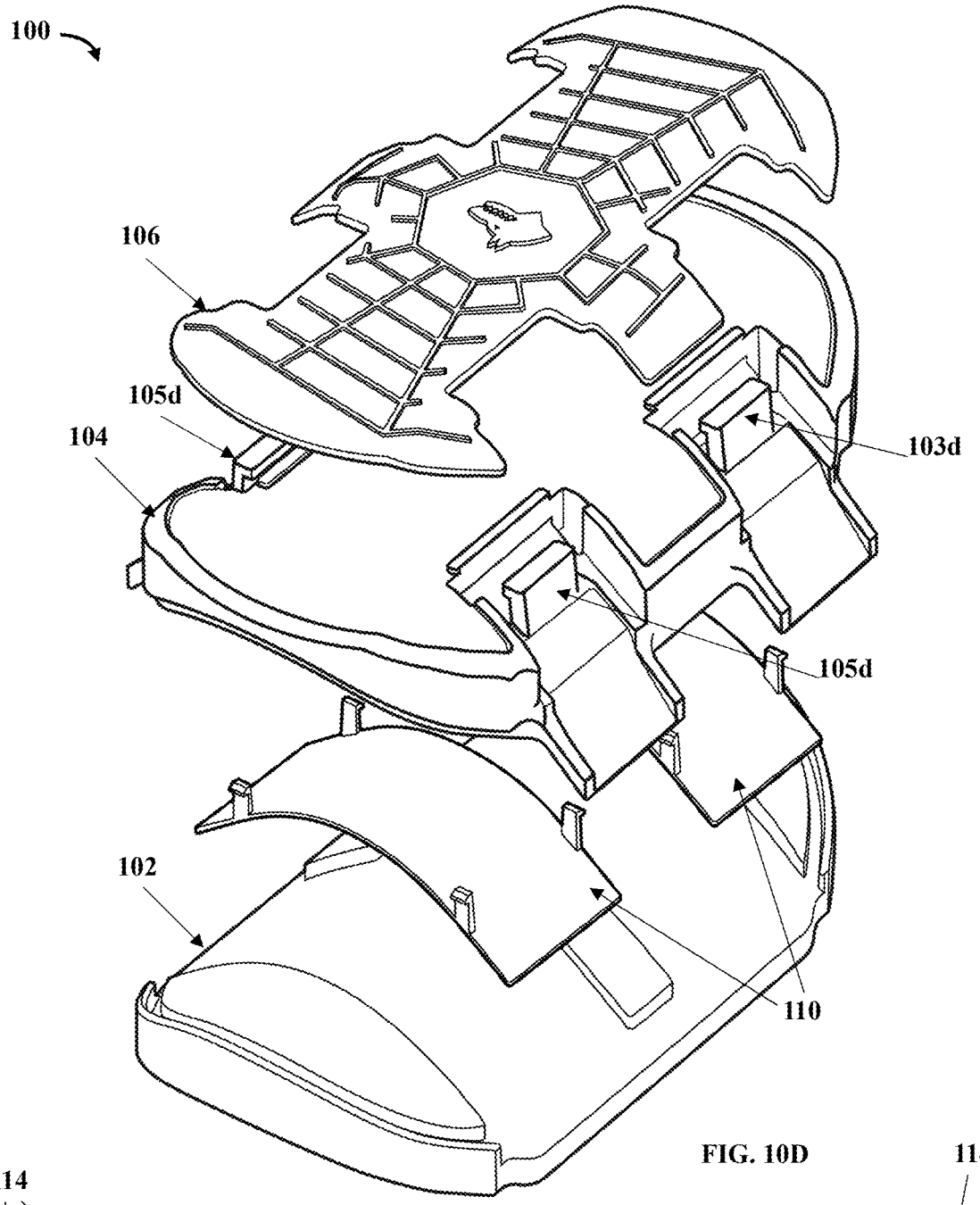
FIG. 10D illustrates another embodiment of the relocatable protection system where the straps are not attached to the retention members.
Figure 11A:
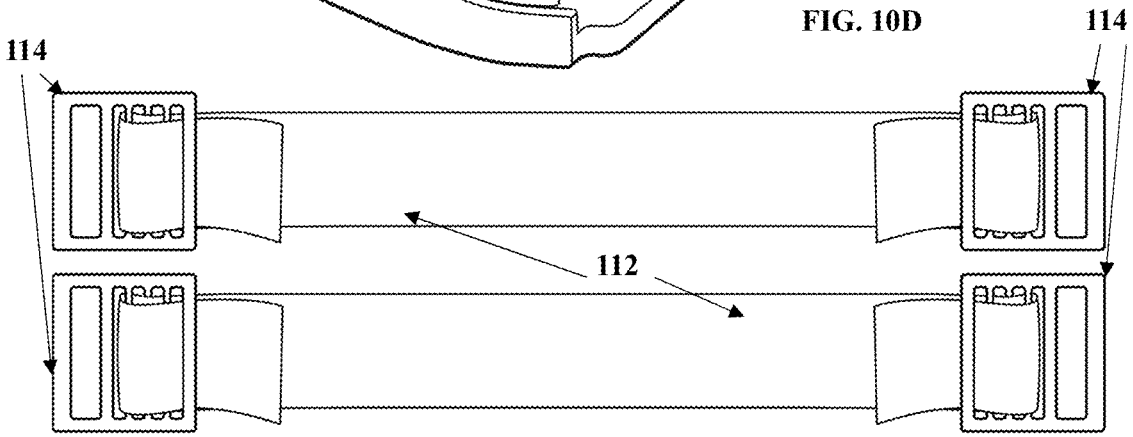
FIG. 11A illustrates a pair of straps used to fasten the relocatable protection system to a body part of the wearer.

FIG. 10D illustrates another embodiment of the relocatable protection system 100 where the straps 112 are not attached to the retention members 110. FIG. 11A illustrates a pair of straps 112 used to fasten the relocatable protection system 100 to a body part of the wearer. As shown in FIG. 10D, the straps 112 are not sandwiched between the retention members 110 and the shell lower section 104*b*. Instead, the straps 112 are first inserted through a pair of loops 1004 and then directly attached to the corresponding cantilever hook 103*d* or 105*d* of the relocatable protection system 100.

Figure 11B:
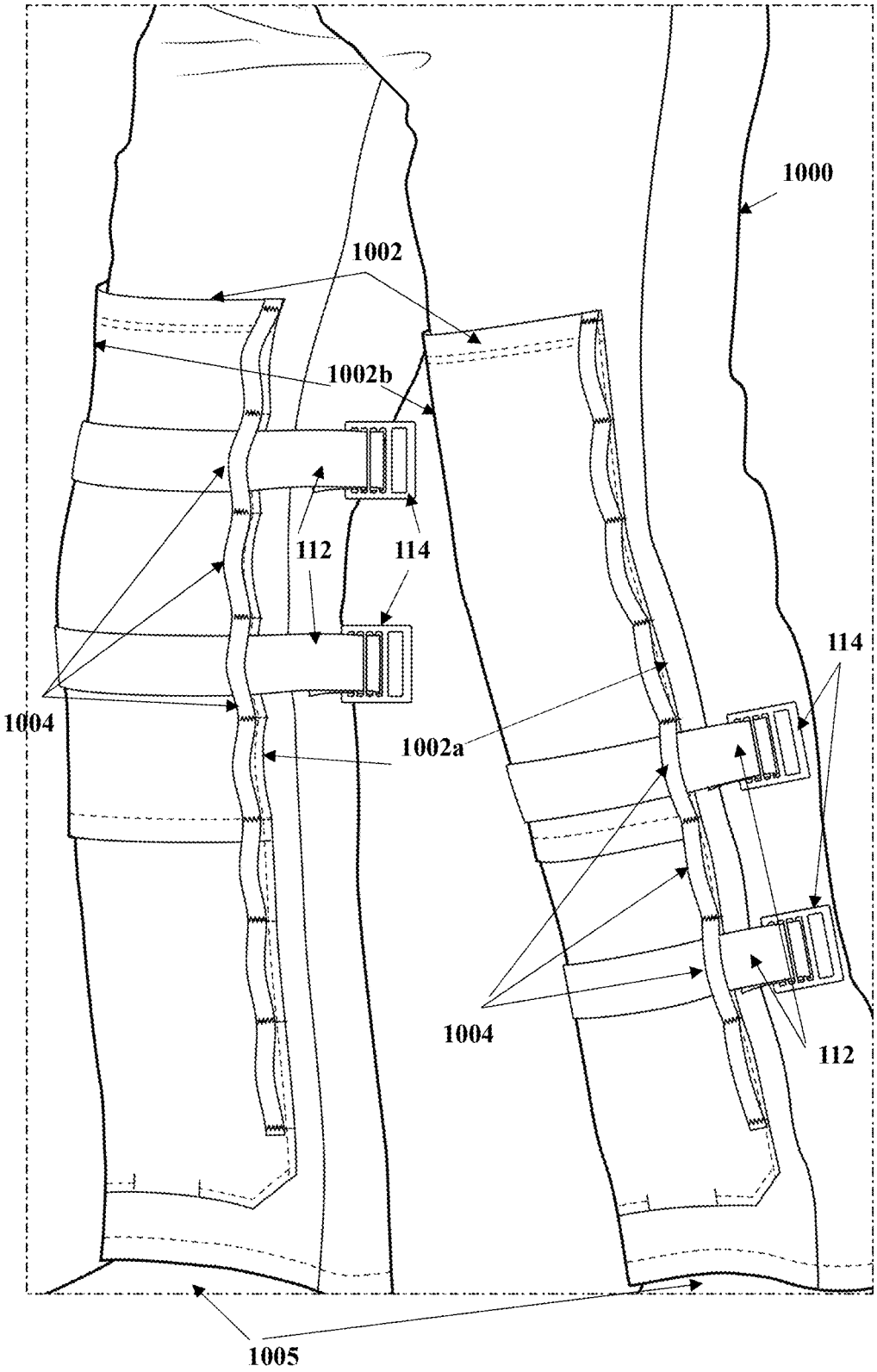
FIG. 11B illustrates the straps being inserted through the pair of loops.
Figure 11C:
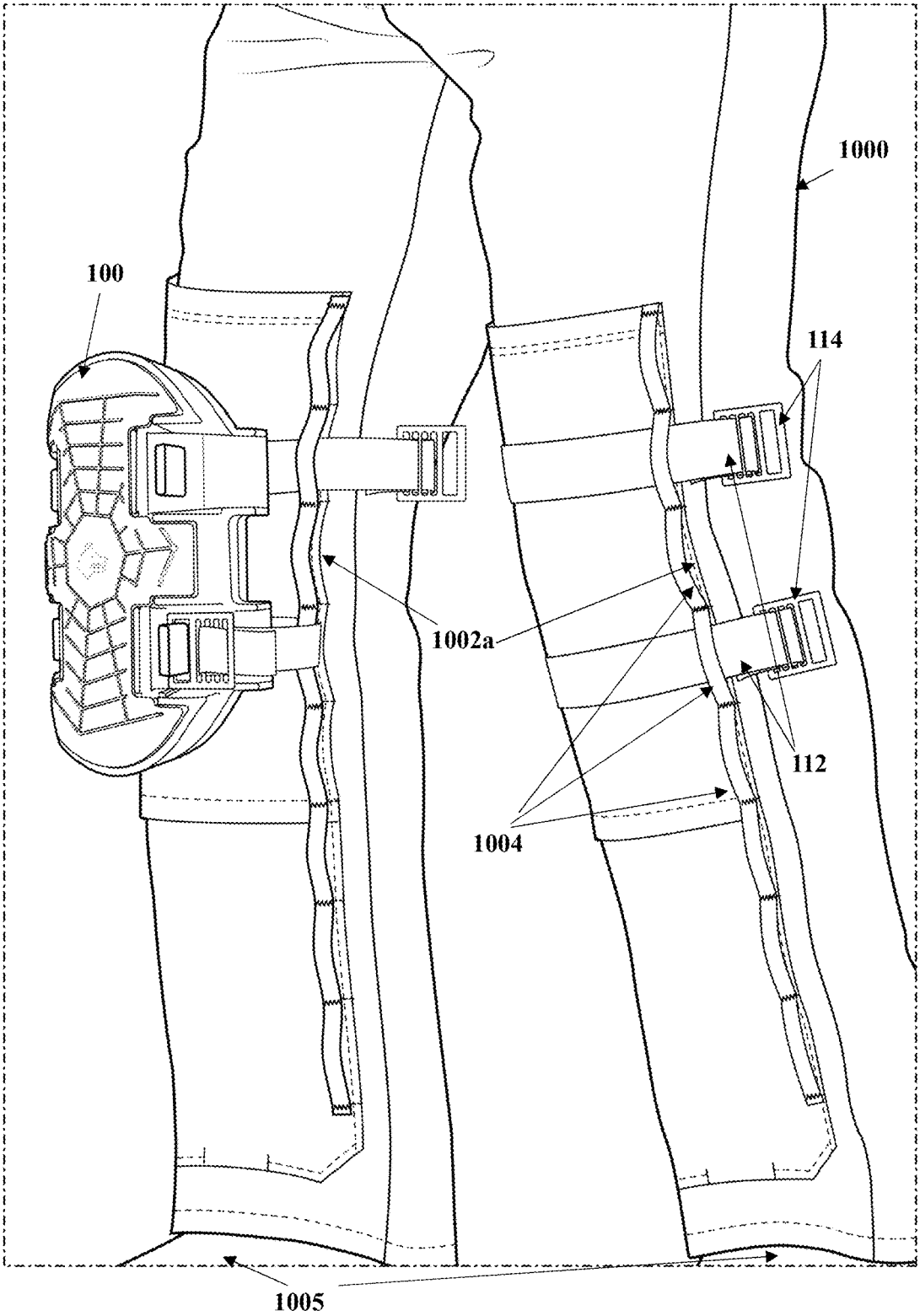
FIG. 11C illustrates the relocatable protection system being secured using the slotted anchor plates and the cantilever hook.

FIG. 11B illustrates the straps being inserted through the pair of loops 1004. FIG. 11C illustrates the relocatable protection system 100 being secured using the slotted anchor plates 114 and the cantilever hook 103*d* and 105*d*.

Figure 12A:
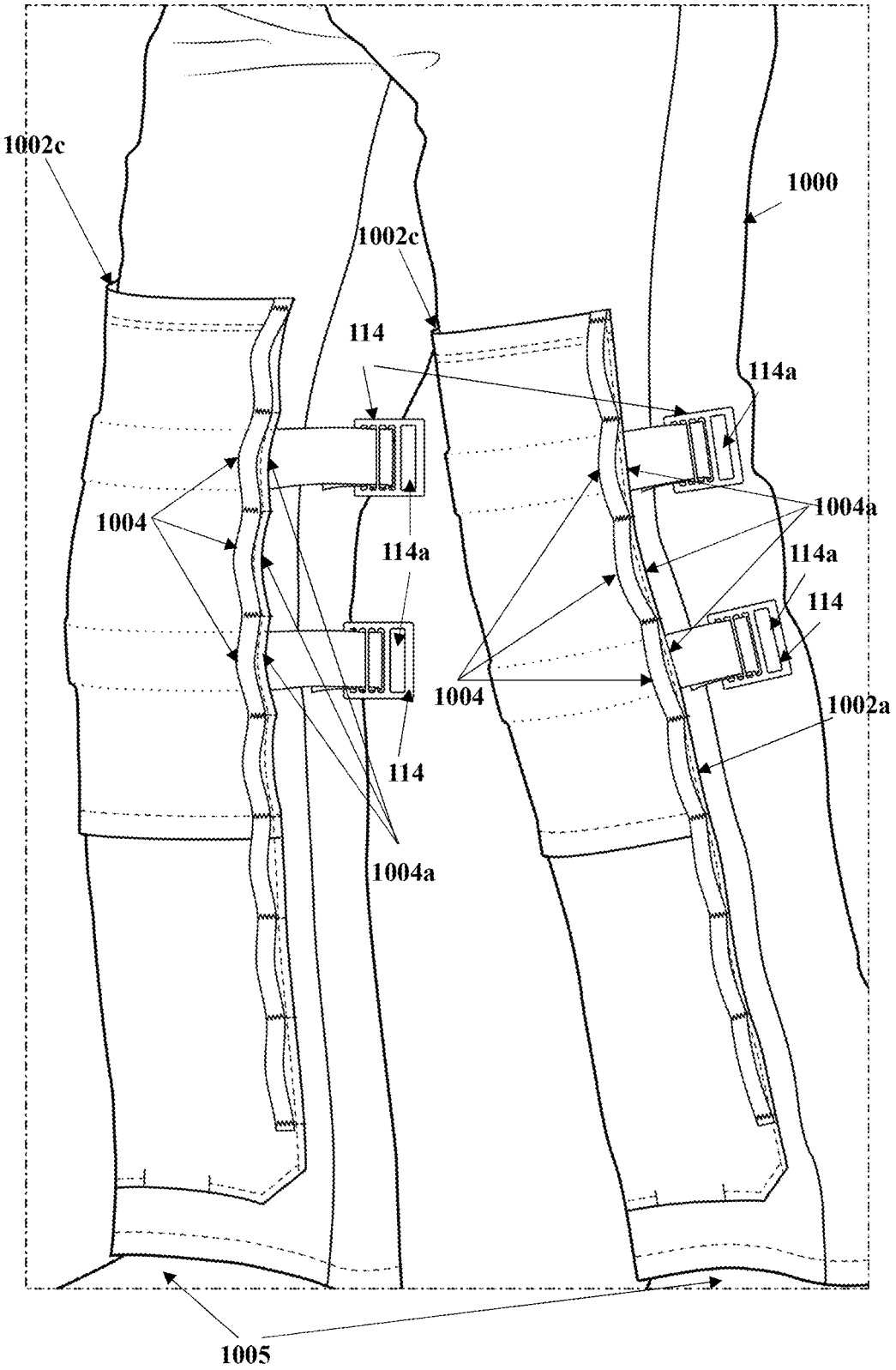
FIG. 12A illustrates another embodiment of the relocatable protection system where the straps are secured to a pair of elongated pockets through the openings in the pair of elongated pockets.
Figure 12B:
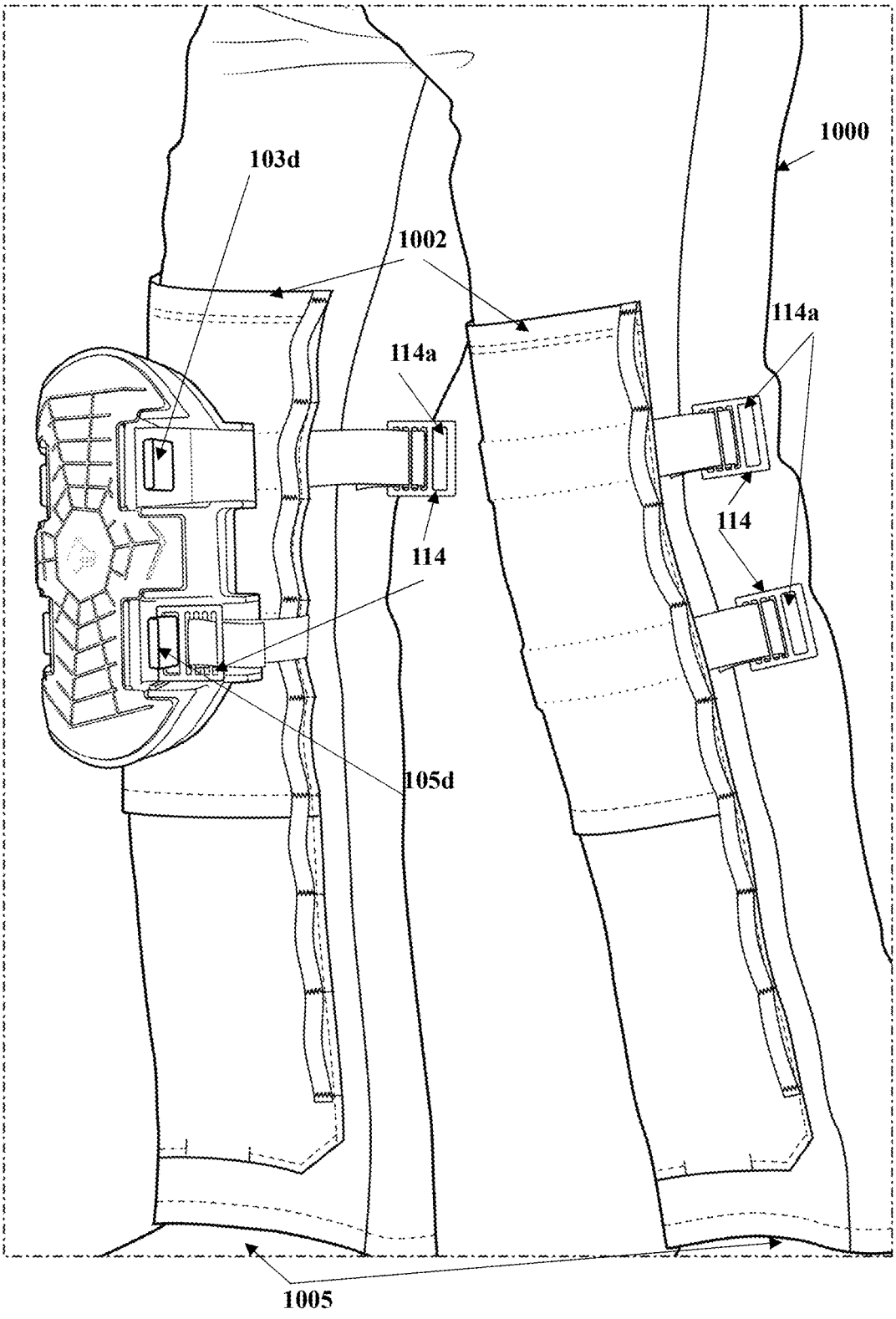
FIG. 12B illustrates the slotted anchor plates at the ends of the strap being secured to the corresponding cantilever hook of the relocatable protection system.

FIG. 12A illustrates another embodiment of the relocatable protection system where the straps are secured to the pair of elongated pockets 1002 through the openings 1004*a* in the pair of elongated pockets 1002. As illustrated in FIGS. 10A-10C, the pair of elongated pockets 1002 comprise multiple openings 1004*a* disposed underneath the first longitudinal side 1002*a* and the second longitudinal side 1002*b* of the pair of elongated pockets 1002. More specifically, the portions of the first longitudinal side 1002*a* and the second longitudinal side 1002*b* below each of the loops 1004 are not attached to the pair of trousers 1000 to create the openings 1004*a*. An end 112*a* of the strap 112 may therefore be inserted into an opening 1004*a* at one of the longitudinal sides, for example, the first longitudinal side 1002*a*, and drawn out from an opening 1004*a* at the second longitudinal side 1002*b*, where the opening 1004*a* at the second longitudinal side 1002*b* is opposite to the opening 1004*a* at the first longitudinal side 1002*a*. The slotted anchor plates 114 at the ends 112*a* of the strap 112 may be then secured to the corresponding cantilever hook 103*d* or 105*d* of the relocatable protection system 100. FIG. 12B illustrates the slotted anchor plates 114 at the ends 112*a* of the strap 112 being secured to the corresponding cantilever hook 103*d* or 105*d* of the relocatable protection system 100.

Figure 13A:
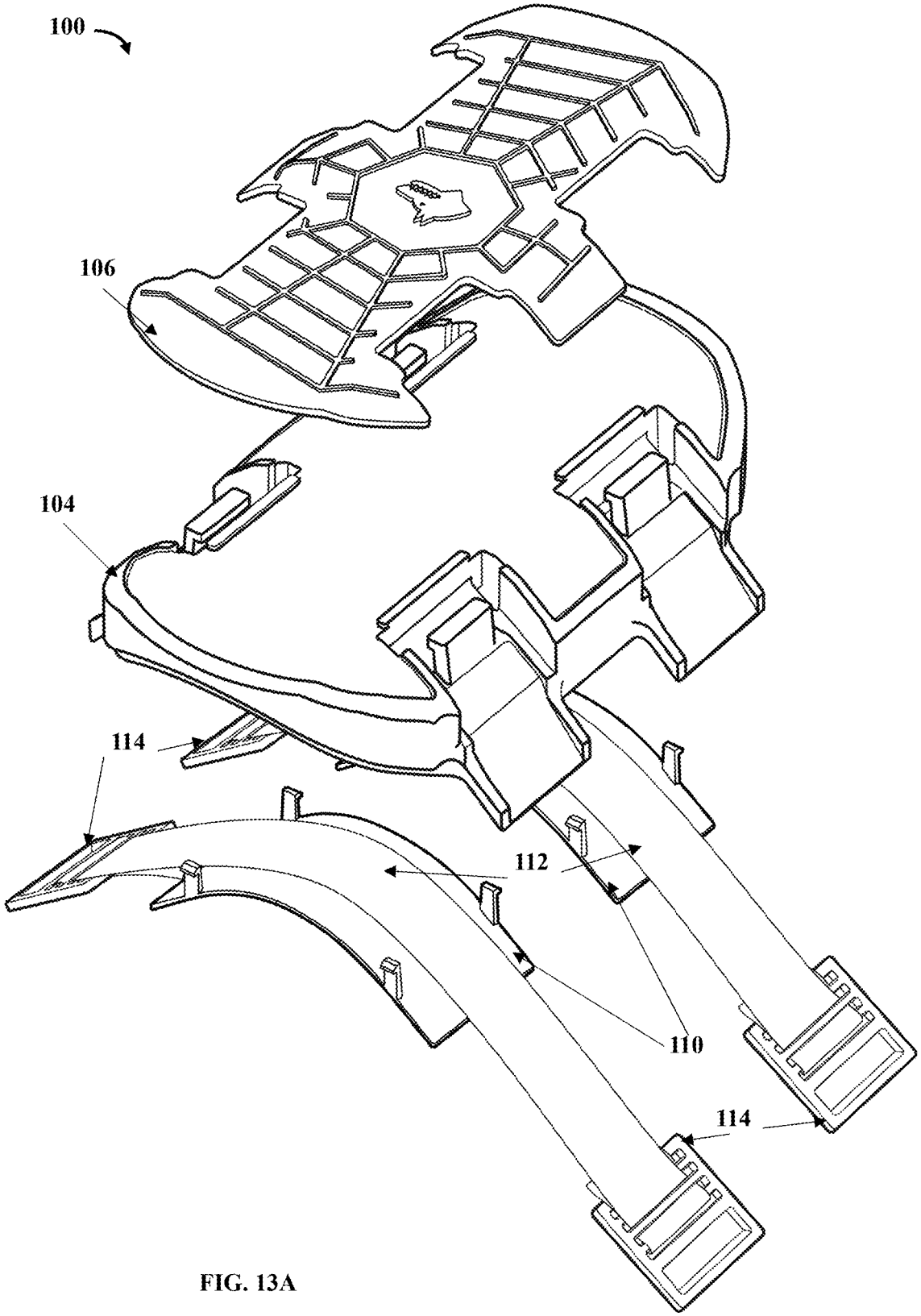
FIGS. 13A and 13B illustrates another embodiment of the relocatable protection system that does not use the base padding.
Figure 13B:
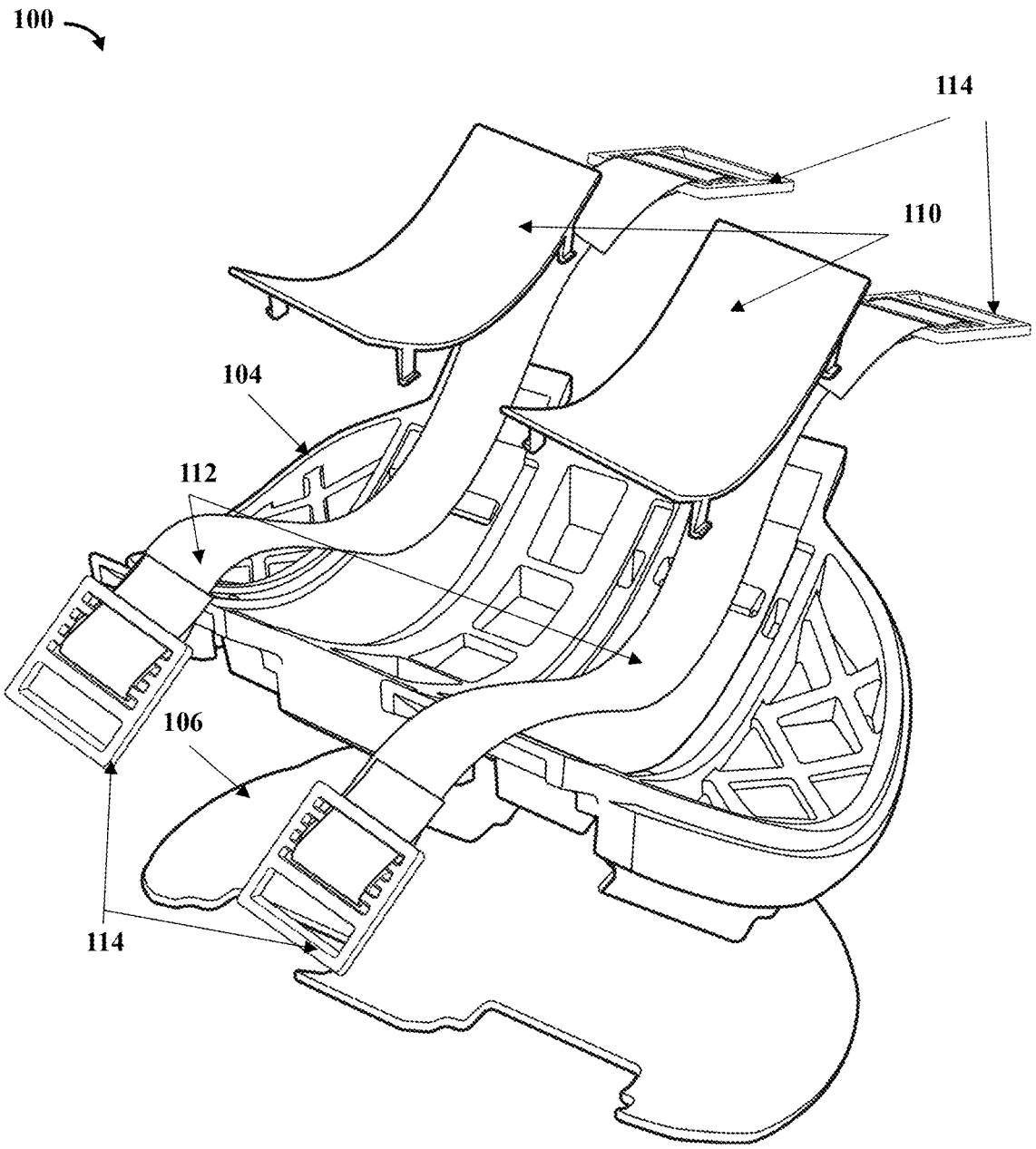
Figure 13C:
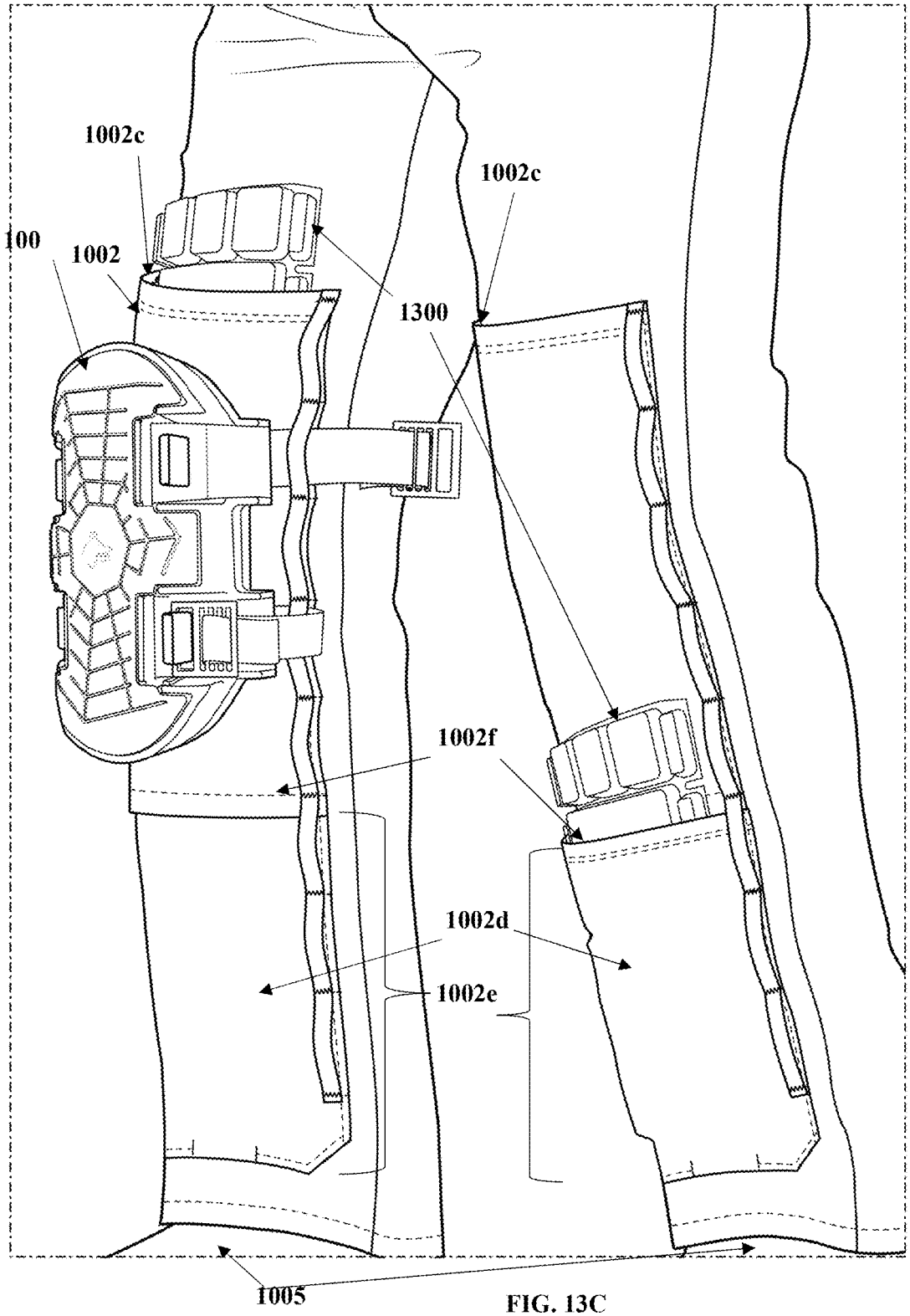
FIG. 13C illustrates insertion of the padding material into the auxiliary pocket of the elongated pocket.
Figure 13D:
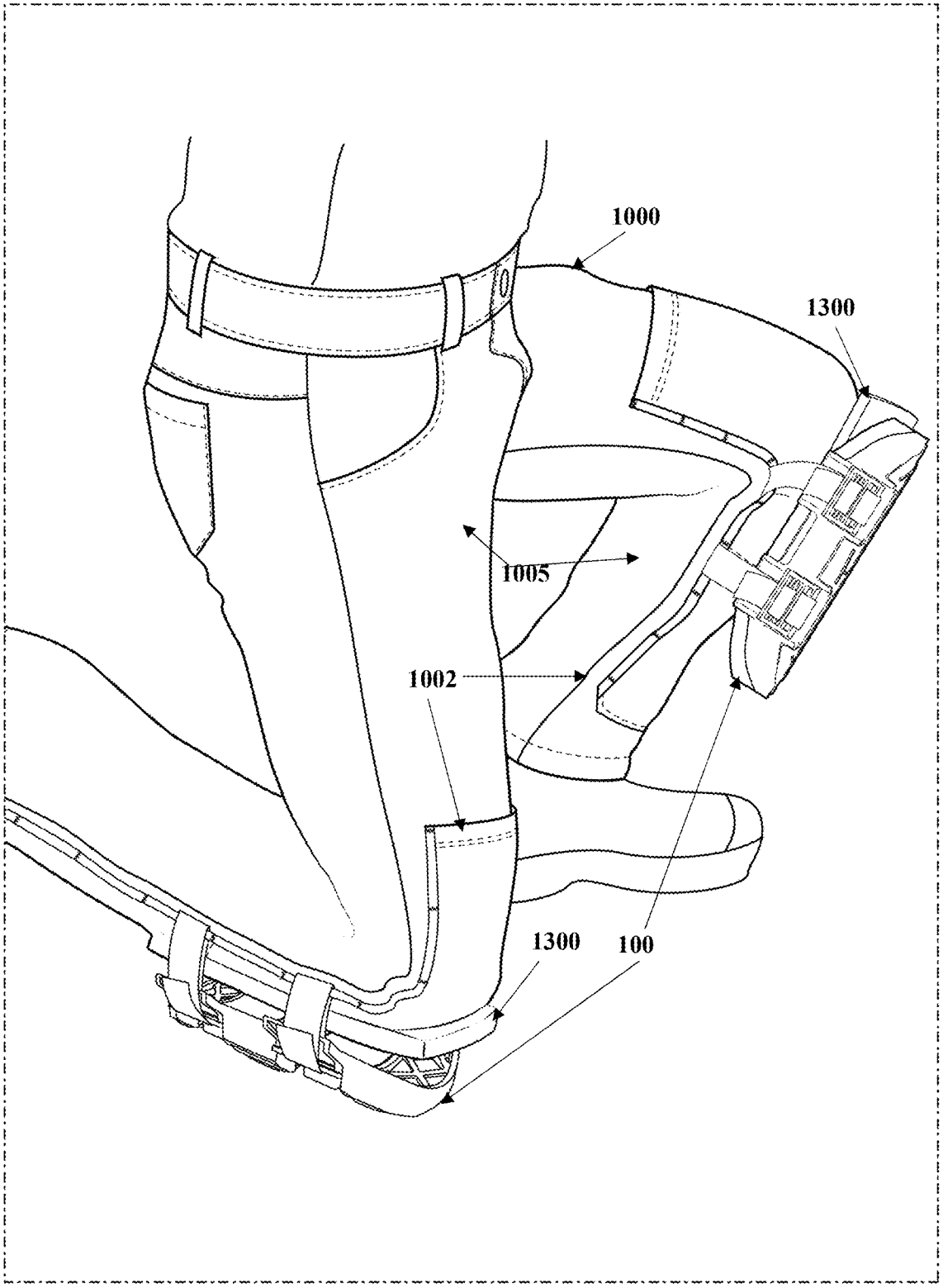
FIG. 13D illustrates a usage of the embodiment of the relocatable protection system shown in FIGS. 13A-13C.

FIGS. 13A and 13B illustrates another embodiment of the relocatable protection system 100 that does not use the base padding 102. Instead of the base padding 102, the wearer may insert padding material 1300, as shown in FIGS. 13C and 13D, into the pair of elongated pockets 1002 through the top opening 1002*c* of the pair of elongated pockets 1002. In an embodiment, each of the elongated pockets 1002*g* and 1002*h* may comprise an auxiliary pocket 1002*d* positioned at a lower section 1002*e* of the elongated pockets 1002*g* and 1002*h*, as shown in FIG. 13C. The auxiliary pocket 1002*d* comprises a separate opening 1002*f* at a top of the auxiliary pocket 1002*d* for receiving the padding material 1300. In an embodiment, the lower section 1002*e* of each of the elongated pockets 1002*g* and 1002*h* is proximal to a shin area of the pair of trousers, as shown in FIG. 13C. FIG. 13C illustrates insertion of the padding material 1300 into the auxiliary pocket 1002*d* of the elongated pocket 1002. FIG. 13D illustrates a usage of the embodiment of the relocatable protection system 100 shown in FIGS. 13A-13C.

Figure 13E:
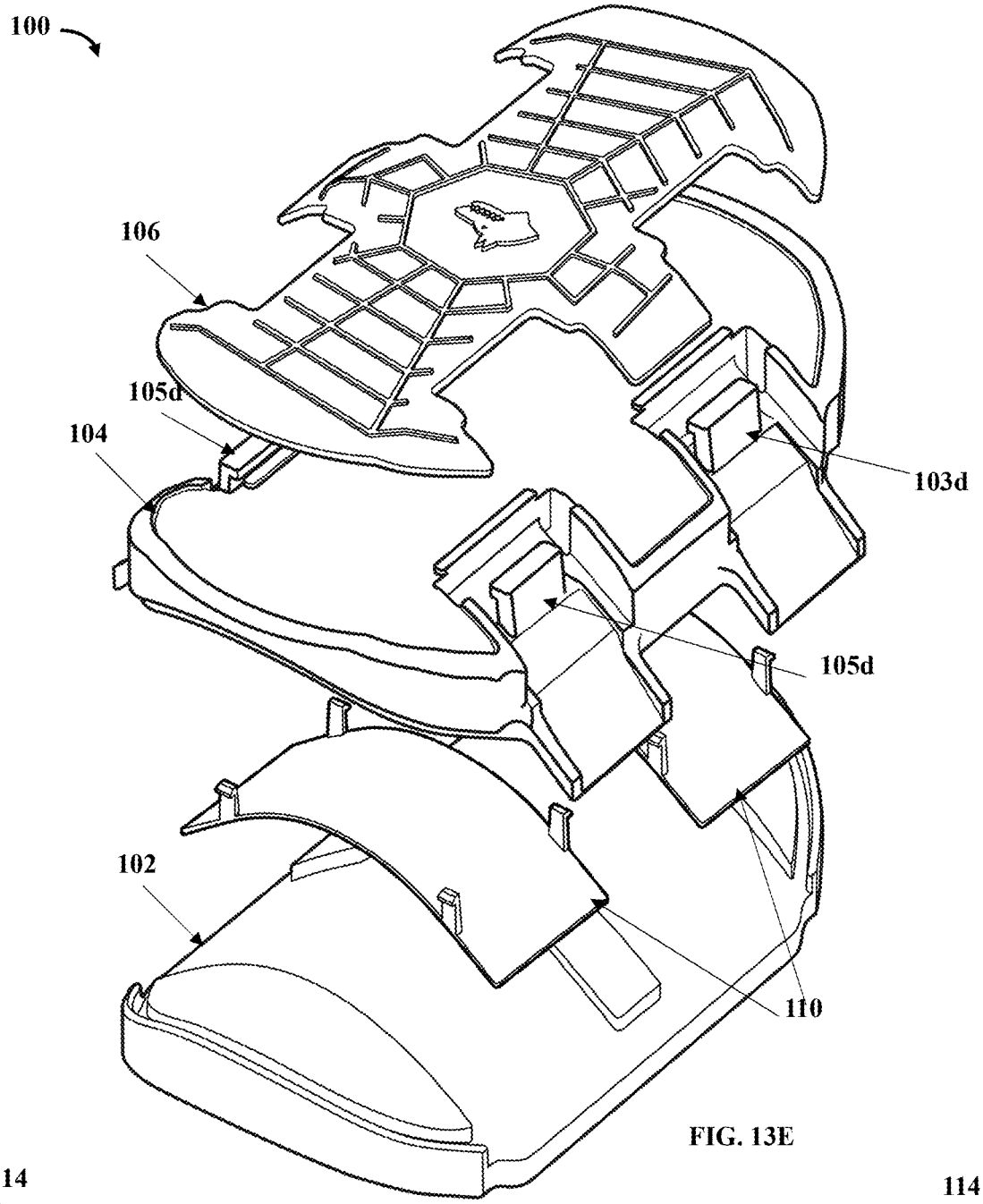
FIG. 13E illustrates an exploded view of an embodiment of the relocatable protection system which uses all the components, similar to FIGS. 10A-12B.
Figure 14C:
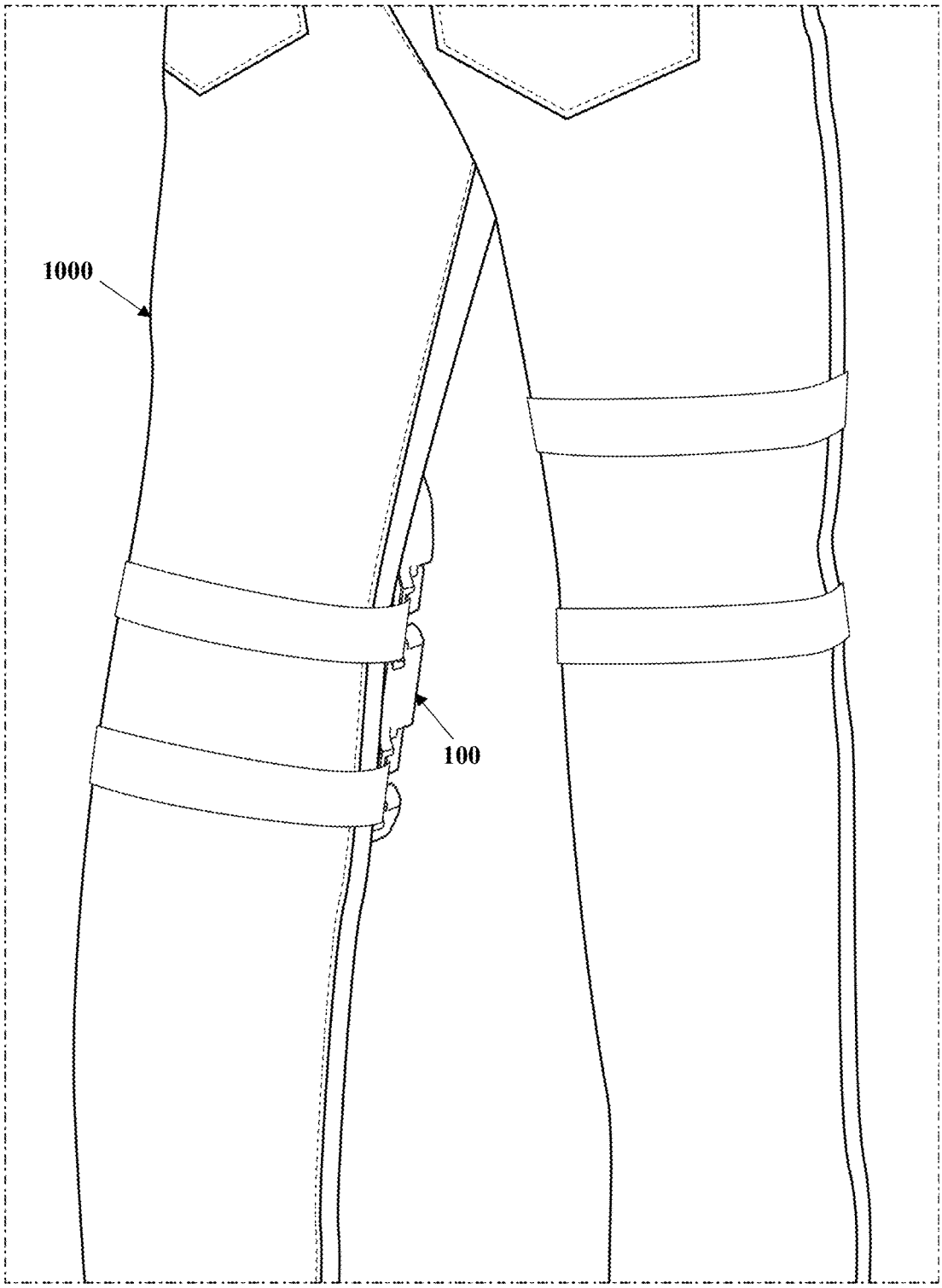
FIG. 14C illustrates a rear view of FIG. 14B.

FIG. 13E illustrates an exploded view of an embodiment of the relocatable protection system 100 which uses all the components, similar to FIGS. 10A-12B. However, the relocatable protection system 100 shown in FIG. 14A may be used with all types of traditional trousers, work pants, etc. FIG. 14A illustrates a pair of straps 112 used to fasten the relocatable protection system 100 to a body part of the wearer. FIG. 14B illustrates the relocatable protection system 100 being secured to a leg 1005 of a wearer by wrapping the strap 112 around the leg 1005 of the wearer. FIG. 14C illustrates a rear view of FIG. 14B. Even though FIGS. 14B and 14C show the pair of trousers 1000 having the pair of elongated pockets 1002 comprising loops 1004 on the first longitudinal side 1002*a* and the second longitudinal side 1002*b* of the pockets 1002, it should be noted that the loops 1004 are not used to secure the relocatable protection system 100 to the wearer's legs 1005. Instead, the relocatable protection system 100 is directly wrapped around the leg 1005 of the wearer using the straps 112.

Figure 14D:
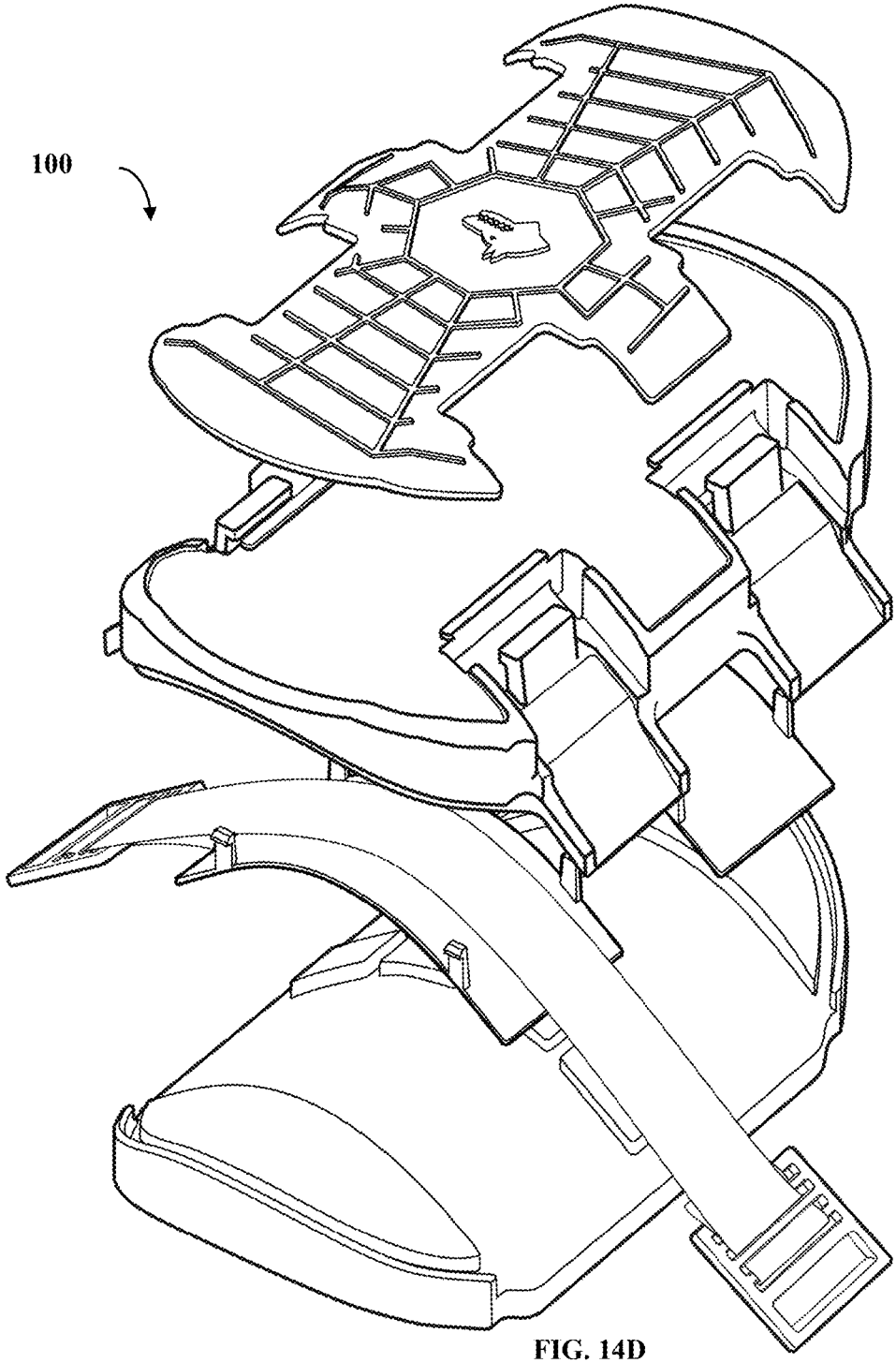
FIG. 14D illustrates another exploded view of an embodiment of the relocatable protection system where just a single strap is secured to the relocatable protection system using a retention member and the other strap is directly wrapped around the leg of a wearer.
Figure 15A:
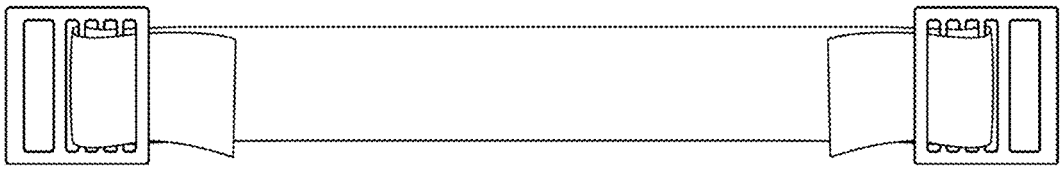
FIG. 15A illustrates a single strap used to secure the relocatable protection system to the leg of the wearer.
Figure 15B:
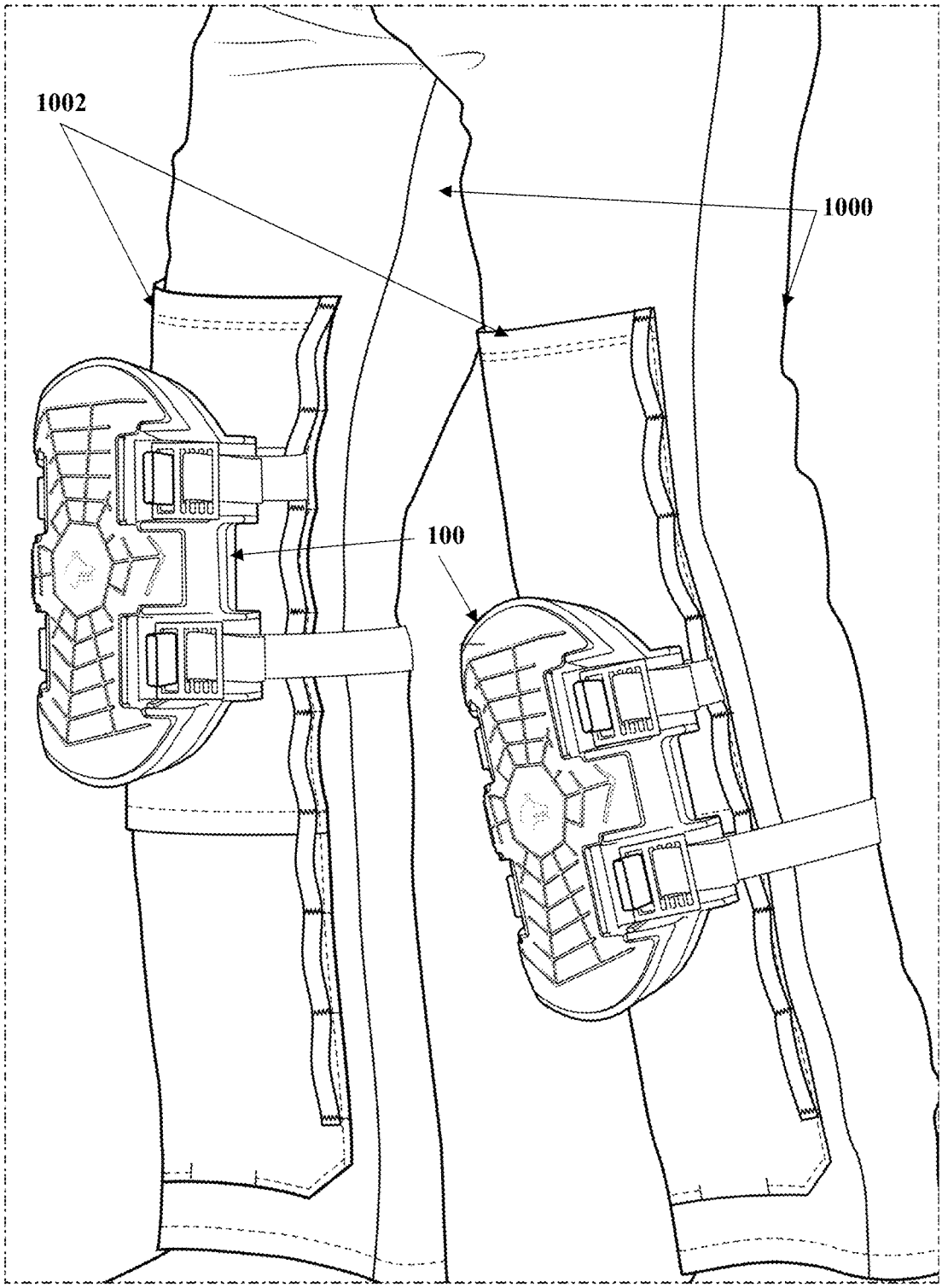
FIG. 15B illustrates the relocatable protection system shown in FIG. 14D being secured to the legs of the wearer.
Figure 15C:
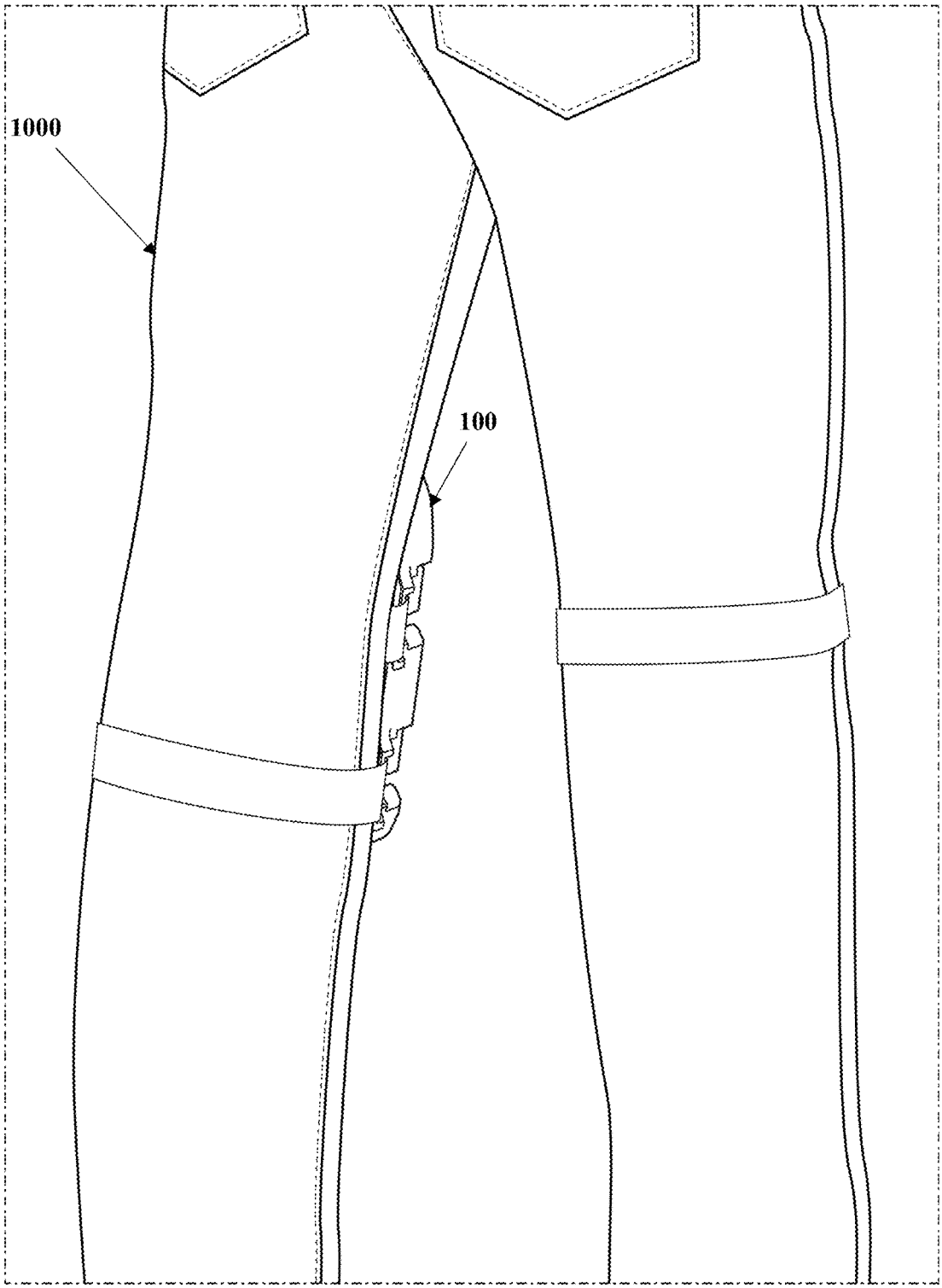
FIG. 15C illustrates a rear view of FIG. 15B.

FIG. 14D illustrates another exploded view of an embodiment of the relocatable protection system 100 where just a single strap 112 is secured to the relocatable protection system 100 using a retention member 110 and the other strap 112 is directly wrapped around the leg 1005 of a wearer. FIG. 15A illustrates a single strap 112 used to secure the relocatable protection system 100 to the leg 1005 of the wearer. FIG. 15B illustrates the relocatable protection system 100 shown in FIG. 14D being secured to the legs 1005 of the wearer. FIG. 15C illustrates a rear view of FIG. 15B. FIGS. 15B and 15C illustrate a hybrid model of securing the relocatable protection system 100 to the leg 1005 of the wearer. As shown in FIGS. 15B and 15C, the upper strap 112 may be inserted through the loops 1004 with the ends 112*a* of the strap 112 being looped around the loops 1004 on the first longitudinal side 1002*a* and the second longitudinal side 1002*b* and then the slotted anchor plates 114 at the ends 112*a* of the strap 112 secured to the corresponding cantilever hook 103*d* or 105*d* of the relocatable protection system 100. The lower strap 112 may directly wrap around the leg 1005 of the wearer and then secured to the cantilever hooks 103*d* and 105*d* via slotted anchor plates 114.

In an embodiment, each part of the relocatable protection system 100 i.e., the base padding 102, the shell 104, the slip-resistant layer 106, and the fastening mechanism 108 comprising the retention members 110, the straps 112 and the slotted anchor plates 114 is easily replaceable. Furthermore, each part of the relocatable protection system 100 can be removed and replaced without using any tools.

Furthermore, as illustrated in FIGS. 10A-15C, a wearer can use the relocatable protection system 100 the way the user likes. For example, the user may wear the relocatable protection system 100 on the left leg or on the right leg or both. The wearer may wear the relocatable protection system 100 on the wearer's body part, for example, a knee, an elbow, a thigh, a shin, a forearm, an upper arm, etc., of the wearer. Furthermore, the wearer may wear the relocatable protection system 100 on an upper part, a lower part or a middle of the wearer's body part.

In an embodiment, the relocatable protection system 100 and the pair of trousers 1000 together form a kit 1100 that may be worn by the wearer for protecting his body part. The kit 1100 comprises the relocatable protection system 100 and the pair of trousers 1000, as shown FIG. 10C. The relocatable protection system 100 comprises the base padding 102 comprising the base padding upper surface 102*a* and a base padding lower surface 102*b*. The base padding lower surface 102*b* is shaped to substantially conform to a wearer's body part. The relocatable protection system 100 further comprises the shell 104 positioned over the base padding 102. The shell 104 has a capsule shape. More specifically, the shell 104 has an elongated body portion 104*v* and opposing rounded end portions 104*w* and 104*x*, as shown in FIG. 5A. The shell 104 comprises the shell upper section 104*a*, the shell lower section 104*b* and the intermediate section 104*c* therebetween the shell upper section 104*a* and the shell lower section 104*b*. The shell 104 further comprising at least two pairs of indentations 103 and 105. Each of the indentations 103 and 105 comprise cantilever hooks 103*d* and 105*d* projecting substantially perpendicularly upwards from the indentations 103 and 105 and disposed proximal to the external wall 104*t* of the intermediate section 104*c*. Atop end of each of the cantilever hooks 103*d* and 105*d* comprise a catch 103*e* and 105*e*. The relocatable protection system 100 further comprises the slip resistant layer 106 positioned over the shell 104. The relocatable protection system 100 further comprises the fastening mechanism 108 disposed between the base padding 102 and the shell 104. The fastening mechanism 108 comprises multiple retention members 110. Each of the retention members 110 is configured to be attached to the shell lower section 104*b*. The fastening mechanism 108 further comprises multiple straps 112 corresponding to the number of retention members 110. The straps 112 are configured to fasten the relocatable protection system 100 to the wearer's body part. Each of the straps 112 are disposed along a length of one of the retention members 110 and sandwiched between the retention member 110 and the shell lower section 104*b*. The fastening mechanism 108 further comprises slotted anchor plates 114, each attached to an end 112*a* of one of the straps 112. Each of the slotted anchor plates 114 comprise the anchor slot 114*a* and adjuster slots 114*b*. The end 112*a* of one of the straps 112 is looped through the adjuster slots 114*b* to adjust the length of the one of the straps 112. The anchor slot 114*a* and the adjuster slots 114*b* are substantially parallel to each other.

The kit 1100 further comprises the pair of trousers 1000 for accommodating the relocatable protection system 100. The pair of trousers 1000 comprises the pair of elongated pockets 1002. Each one of the pair of elongated pockets 1002 is attached to the front section 1000*a* of a trouser leg 1000*b* of the pair of trousers 1000, as shown in FIG. 10A. The elongated pockets 1002 comprise a top opening 1002*c*. Each of the pair of elongated pockets 1002 comprise adjacently located loops 1004 on both the first longitudinal side 1002*a* and the second longitudinal side 1002*b* of the pair of elongated pockets. The pair of elongated pockets 1002 comprise openings 1004*a* disposed underneath the first and second longitudinal sides 1002*a* and 1002*b* of the pair elongated pockets.

Figure 16A:
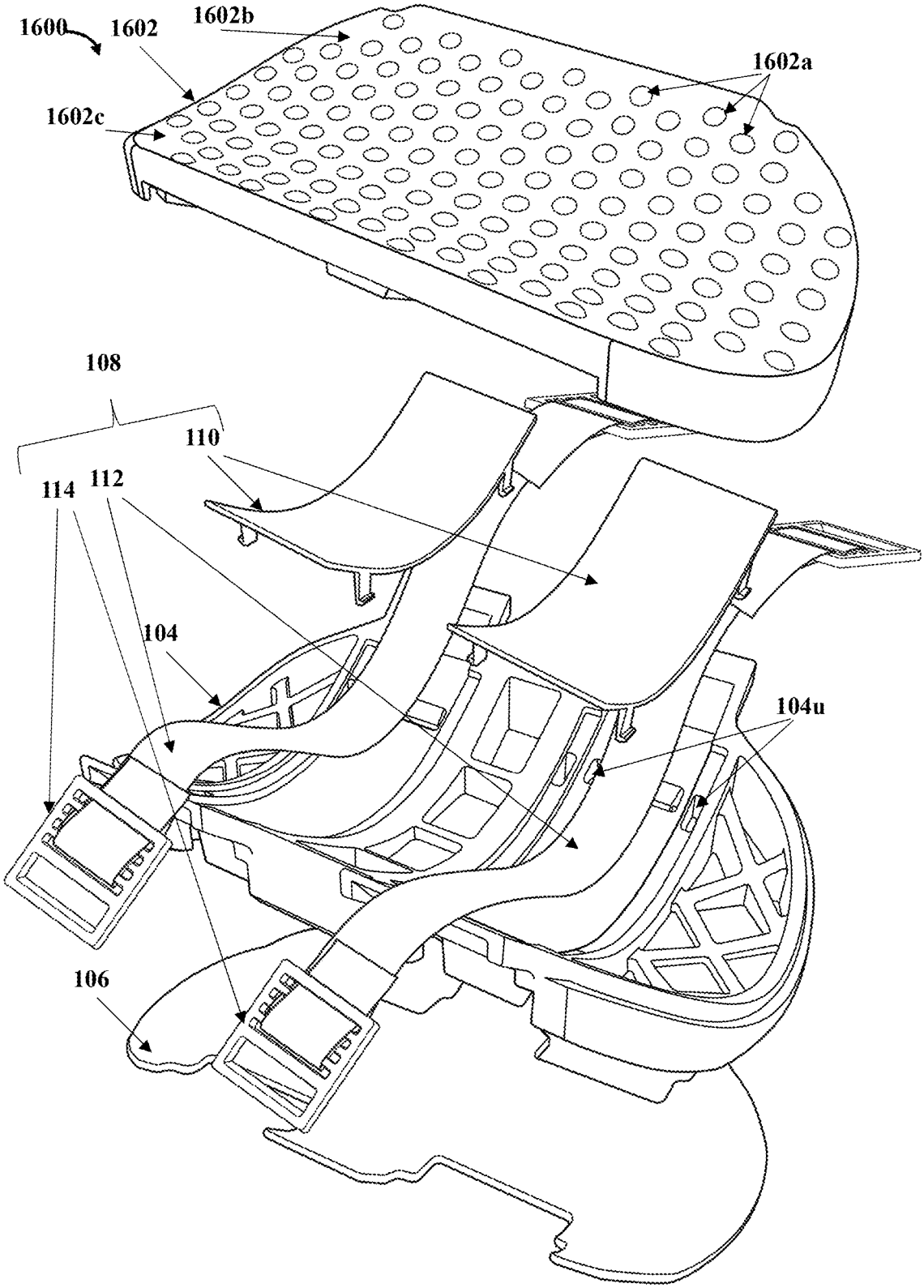
FIG. 16A illustrates an exploded front, bottom perspective view of another embodiment of the relocatable protection system having a base padding comprising multiple circular protuberances on a base padding lower surface.
Figure 16B:
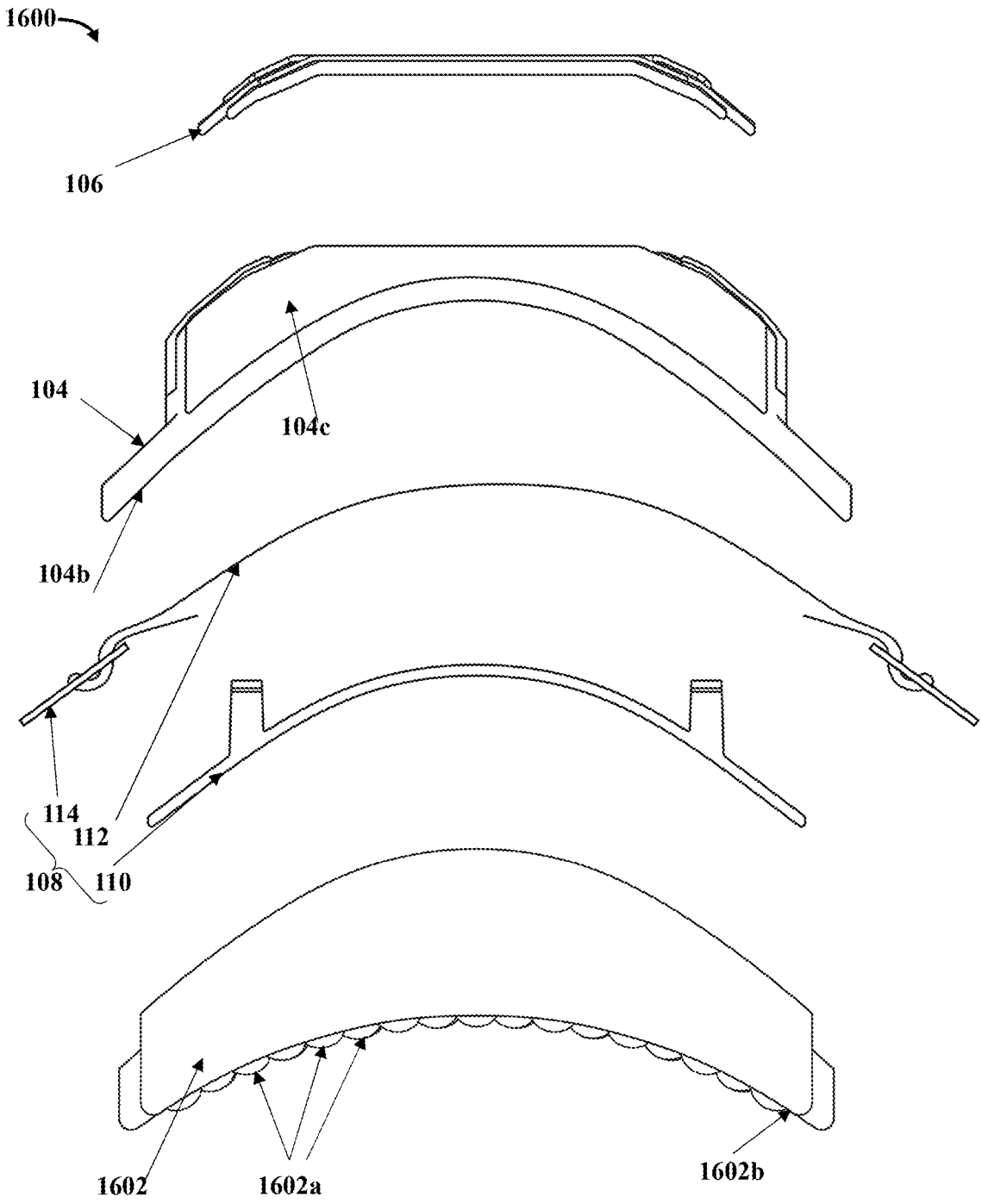
FIG. 16B illustrates an exploded front view of the embodiment of the relocatable protection system shown in FIG. 16A.
Figure 16C:
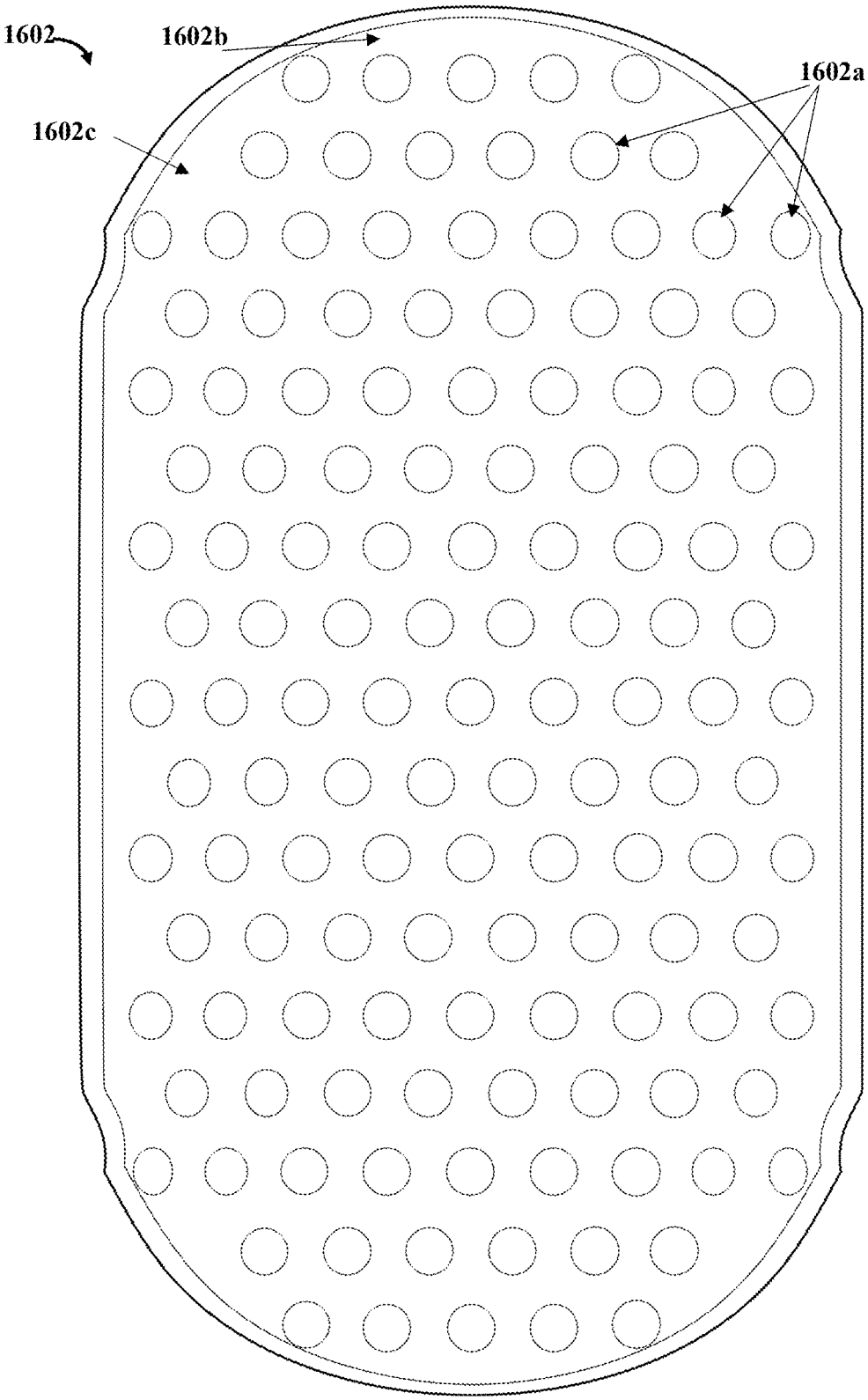
FIG. 16C illustrates a rear view of the base padding showing the circular protuberances on the base padding lower surface.

FIG. 16A illustrates an exploded front, bottom perspective view of another embodiment of the relocatable protection system 1600 having a base padding 1602 comprising multiple circular protuberances 1602*a* on a base padding lower surface 1602*b*. FIG. 16B illustrates an exploded front view of the embodiment of the relocatable protection system 1600 shown in FIG. 16A. Each of the circular protuberances 1602*a* protrude about 1 mm to about 5 mm from a surface 1602*c* of the base padding lower surface 1602*b* and have a diameter of about 2 mm to about 1 cm. FIG. 16C illustrates a rear view of the base padding 1602 showing the circular protuberances 1602*a* on the base padding lower surface 1602*b*. The circular protuberances 1602*a* are arranged in rows, as shown in FIG. 16C. Furthermore, the circular protuberances 1602*a* are spaced apart from each other by about 2 mm to about 1 cm. In an embodiment, as shown in FIGS. 16A and 16C-16E, the circular protuberances 1602*a* in a one of the rows along a width of the base padding 1602 are offset in position with respect to the circular protuberances 1602*a* in an immediate adjacent row of the base padding 1602 such that circular protuberances 1602*a* in the first row and the immediate adjacent row are not in a single column.

Figure 16D:
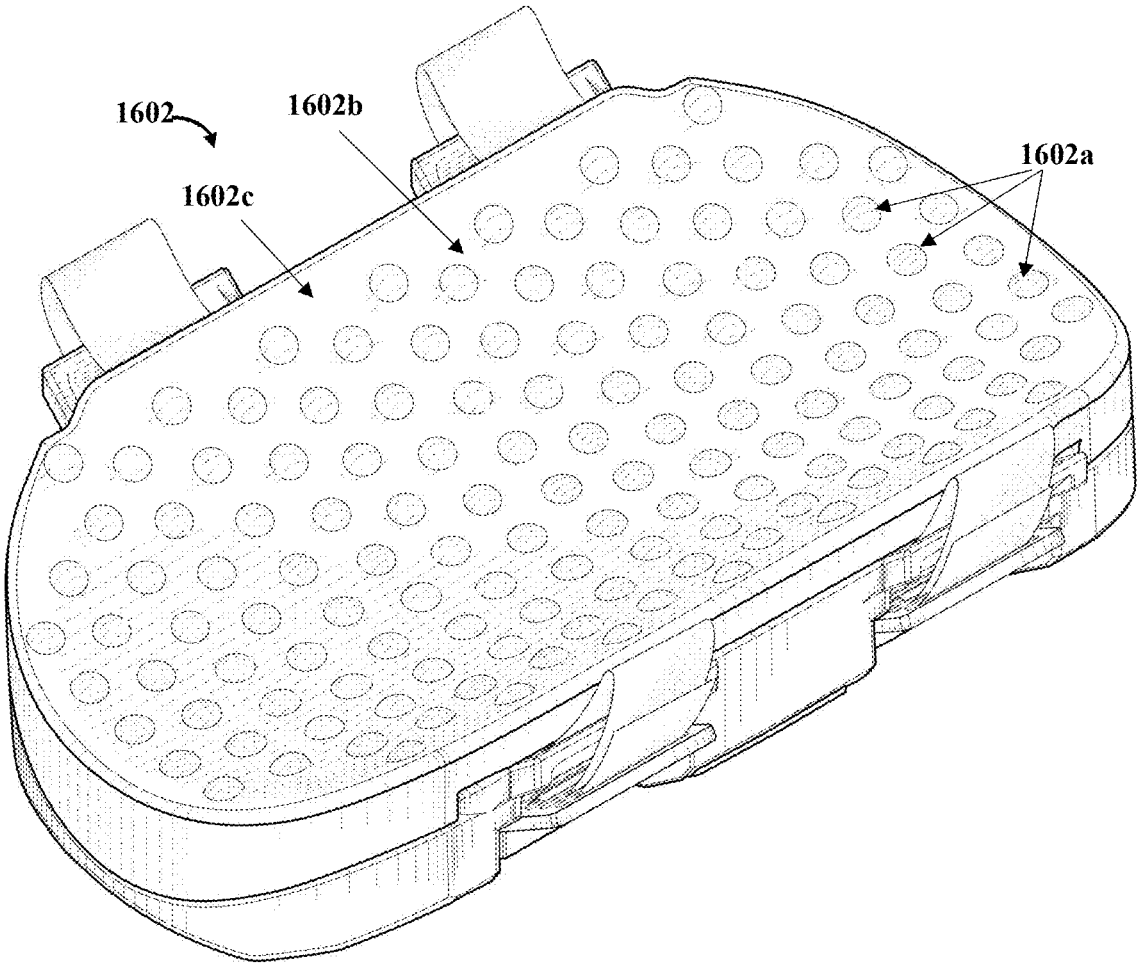
FIG. 16D illustrates a rear perspective view of the base padding showing the circular protuberances on the base padding lower surface.
Figure 16E:
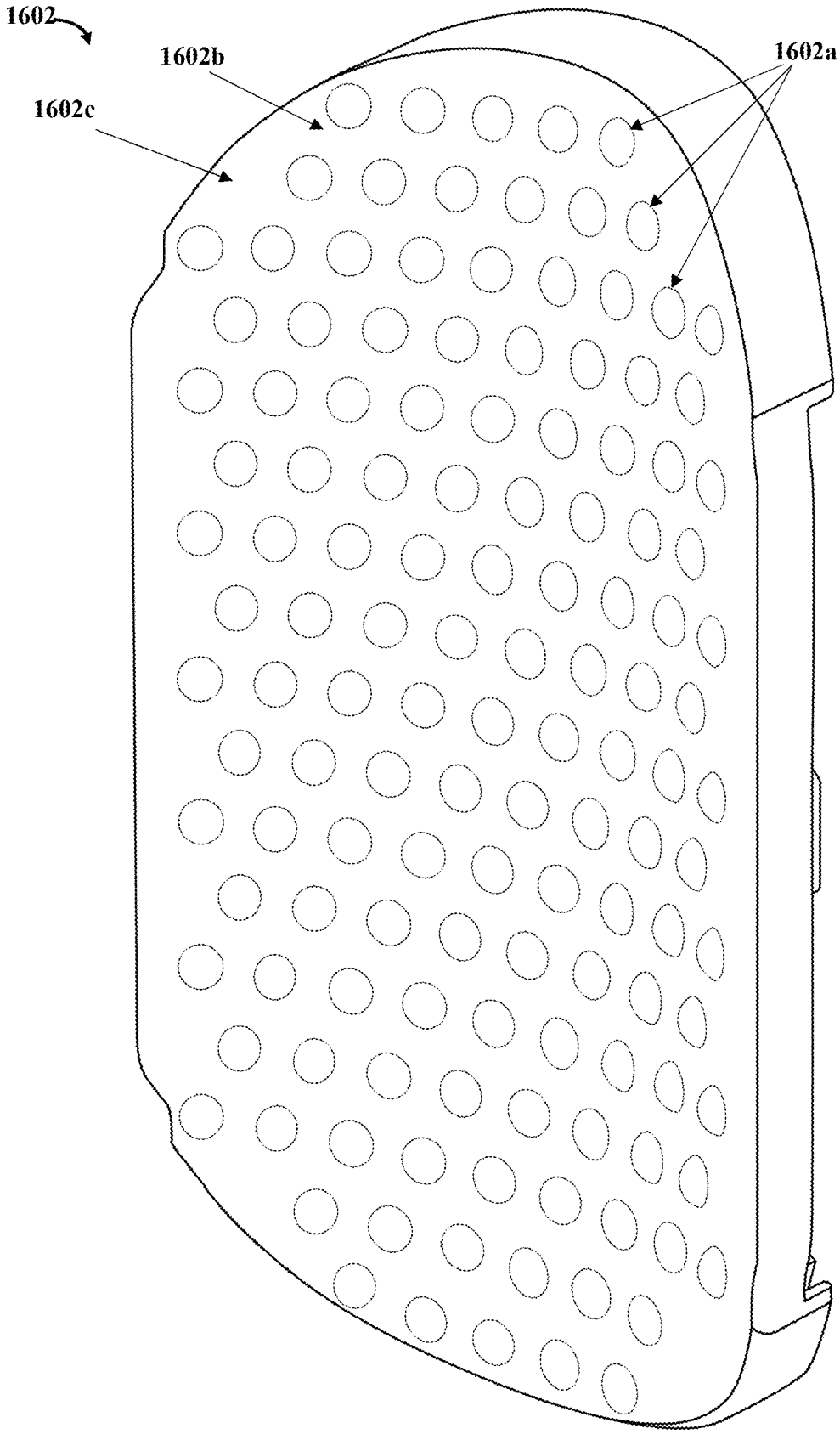
FIG. 16E illustrates another rear perspective view of the base padding showing the circular protuberances on the base padding lower surface.
Figure 16F:
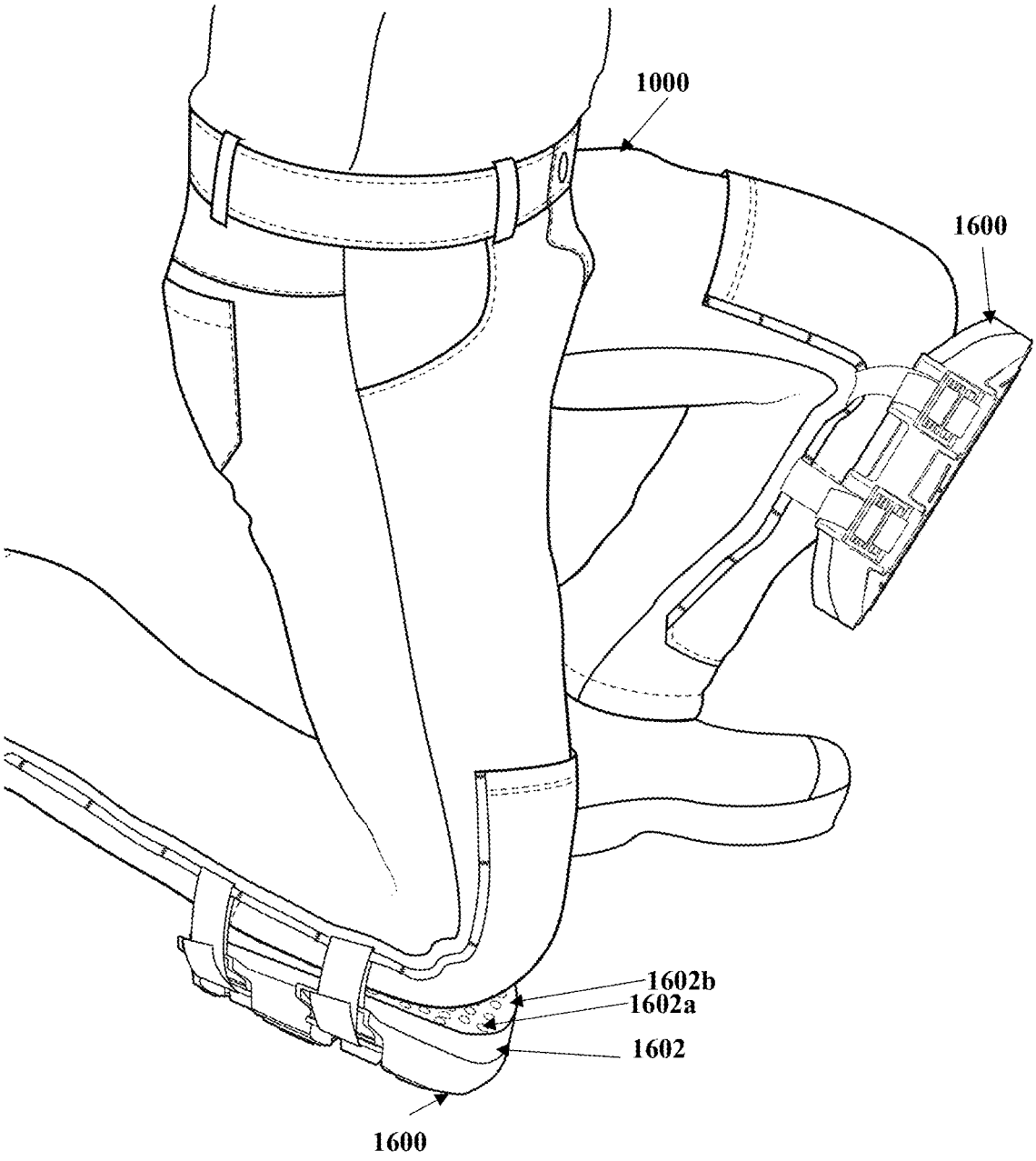
FIG. 16F illustrates a usage of the embodiment of the relocatable protection system shown in FIG. 16A.

FIG. 16D illustrates a rear perspective view of the base padding showing the circular protuberances on the base padding lower surface. FIG. 16E illustrates another rear perspective view of the base padding showing the circular protuberances on the base padding lower surface. FIG. 16F illustrates a usage of the embodiment of the relocatable protection system shown in FIG. 16A. The circular protuberances 1602*a* provide additional cushioning to a wearer's body part, for example, the knees, as shown in FIG. 16F, when the wearer kneels down on his knees. In an embodiment, the circular protuberances 1602*a* may provide ventilation to the wearer's body part that lies directly underneath the circular protuberances 1602*a* by creating a gap between the base padding lower surface 1602*b* and the wearer's body part that lies directly underneath the circular protuberances 1602*a*. In an embodiment, the base padding lower surface 1602*b* may comprise protuberances of other shapes such as oval shaped protuberances.

The foregoing examples have been provided merely for explanation and are in no way to be construed as limiting of the relocatable protection system 100 disclosed herein. While the relocatable protection system 100 has been described with reference to various embodiments, it is understood that the words, which have been used herein, are words of description and illustration, rather than words of limitation. Furthermore, although the relocatable protection system 100 has been described herein with reference to particular means, materials, and embodiments, the relocatable protection system 100 is not intended to be limited to the particulars disclosed herein; rather, the relocatable protection system 100 extends to all functionally equivalent structures, methods and uses, such as are within the scope of the appended claims. While multiple embodiments are disclosed, it will be understood by those skilled in the art, having the benefit of the teachings of this specification, that the relocatable protection system 100 disclosed herein are capable of modifications and other embodiments may be effected and changes may be made thereto, without departing from the scope and spirit of the relocatable protection system 100 disclosed herein.

I claim:

1. A relocatable protection system, comprising:

a base padding comprising a base padding upper surface and a base padding lower surface, wherein the base padding lower surface is shaped to substantially conform to a wearer's body part;

a shell positioned over said base padding, said shell having an elongated body portion and opposing rounded end portions, said shell comprising a shell upper section, a shell lower section and an intermediate section therebetween, wherein said shell lower section and said intermediate section have a cross-sectional shape of a curved arch, wherein said shell upper section comprises a substantially flat mid-section extending symmetrically from a longitudinal axis, wherein said shell upper section further comprises a first lateral curved section extending downwardly from a first side of said substantially flat mid-section and a second lateral curved section extending downwardly from a second side of said substantially flat mid-section, wherein said intermediate section comprises a plurality of cut-outs integrally formed along a width of the shell, wherein said cut-outs are located at a mid-section of the shell and extend along a thickness of the intermediate section, wherein said intermediate section further comprises a first latticework integrally formed at a first end and a second latticework integrally formed at a second end of said shell, wherein said first and second latticework are substantially parallel to said cut-outs and extend along the thickness of the intermediate section, wherein the first and second latticework extend partially along the thickness of the intermediate section, wherein the first latticework is partially recessed within a cavity at the first end of the shell and the second latticework is partially recessed within a cavity at the second end of the shell, wherein the cavity at the first end of the shell is adapted to receive and accommodate a first supplemental padding section of the base padding upper surface and the cavity at the second end of the shell is adapted to receive and accommodate a second supplemental padding section of the base padding upper surface, wherein each of the cavities comprises a wall surrounding the cavities, wherein a substantial portion of the wall surrounding the cavity at the first end of the shell is configured to mate with a first channel of the padding upper surface, and wherein a substantial portion of the wall surrounding the cavity at the second end of the shell is configured to mate with a second channel of the padding upper surface;

said shell further comprising at least two pairs of indentations, wherein each of said indentations comprises a cantilever hook projecting substantially perpendicularly upwards from said indentations and disposed proximal to an external wall of said intermediate section, wherein a top end of each of said cantilever hooks comprise a catch;

a slip resistant layer positioned over said shell; and a fastening mechanism disposed between said base padding and said shell, said fastening mechanism comprising:

a plurality of retention members, wherein said retention members are configured to be attached to said shell lower section;

a plurality of straps corresponding to said number of retention members, wherein said straps are configured to fasten said relocatable protection system to said wearer's body part, wherein each of said straps are disposed along a length of one of said retention members and sandwiched between said retention member and said shell lower section; and a plurality of slotted anchor plates, each attached to an end of one of said straps, wherein each of said slotted anchor plates comprise an anchor slot and a plurality of adjuster slots, wherein said end of one of the straps is looped through said adjuster slots to adjust the length of said one of the straps, wherein the anchor slot and the adjuster slots are substantially parallel to each other.

2. The relocatable protection system of claim 1, wherein the base padding, the shell and the slip resistant layer has one of a rounded rectangular shape and an oval shape.

3. The relocatable protection system of claim 1, wherein the base padding has a lateral cross-section of a segmental arch.

4. The relocatable protection system of claim 1, wherein the shell is made of an impact resistant material.

5. The relocatable protection system of claim 1, wherein each indentation comprises an opening in the shell upper section, another opening on a side of the shell, and a downwardly sloping cantilever slab, wherein a first of said pair of indentations are disposed between said cut-outs and said first latticework and a second of said pair of indentations are disposed between said cut-outs and said second latticework.

6. The relocatable protection system of claim 5, wherein each of said downwardly sloping cantilever slabs in the indentations comprise guardrails on both sides of each of the downwardly sloping cantilever slabs.

7. The relocatable protection system of claim 1, wherein the anchor slot in each one of the slotted anchor plates is configured to be positioned over a respective one of the cantilever hooks, and wherein each one of the cantilever hooks is slid into the anchor slot of a respective one of the slotted anchor plates to secure the respective one of the anchor plates to a corresponding one of the cantilever hooks.

8. The relocatable protection system of claim 1, wherein the base padding is configured to provide cushioning to the body part of the wearer.

9. The relocatable protection system of claim 1, wherein the padding upper surface comprises a mid-section located along a longitudinal axis of the padding upper surface, wherein the padding upper surface curves downwards from the mid-section located along the longitudinal axis to both sides of the padding upper surface that are parallel to the longitudinal axis.

10. The relocatable protection system of claim 1, wherein the padding upper surface comprises a plurality of protrusions disposed along a width of the base padding at a mid-section of the padding upper surface, wherein the protrusions have a generally square shape and are spaced apart from an adjacent one of the protrusions.

11. The relocatable protection system of claim 1, wherein each of said retention members comprise a plurality of cantilever snap-fit connectors located proximal to each corner of said retention member, wherein said retention member has a curved rectangular profile.

12. The relocatable protection system of claim 11, wherein each of the cantilever snap-fit connectors is configured to be inserted into corresponding one of a plurality of slots in the shell lower section, wherein each of the cantilever snap-fit connectors deflects and snaps back into place inside the slots when each of the respective cantilever snap-fit connectors is inserted into each of the respective slots, to secure each of the retention members to the shell lower section.

13. The relocatable protection system of claim 1, wherein the base padding lower surface comprises a plurality of circular protuberances, wherein the circular protuberances are arranged in a plurality of rows on the base padding lower surface, wherein the circular protuberances are spaced apart from each other, wherein the circular protuberances in one of the rows along a width of the base padding are offset in position with respect to the circular protuberances in an immediate adjacent row.

14. A pair of trousers, comprising:

a pair of elongated pockets, wherein each one of said pair of elongated pockets is attached to a front section of a trouser leg of the pair of trousers, wherein the elongated pockets comprise a top opening, wherein each of the pair of elongated pockets comprise a plurality of adjacently located loops on a first longitudinal side of the pair of elongated pockets and a plurality of adjacently located loops on a second longitudinal side of the pair of elongated pockets, wherein the pair of elongated pockets comprise a plurality of openings disposed below the first longitudinal side of the pair of elongated pockets and below the second longitudinal side of the pair of elongated pockets, wherein each of the adjacently located loops on the first longitudinal side of the pair of elongated pockets and each of the adjacently located loops on the second longitudinal side of the pair of elongated pockets is configured to receive a first strap for fastening a first relocatable protection system to the first trouser leg of said pair of trousers and to a first leg of a wearer, wherein an end of the strap is configured to be inserted into one of the loops on the first longitudinal side and configured to be drawn out from another one of the loops on the second longitudinal side, and wherein each one of the loops on the second longitudinal side is located opposite to another one of the loops on the first longitudinal side.

15. The pair of trousers of claim 14, wherein the elongated pockets are configured to receive one of a plurality of padding material from the top opening, wherein each of the elongated pockets comprise an auxiliary pocket positioned at a lower section of the elongated pockets, wherein said lower section of each of the elongated pockets is proximal to a shin area of the pair of trousers, wherein each of the auxiliary pockets comprises a separate opening at a top of the auxiliary pockets, and wherein each of the auxiliary pockets are configured to receive a respective one of the plurality of padding material.

16. The pair of trousers of claim 14, wherein the adjacently located loops on the first longitudinal side of the pair of elongated pockets and the adjacently located loops on the second longitudinal side of the pair of elongated pockets extend along an entire length of the pair of elongated pockets.

17. The pair of trousers of claim 14, wherein each of the opening is configured to receive a second strap for fastening a relocatable protection system to the second trouser leg of said pair of trousers and to a second leg of wearer, wherein each of the openings is substantially same size as one of loops, wherein an end of the second strap is configured to be inserted into one of the openings on the first longitudinal side and configured to be drawn out from another one of the openings on the second longitudinal side, and wherein each one of the openings on the second longitudinal side is located opposite to another one of the openings on the first longitudinal side.

18. A kit comprising:

a relocatable protection system, comprising:

a base padding comprising a base padding upper surface and a base padding lower surface, wherein the base padding lower surface is shaped to substantially conform to a wearer's body part;

a shell positioned over said base padding, said shell having an elongated body portion and opposing rounded end portions-a-capsule-shape, said shell comprising a shell upper section, a shell lower section and an intermediate section therebetween;

said shell further comprising at least two pairs of indentations, wherein each of said indentations comprises a cantilever hook projecting perpendicularly upwards from said indentations and disposed proximal to an external wall of said intermediate section, wherein a top end of each of said cantilever hooks comprise a catch;

a slip resistant layer positioned over said shell; and a fastening mechanism disposed between said base padding and said shell, said fastening mechanism comprising:

a plurality of retention members, wherein said retention members are configured to be attached to said shell lower section;

a plurality of straps corresponding to said number of retention members, wherein said straps are configured to fasten said relocatable protection system to said wearer's body part, wherein each of said straps are disposed along a length of one of said retention members and sandwiched between said retention member and said shell lower section; and a plurality of slotted anchor plates, each attached to an end of one of said straps, wherein each of said slotted anchor plates comprise an anchor slot and a plurality of adjuster slots, wherein said end of one of the straps is looped through said adjuster slots to adjust the length of said one of the straps, wherein the anchor slot and the adjuster slots are parallel to each other; and a pair of trousers for accommodating the relocatable protection system, comprising:

a pair of elongated pockets, wherein each one of said pair of elongated pockets is attached to a front section of a trouser leg of the pair of trousers, wherein the elongated pockets comprise a top opening, wherein each of the pair of elongated pockets comprise a plurality of adjacently located loops on a first longitudinal side and a second longitudinal side of the pair of elongated pockets, wherein the pair of elongated pockets comprise a plurality of openings disposed underneath the first and second longitudinal sides of the pair of elongated pockets.

19. The kit of claim 18, wherein each of the loops is configured to receive one of the straps for fastening the relocatable protection system to one of the trouser legs of said pair of trousers and to the wearer's body part, wherein an end of one of the straps is configured to be inserted into one of the loops on the first longitudinal side and the end of the one of the straps is configured to be drawn out from another one of the loops on the second longitudinal side, and wherein each one of the loops on the second longitudinal side is located opposite to another one of the loops on the first longitudinal side.

20. The kit of claim 18, wherein each of the openings is configured to receive one of the straps for fastening the relocatable protection system to one of the trouser legs of said pair of trousers and to the wearer's body part, wherein each of the openings has substantially same size as one of the loops, wherein an end of said one of the straps is configured to be inserted into one of the openings on the first longitudinal side and configured to be drawn out from another one of the openings on the second longitudinal side, and wherein each one of the openings on the second longitudinal side is located opposite to another one of the openings on the first longitudinal side.

21. The kit of claim 18, wherein the base padding lower surface comprises a plurality of circular protuberances, wherein the circular protuberances are arranged in a plurality of rows on the base padding lower surface.

22. The kit of claim 21, wherein the circular protuberances are spaced apart from each other, wherein the circular protuberances in one of the rows along a width of the base padding are offset in position when compared to the circular protuberances in an immediate adjacent row.

* * * * *